US009181687B2

(12) United States Patent
Schuster et al.

(10) Patent No.: US 9,181,687 B2
(45) Date of Patent: Nov. 10, 2015

(54) ADAPTATION OF FLUSH VALVE FOR DUAL FLUSH CAPABILITY

(71) Applicant: Danco, Inc., Irving, CA (US)

(72) Inventors: Michael J. Schuster, Joliet, IL (US); Duston E. A. Stutzman, Plainfield, IL (US); Dwayne A. Porter, New Lenox, IL (US); Douglas C. Saunders, Plainfield, IL (US)

(73) Assignee: DANCO, INC., Irving, TX (US)

( * ) Notice: Subject to any disclaimer, the term of this patent is extended or adjusted under 35 U.S.C. 154(b) by 0 days.

(21) Appl. No.: 14/492,536

(22) Filed: Sep. 22, 2014

(65) Prior Publication Data

US 2015/0013055 A1 Jan. 15, 2015

Related U.S. Application Data

(63) Continuation of application No. 12/715,757, filed on Mar. 2, 2010, now Pat. No. 8,943,620.

(60) Provisional application No. 61/156,701, filed on Mar. 2, 2009, provisional application No. 61/162,291, filed on Mar. 21, 2009.

(51) Int. Cl.
*E03D 1/14* (2006.01)
*E03D 1/34* (2006.01)

(52) U.S. Cl.
CPC .. *E03D 1/14* (2013.01); *E03D 1/34* (2013.01); *Y10T 29/49826* (2015.01)

(58) Field of Classification Search
CPC ..... E03D 1/142
USPC ..... 4/300–442
See application file for complete search history.

(56) References Cited

U.S. PATENT DOCUMENTS

| | | | | |
|---|---|---|---|---|
| 3,744,064 | A | 7/1973 | Preston | |
| 3,758,893 | A | 9/1973 | Smolinski et al. | |
| 3,839,746 | A | 10/1974 | Kowalski | |
| 3,839,747 | A * | 10/1974 | Clark | 4/327 |
| 3,988,785 | A | 11/1976 | Schoepe et al. | |
| 4,145,774 | A | 3/1979 | Sullivan | |
| 4,145,775 | A | 3/1979 | Butler | |
| 4,329,260 | A | 5/1982 | Lester et al. | |
| 4,391,003 | A | 7/1983 | Talerico et al. | |
| 4,485,501 | A * | 12/1984 | Kloner | 4/324 |
| 4,488,388 | A | 12/1984 | Schmidt | |
| 4,707,867 | A | 11/1987 | Kawabe et al. | |
| 4,764,996 | A | 8/1988 | Pino | |
| 4,918,764 | A | 4/1990 | Haselswerdt et al. | |
| 5,036,553 | A | 8/1991 | Sanderson | |

(Continued)

OTHER PUBLICATIONS

Fluidmaster 555CC Flapper, Drain Seat & Timing Cup Installation Instructions—Feb. 1999.

(Continued)

*Primary Examiner* — Lori Baker
(74) *Attorney, Agent, or Firm* — Thomas | Horstemeyer, LLP

(57) ABSTRACT

Various apparatuses and methods that facilitate dual flush capability are presented. In one embodiment, an apparatus is provided that includes a dual flush mechanism configured to provide for a dual flush capability in a toilet. The dual flush mechanism can include a basket structure. A gasket can be attached to the dual flush mechanism. The gasket can form a seal between the dual flush mechanism and a flush orifice of a flush valve.

21 Claims, 56 Drawing Sheets

(56) References Cited

U.S. PATENT DOCUMENTS

| | | | | |
|---|---|---|---|---|
| 5,134,729 | A | 8/1992 | Shaw | |
| 5,211,204 | A | 5/1993 | Mikol | |
| 5,325,547 | A | 7/1994 | Pino | |
| 5,432,959 | A | 7/1995 | Ellsworth et al. | |
| 5,469,586 | A | 11/1995 | Tsutsui et al. | |
| 5,742,951 | A | 4/1998 | Wright et al. | |
| 5,794,279 | A | 8/1998 | Schwartz | |
| 5,862,537 | A | 1/1999 | Osmond | |
| 6,202,227 | B1 | 3/2001 | Gurowitz | |
| 6,263,519 | B1 | 7/2001 | Parsons et al. | |
| 6,263,520 | B1 * | 7/2001 | Song | 4/325 |
| 6,823,889 | B1 | 11/2004 | Schuster | |
| 6,829,787 | B1 * | 12/2004 | Pipenburg | 4/393 |
| 6,837,264 | B1 | 1/2005 | Schuster | |
| 7,073,209 | B1 | 7/2006 | McCormick | |
| 7,140,050 | B2 | 11/2006 | Muderlak | |
| 7,526,819 | B2 * | 5/2009 | Beaupre | 4/327 |
| 8,584,268 | B2 * | 11/2013 | Han | 4/405 |
| 8,833,727 | B2 * | 9/2014 | Wilson | 251/40 |
| 8,943,620 | B2 * | 2/2015 | Schuster et al. | 4/324 |
| 2004/0068784 | A1 | 4/2004 | Muderlak | |
| 2005/0172387 | A1 | 8/2005 | Higgins | |
| 2008/0201833 | A1 | 8/2008 | Scruggs | |
| 2010/0218308 | A1 * | 9/2010 | Schuster et al. | 4/325 |
| 2012/0017363 | A1 * | 1/2012 | Schuster et al. | 4/324 |

OTHER PUBLICATIONS

International Search Report and Written Opinion in PCT/US2010/025890 mailed May 3, 2010.

* cited by examiner

FIG. 10A
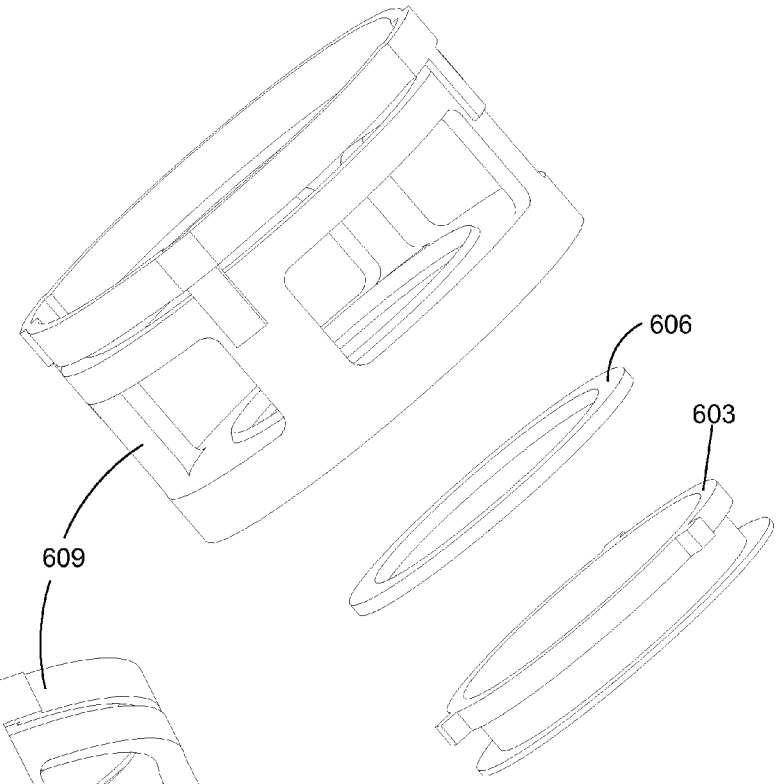
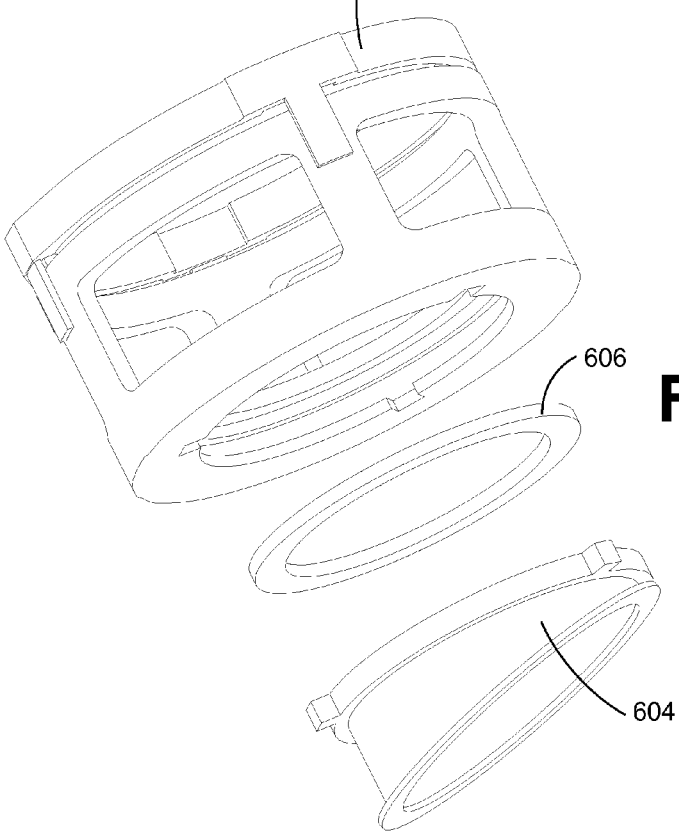
FIG. 10B

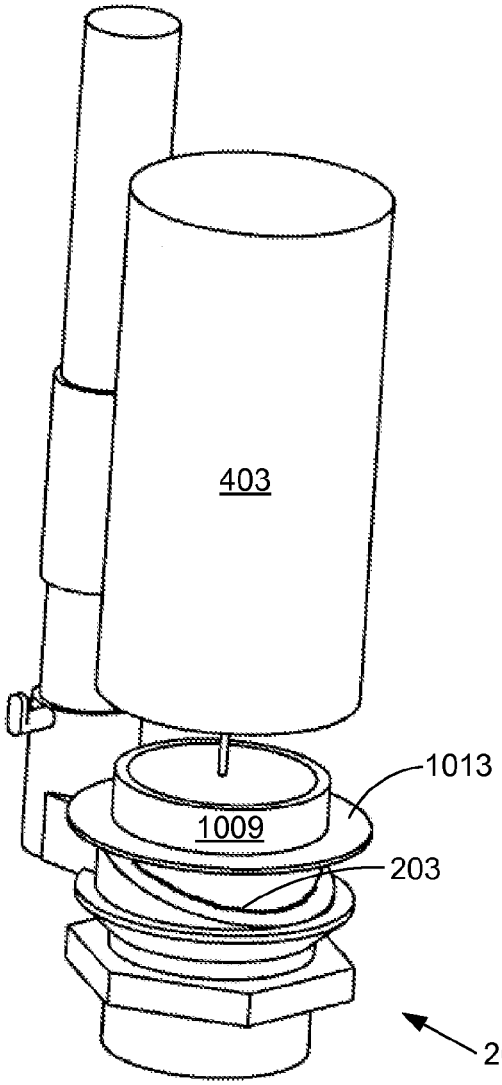
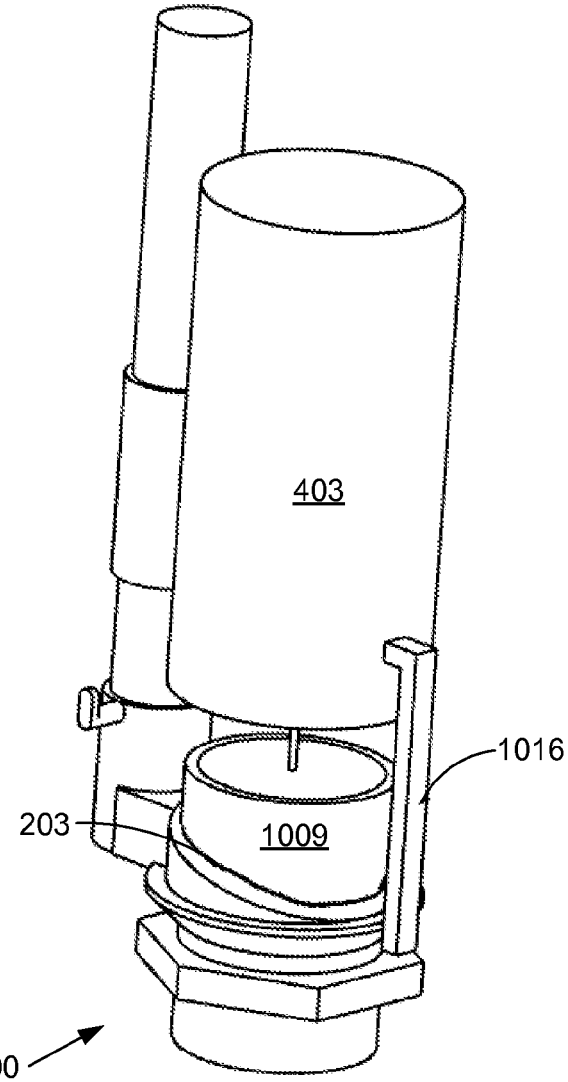
200
FIG. 25
FIG. 26

ADAPTATION OF FLUSH VALVE FOR DUAL FLUSH CAPABILITY

CROSS REFERENCE TO RELATED APPLICATIONS

This application is a continuation of, and claims priority to, copending U.S. nonprovisional application entitled "ADAPTATION OF FLUSH VALVE FOR DUAL FLUSH CAPABILITY" having Ser. No. 12/715,757, filed Mar. 2, 2010, which is incorporated herein by reference in its entirety and which claims priority to both U.S. provisional application entitled "DUAL FLUSH ADAPTION" having Ser. No. 61/156,701, filed Mar. 2, 2009, and U.S. provisional application entitled "ADAPTION OF FLUSH VALVES" having Ser. No. 61/162,291, filed Mar. 21, 2009, both of which are incorporated herein by reference in their entireties.

BACKGROUND

Most toilets in the United States feature a single flush capability that typically uses more water than is needed to flush urine and tissue. This translates into a colossal waste of water each year. Also, typical flush valves that include a flapper preclude the use of other flush technologies without significant effort needed to remove a toilet tank, remove an existing flush valve, and install a new style flush valve, or result in limited fit or function.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

FIGS. 10A-D show various flush adapters according to various embodiments.

FIGS. 24-27 illustrate examples of flappers of the dual flush canister according to various embodiments.

DETAILED DESCRIPTION

Figure 1A:
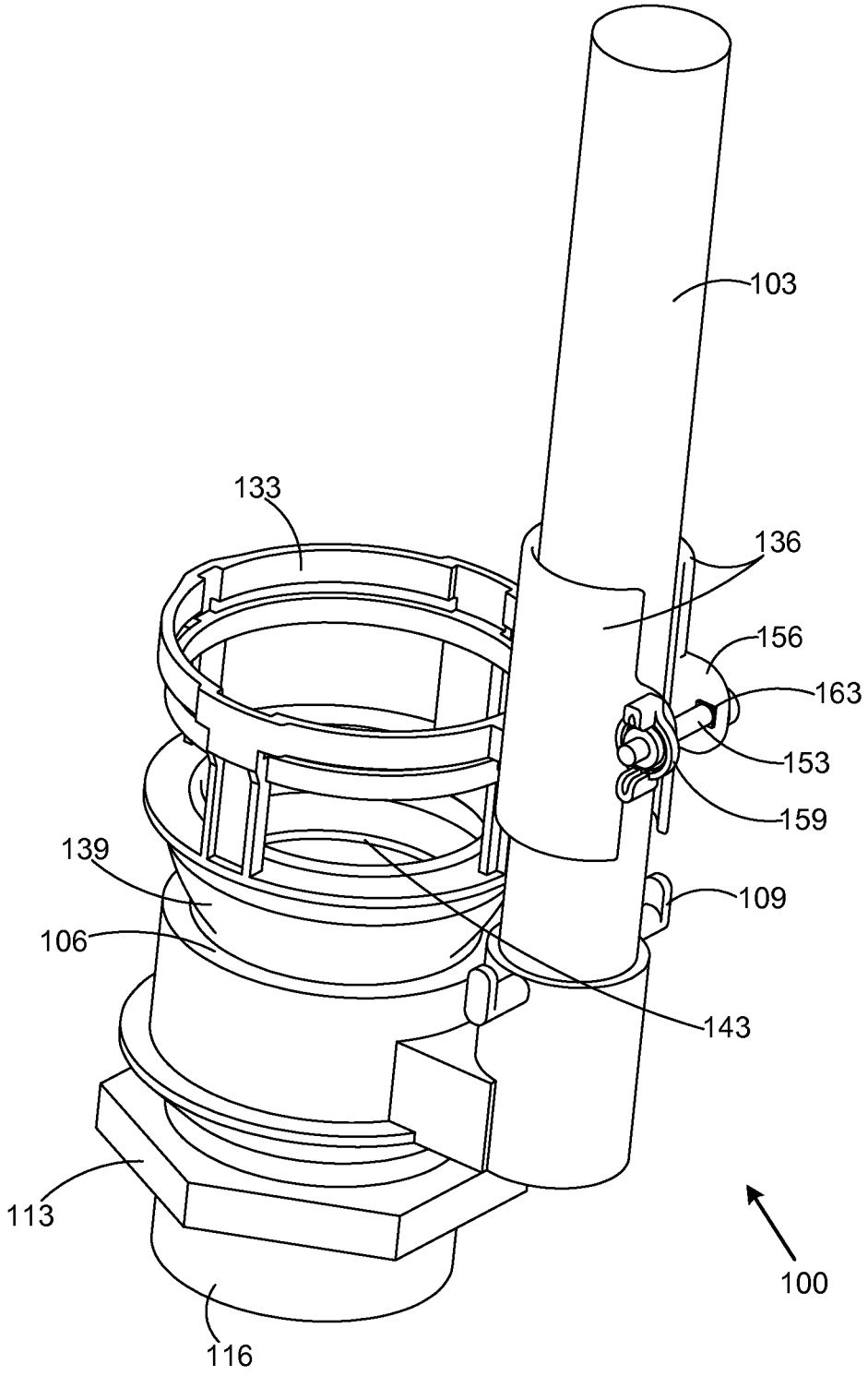
FIGS. 1A-D are drawings that provide various views of single flush toilet flush valve with a dual flush adapter according to various embodiments.
Figure 1B:
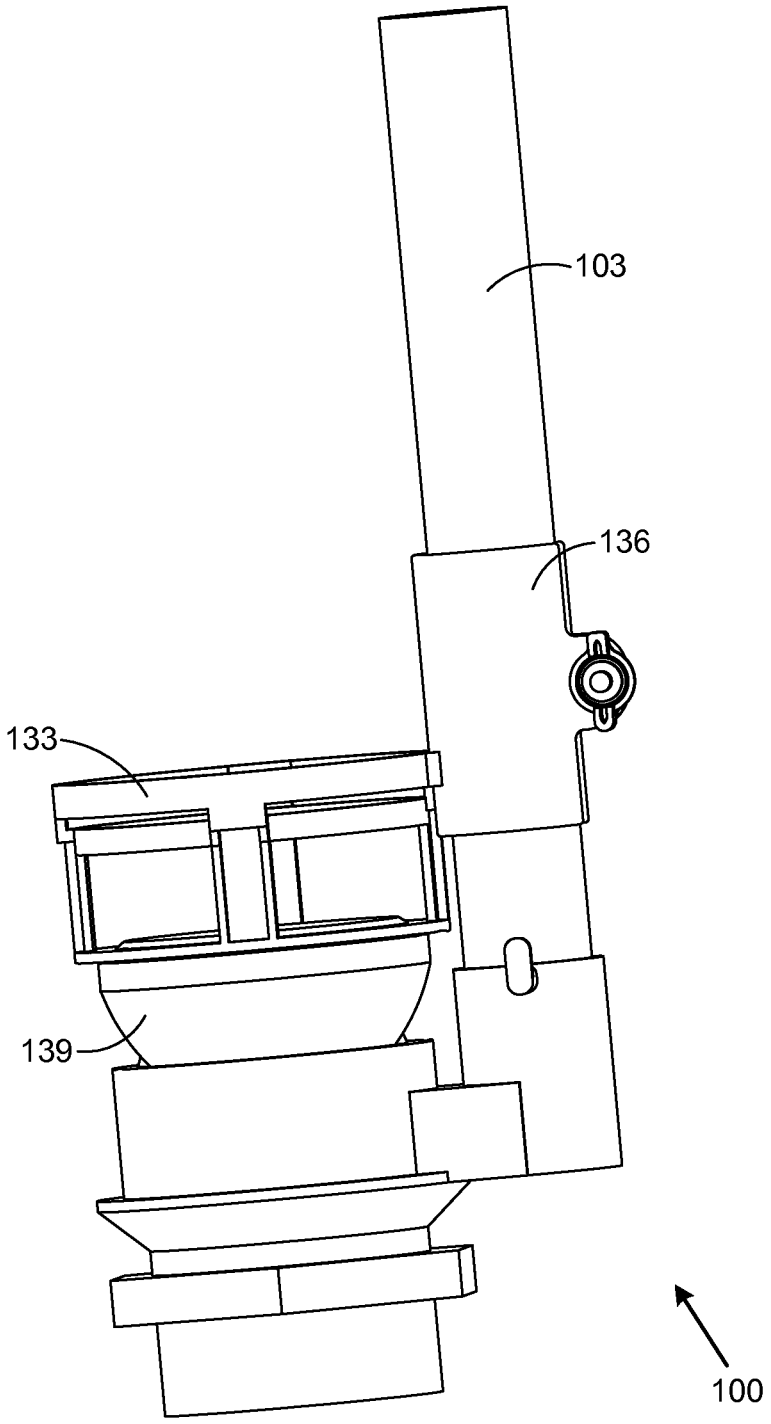

With reference to FIGS. 1A-D, shown are various views of a toilet flush valve 100 that includes an overflow tube 103. The flush valve 100 is generally employed in gravity toilets and includes an orifice 106 through which water drains into a toilet bowl during a flush of a toilet as can be appreciated. The orifice 106 is typically sealed using a flapper that hinges upon ears 109 that extend from the sides of the overflow tube 103. Some flush valves do not use a flapper or have ears 109 as such as might be the case with a ball-type flush valve, but typically include an overflow tube 103. In any event, the flush valves as described herein are those that are configured to seat a flapper, flush ball, gasket, or other sealing member to ensure that water does not leak into the toilet bowl until a flush is initiated.

A sealing washer such as a rubber washer or other sealing structure is sandwiched between the flush valve 100 and the bottom of the tank as can be appreciated. The flush valve 100 also includes a retaining nut 113 that is used to secure the flush valve 100 to the bottom of a toilet tank and serves to compress the rubber washer or other sealing structure. The flush valve 100 includes a threaded portion 116 upon which the retaining nut 113 is fastened. Also, another gasket may be employed to seal between the toilet tank and the toilet bowl.

Also depicted in FIGS. 1A-D is an adapter 133. The adapter includes a clamp 136 that can be affixed to the overflow tube 103 as shown. To this end, the adapter 133 can move up and down with the clamp 136 sliding up and down the overflow tube until the clamp 136 is tightened as shown. Attached to the adapter 133 is a gasket 139. The gasket 139 is configured to be compatible with the flush orifice 106 such that it can mate with the junction forming a seal between the gasket 139 and the flush orifice 106. Also, the gasket 139 is attached to the bottom of the adapter 133 in such a manner that a seal is formed at the junction between the adapter 133 and the gasket 139. The adapter 133 may be viewed as a basket that includes a flush orifice 143 that is compatible with various flush mechanisms such as dual flush devices, siphonic flush valves, electronically operated dual flush valves, or other flush mechanisms. Although the following discussion mentions dual flush mechanisms, it is understood that the adapter 133 is not limited for use with such dual flush mechanisms, and that other flush mechanisms may be mated with the adapter 133 as desired.

The adapter 133 is configured to mate with a flush mechanism such as a dual flush canister so that the dual flush canister can open or close the flush orifice 143 to implement a flush of a toilet. To this end, two different flushes may be implemented. One uses a minimum amount of water to flush urine and tissue down the drain. The second uses an additional amount of water to flush excrement and tissue, etc., down the drain.

To tighten the clamp 136 on the overflow tube 103, a carriage bolt 153 extends through holes of ears 156 associated with the clamp 136. The carriage bolt 153 includes a wing nut 159 that, when tightened, causes the leaves of the clamp 136 to compress the overflow tube 103. The carriage bolt 153 includes a square portion 163 that mates with a square hole in a given one of the ears 156 to prevent the carriage bolt from rotating when the wing nut 159 is tightened. In other embodiments, the clamp 136 may be tightened on the overflow tube 103 using spring clamps, self-tapping screws, or other appropriate fasteners. For example, FIG. 4B illustrates the use of a zip tie 166 (or cable tie) to tighten clamp 136 on the overflow tube 103.

By virtue of the adapter 133 being mated with the flush orifice 106 by way of the gasket 139, an existing single flush valve 100 that may already be installed in a toilet can be converted to a dual flush mechanism. To this end, the adapter 133 and the gasket 139 facilitate conversion of existing single flush valves 100 to dual flush mechanisms. Specifically, the adapter is slid down over the overflow tube 103 until the gasket 139 engages the flush orifice 106. An individual may then press the adapter 133 downward such that the gasket 139 mates properly with the flush orifice 106 and seals the junction there between.

To this end, the gasket 139 may be deformed slightly to provide for a better seal. At this point, the adapter 133 may be held in place until the wing nut 159 is tightened, thereby tightening the clamp 136 onto the overflow tube 103. In this manner, the adapter 133 is held into place. In addition, when water fills up in a toilet tank, water pressure against the adapter assembly aids in holding the adapter 133 in the proper position to maintain the seal formed between the flush orifice 106 and the gasket 139. The flush valve 100 as shown in FIGS. 1A-D is a horizontal style flush valve in that the flush orifice 106 is oriented in a horizontal direction relative to the bottom wall of a toilet tank in which the flush valve 100 is installed.

Figure 1C:
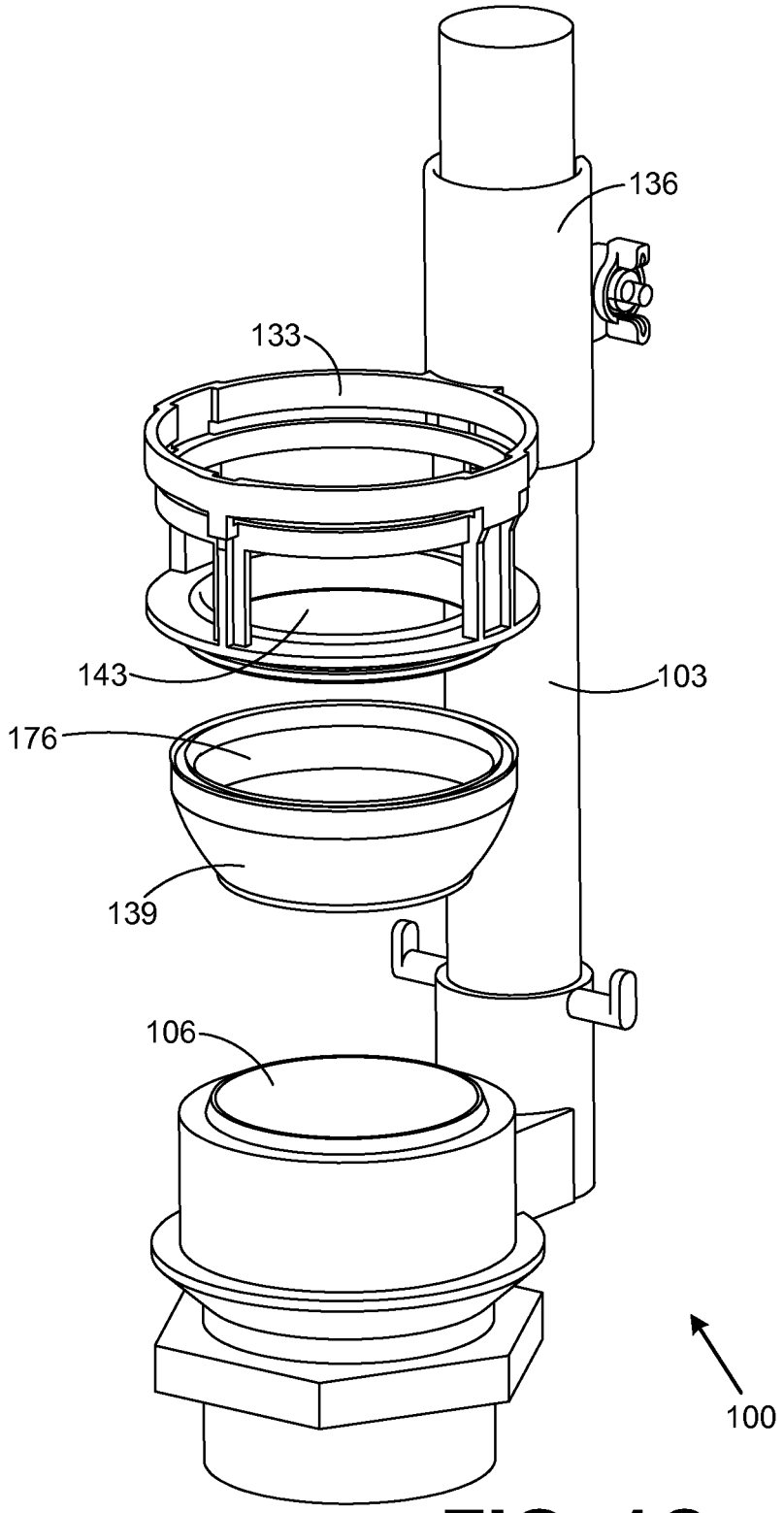
Figure 1D:
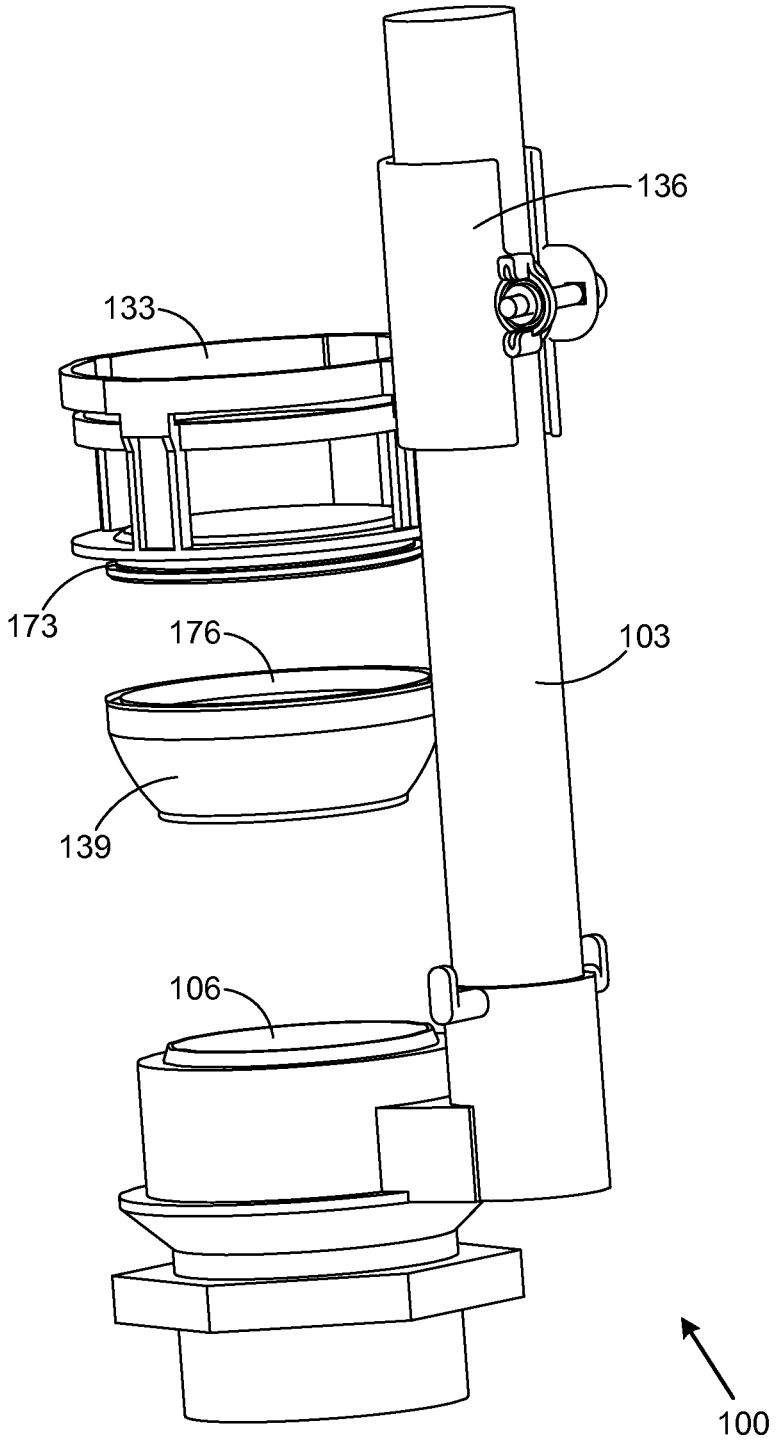

With specific reference to FIGS. 1C and 1D, shown are exploded views of the adapter 133 with the gasket 139 separated. As depicted in FIG. 1D, the adapter 133 includes an annular recess 173 which mates up with an inward annular projection 176 on the gasket 139 to provide for a seal between the adapter 133 and the gasket 139 as will be described in greater detail.

Figure 2A:
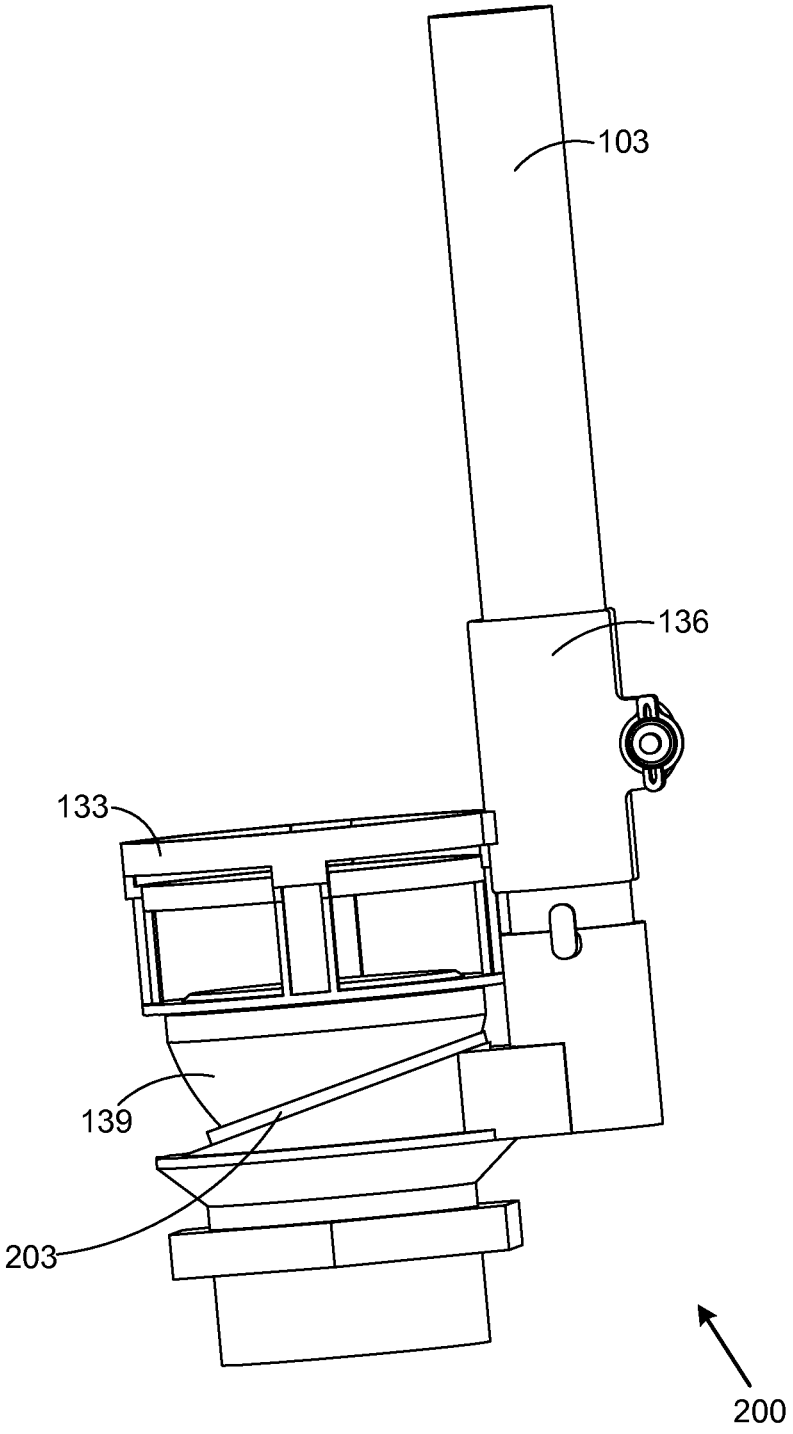
FIGS. 2A-C are drawings that provide various views of another single flush toilet flush valve with a dual flush adapter according to various embodiments.
Figure 2B:
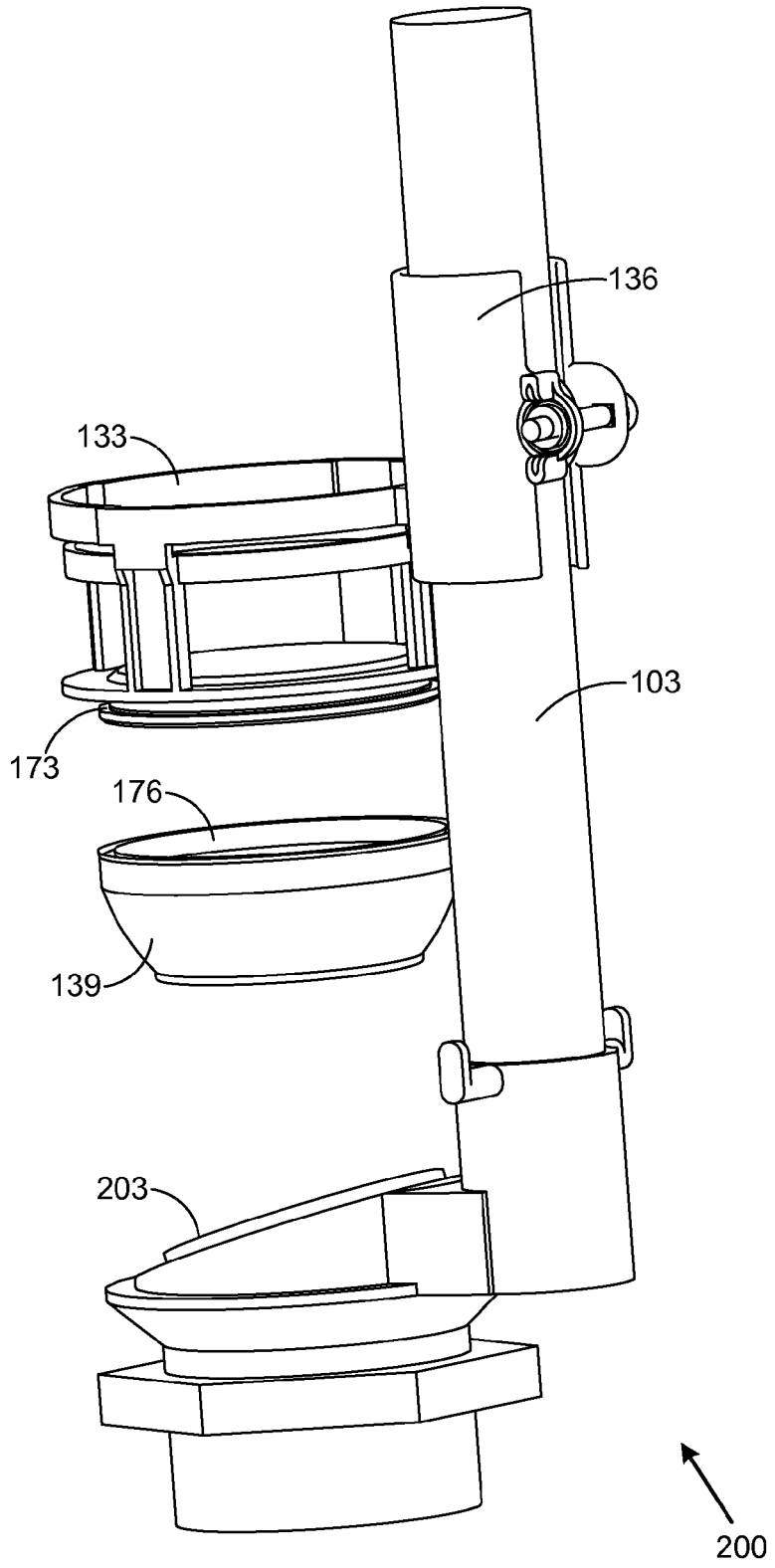
Figure 2C:
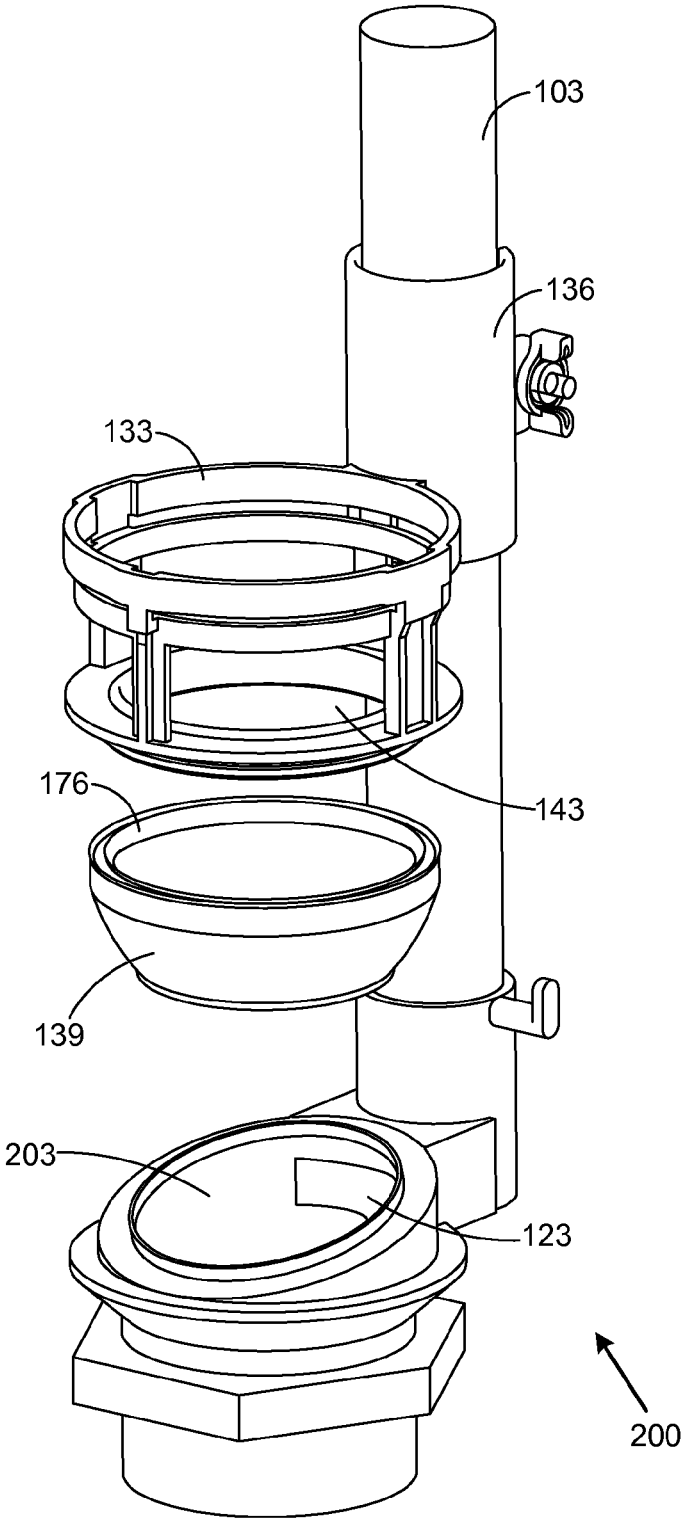

With reference next to FIGS. 2A-C, shown is a flush valve 200 that includes an angled flush orifice 203. To this end, the flush valve 200 is much the same as the flush valve 100 except for the fact that the flush orifice 203 is angled to accommodate the type of flapper or sealing member used to contain the water in the toilet tank and operate a flush cycle as can be appreciated. The adapter 133 and the clamp 136 are unchanged. The gasket 139 may be shaped to conform with the orifice 203 to the extent that the orifice 203 is elliptical in nature relative to the gasket 139 due to the angling of the flush orifice 203.

Figure 3A:
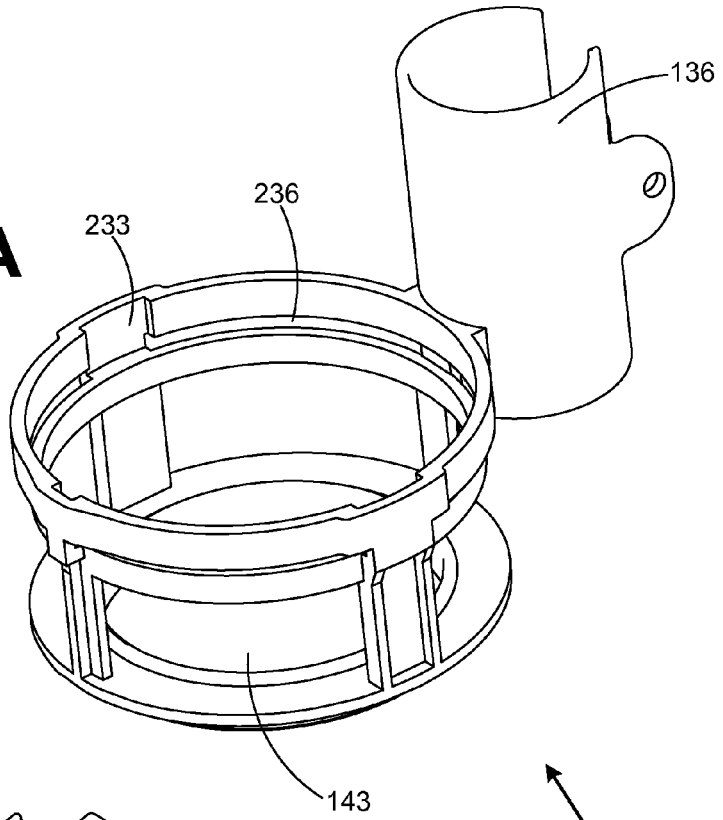
FIGS. 3A-C are drawings that provide various views a dual flush adapter employed in the toilet flush valves of FIGS. 1A-D or FIGS. 2A-C according to various embodiments.
Figure 3B:
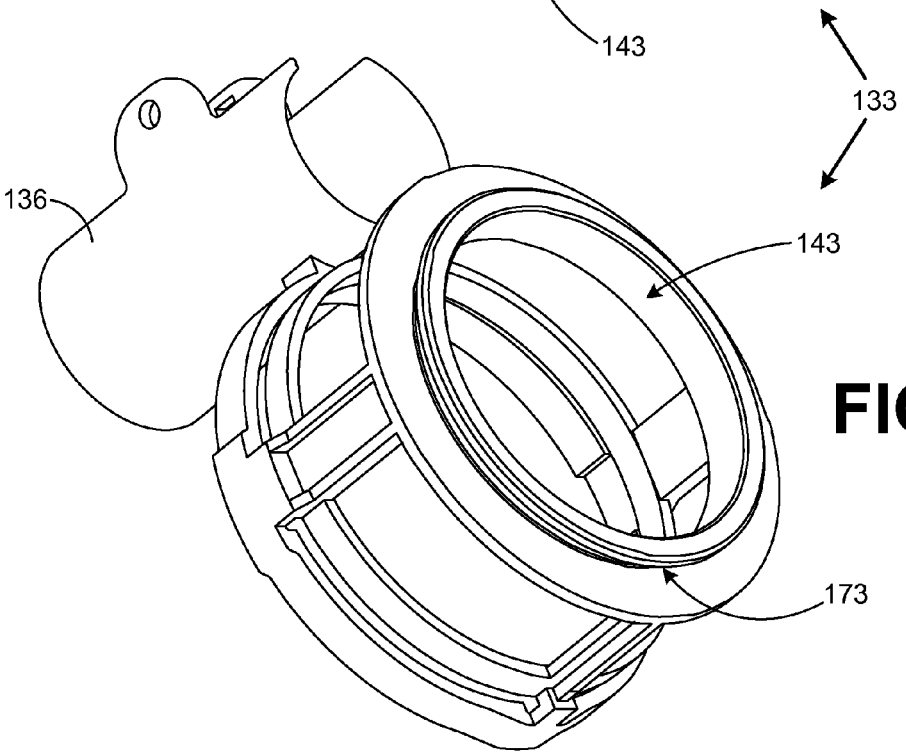
Figure 3C:
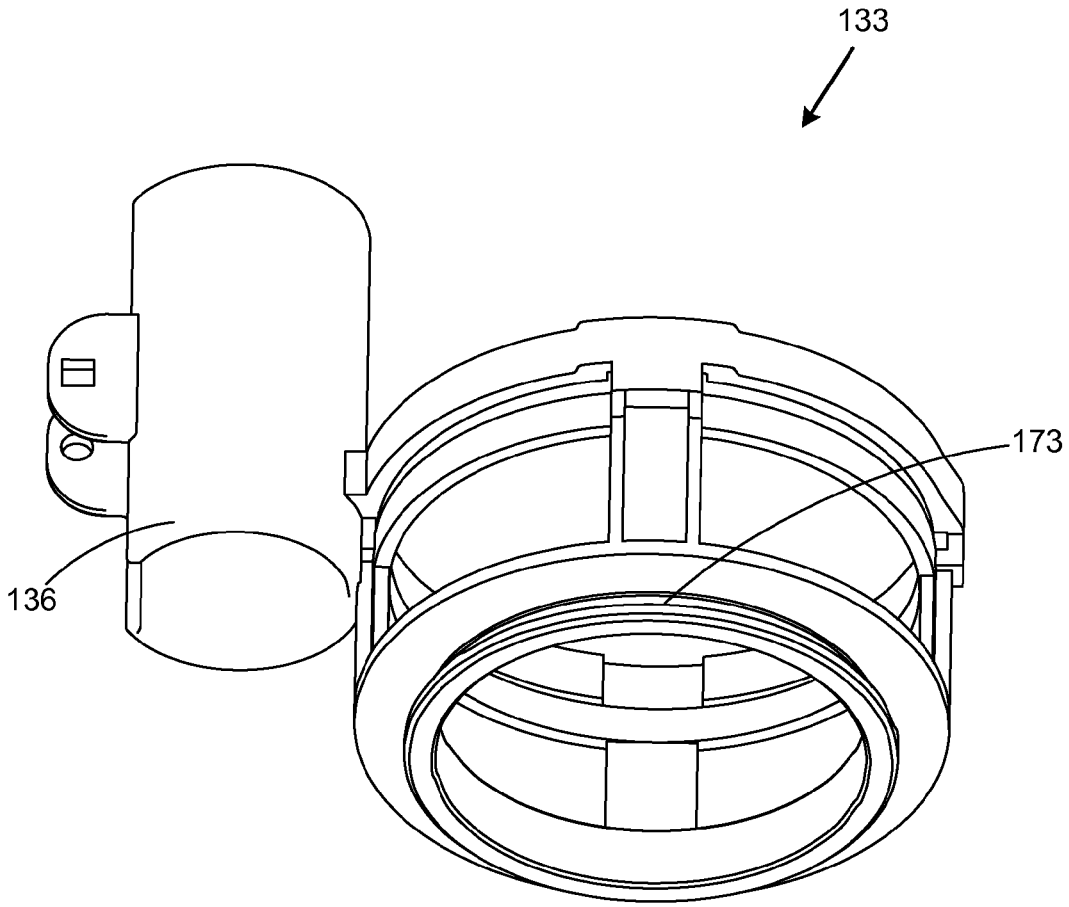

With reference then to FIGS. 3A-C, shown are various views of the adapter 133. As shown with respect to FIG. 3A, the adapter includes slots 233 and an annular groove 236. The slots 233 and annular groove 236 are provided so as to allow a flush canister to mate with the adapter 133. To this end, the dual flush canister includes ears that extend outward and are compatible with the slots 233. Such ears can be lowered down into the slots 233. Once such ears reach the bottom of the slots 233, the dual flush canister may be rotated 360 degrees, where the ears rotate within the annular groove 236. This allows the dual flush canister to be positioned in any orientation needed to facilitate connection with flush mechanisms such as cables and push buttons, etc. Other connections main include ears and slots configured differently and may offer limited travel as can be appreciated. In addition, the depiction of the adapter 133 in FIGS. 3B and 3C clearly show the annular recess 173 at the bottom of the adapter 133 that mates with the gasket 139 (FIG. 1).

Figure 4A:
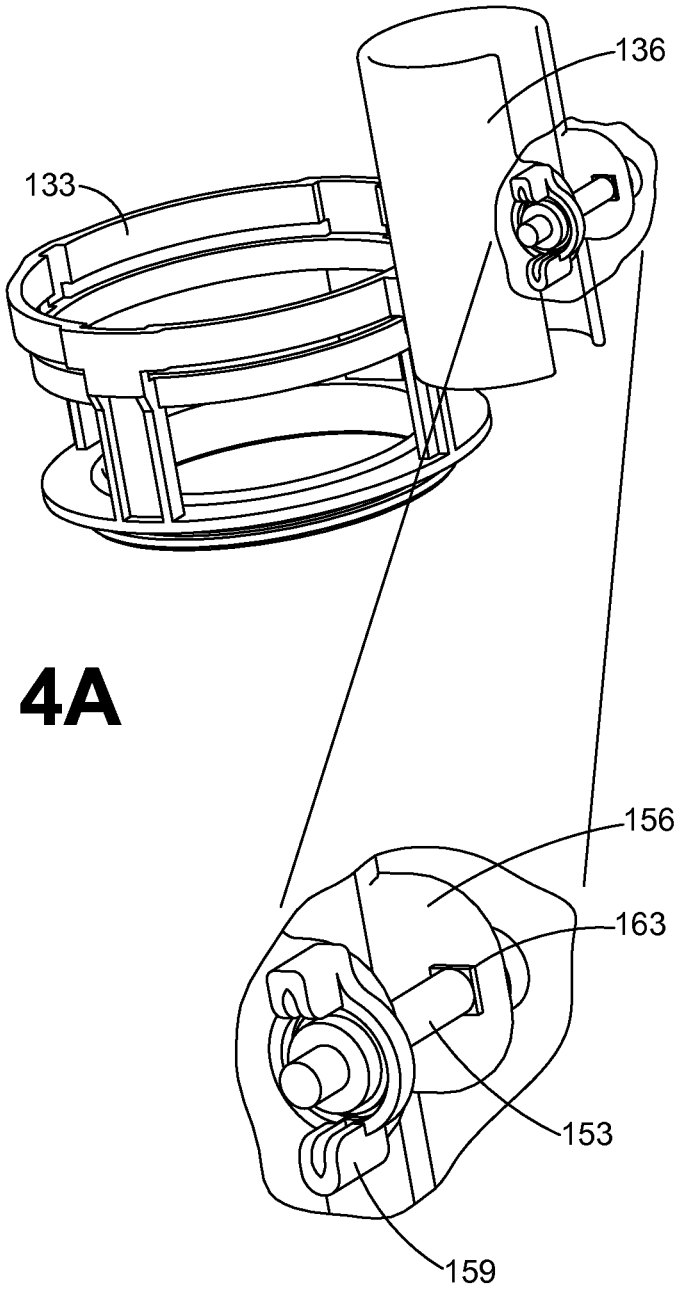
FIGS. 4A-G are drawings that provide views of clamping devices on the dual flush adapter of FIGS. 3A-C according to various embodiments.
Figure 4B:
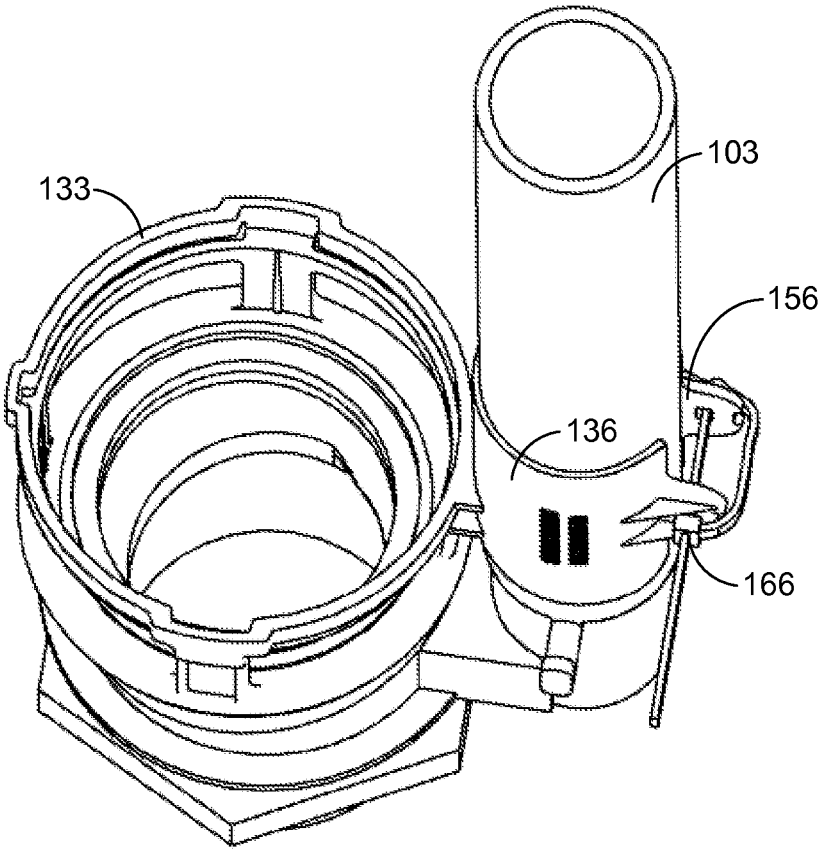

Referring next to FIG. 4A, shown is a view of the adapter 133 that further shows a greater view of the carriage bolt 153 as it pulls the ears 156 of the clamp 136 together to compress onto the overflow tube 103. To this end, the square portion 163 of the carriage bolt 153 fits in a square hole of one of the ears 156 to prevent the carriage bolt 153 from turning when the wing nut 159 is tightened as described above. Other fasteners may be utilized to compress the ears 156 of the clamp 136 onto the overflow tube 103. For example, FIG. 4B illustrates the use of a zip tie 166 (or cable tie) to tighten clamp 136 around the overflow tube 103. The clamp 136 may not be split as shown and may be circular with a diameter larger than the overflow tube 103.

Figure 4C:
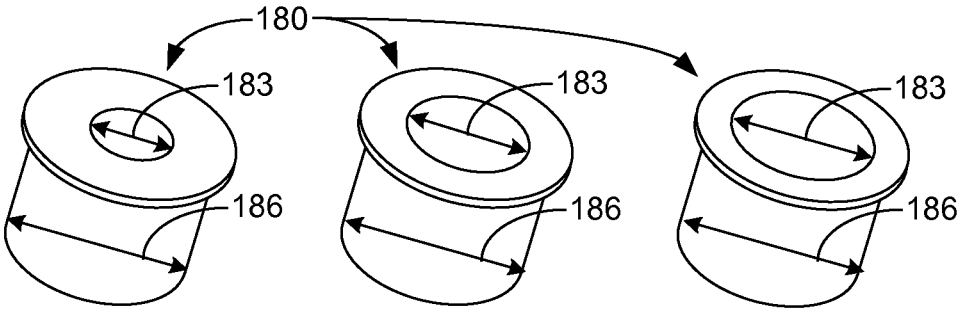

In some embodiments, sleeve adapters 180 may be utilized to allow for variations in overflow tube diameters. A sleeve adapter 180 may be slide between the overflow tube 103 and the clamp 136 before compressing the ears 156 of the clamp 136. If the clamp 136 is not split (as mentioned above), sleeve adapters 180 may be compressed between the overflow tube 103 and the clamp 136 to secure the adapter in position. As depicted in FIG. 4C, different sleeve adapters 180 may include an inner sleeve diameter 183 corresponding to the different sizes of the overflow tubes 103 and a common outer diameter 186 associated with the clamp 136. Alternatively, outer diameters 186 may vary to allow the sleeve adapters 180 to nest together, thereby accommodating different tube diameters.

Figure 4D:
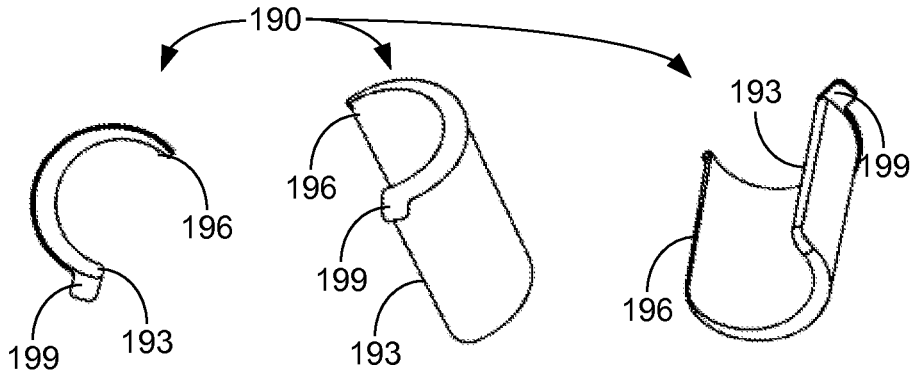

In other embodiments, a cam adjuster 190 may be used to allow for variations in overflow tube diameters, as well as compensating for alignment of the gasket 139 with the orifice 106/203. With reference to FIG. 4D, shown are various views of an exemplary cam adjuster 190. As illustrated in FIG. 4D, the cam adjuster 190 is a crescent shaped sleeve that tapers in thickness from a first end 193 to a second end 196. A tab 199 may be used to allow for insertion, removal, and adjustment of the cam adjuster 190 between the overflow tube 103 and the clamp 136.

Figure 4E:
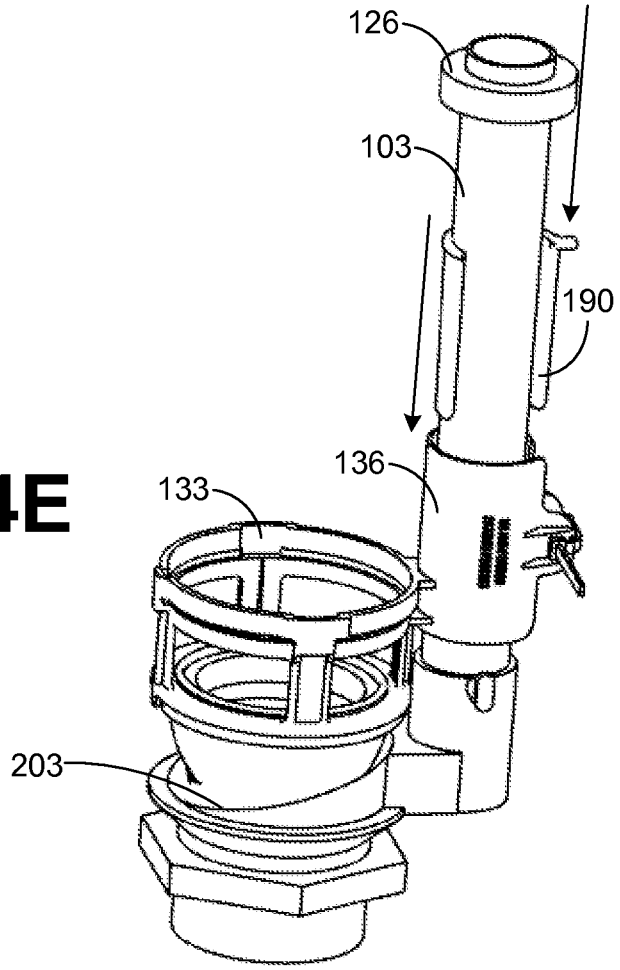
Figure 4F:
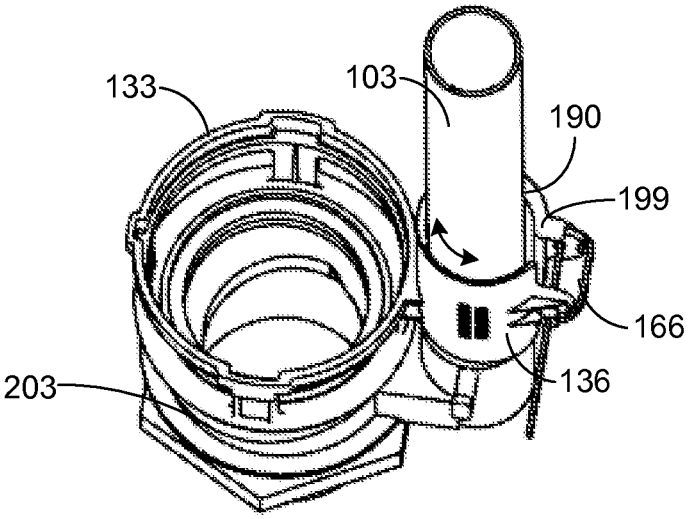
Figure 4G:
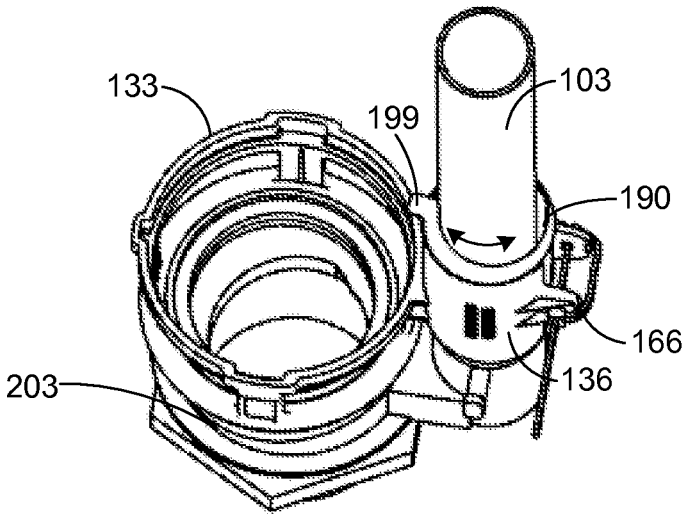

FIGS. 4E-G illustrate the operation of the cam adjuster 190. Beginning with FIG. 4E, the cam adjuster 190 is inserted between the overflow tube 103 and the clamp 136. With the cam adjuster 190 inserted, the cam adjuster may be rotated about the overflow tube 103 using tab 199 as illustrated by FIGS. 4F-G. The offset produced by the taper along the curved surface of the cam adjuster 190 provides for radial adjustment of the clamp 136 and, thus, adjustment of the alignment of the gasket 139 with the orifice 203. Once the cam adjuster 190 is in position, the fastener (e.g., zip tie 166) is tightened to compress the ears 156 of the claim 136. The cam adjuster 190 may be constructed of flexible material such as, but not limited to, polyethylene or rubber to allow the cam adjustor to deform to provide even clamping around the overflow tube 103. As illustrated in FIG. 4E, a compression ring 126 (see also 1126 of FIG. 31) may be positioned on the overflow tube 103 over the top of the cam adjuster 190. An interference fit around the overflow tube 103 may assist in securing the cam adjuster 190 in position between the overflow tube 103 and the clamp 136, as well as provide an additional force for securing the gasket 139 in the orifice 203.

Figure 5:
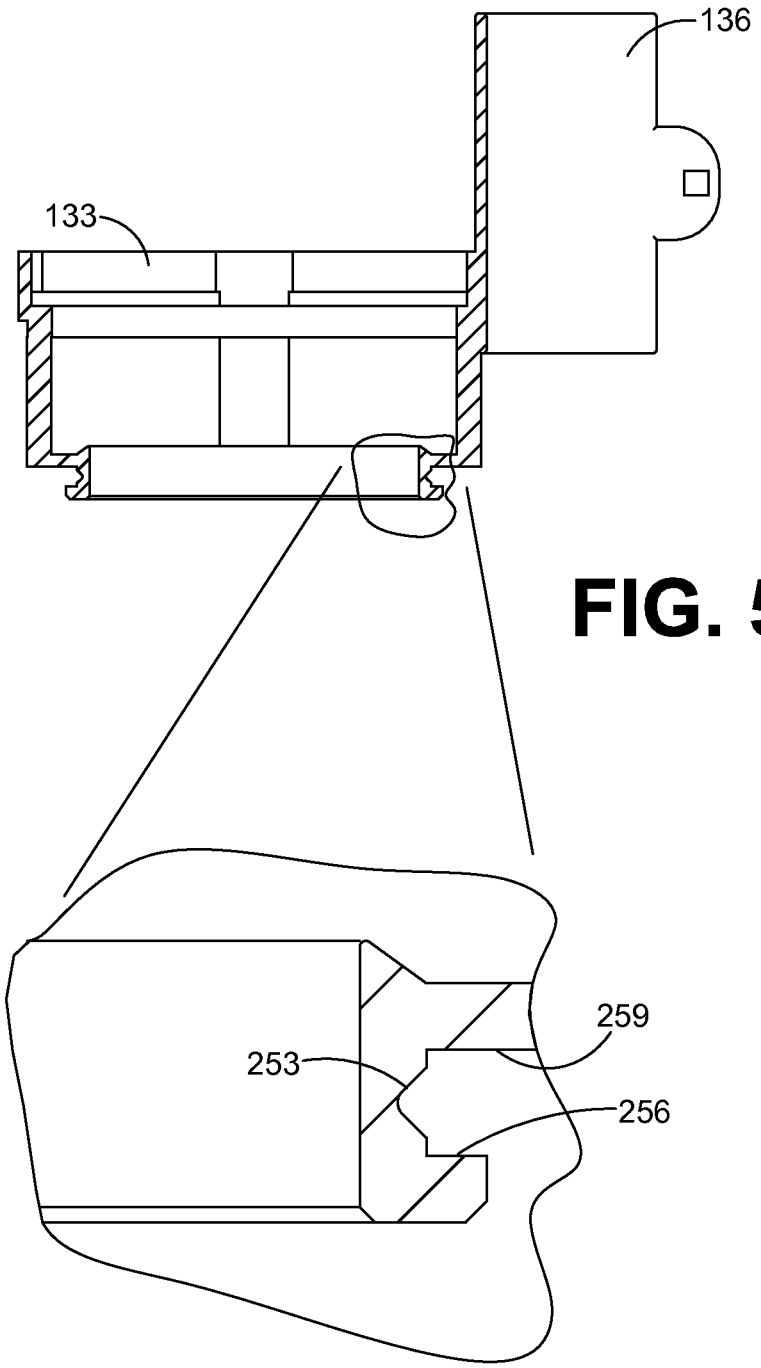
FIG. 5 is a drawing of that provides a cutaway view of the dual flush adapter of FIGS. 3A-C according to various embodiments.

With reference to FIG. 5, shown is a cutaway view of the adapter 133 that particularly illustrates the nature of the annular recess 173. The annular recess 173 may include a pointed recess portion 253 that provides a friction sealing surface. Also, the annular recess 173 includes sealing surfaces 256 and 259. Additionally, any other surfaces within the annular recess 173 may be friction sealing surfaces when the inward annular projection 176 (FIG. 1D). The sealing surfaces 256 and 259 are configured to come into contact with annular sealing projections associated with the inward annular projection 176 as described above. Also, the pointed annular recess 253 mates with a corresponding portion of the inward annular projection 176 as will be described.

Figure 6A:
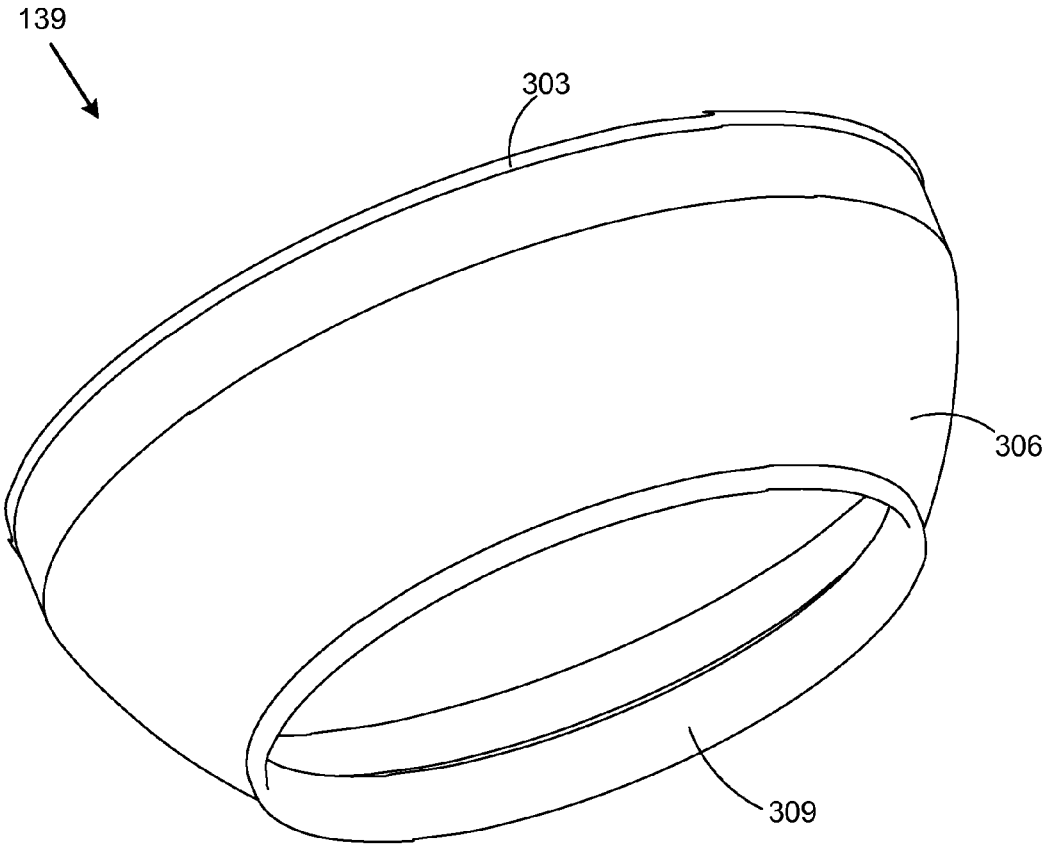
FIGS. 6A-J are drawings that provide various views of gaskets that attach to the dual flush adapter of FIGS. 3A-C according to various embodiments.
Figure 6B:
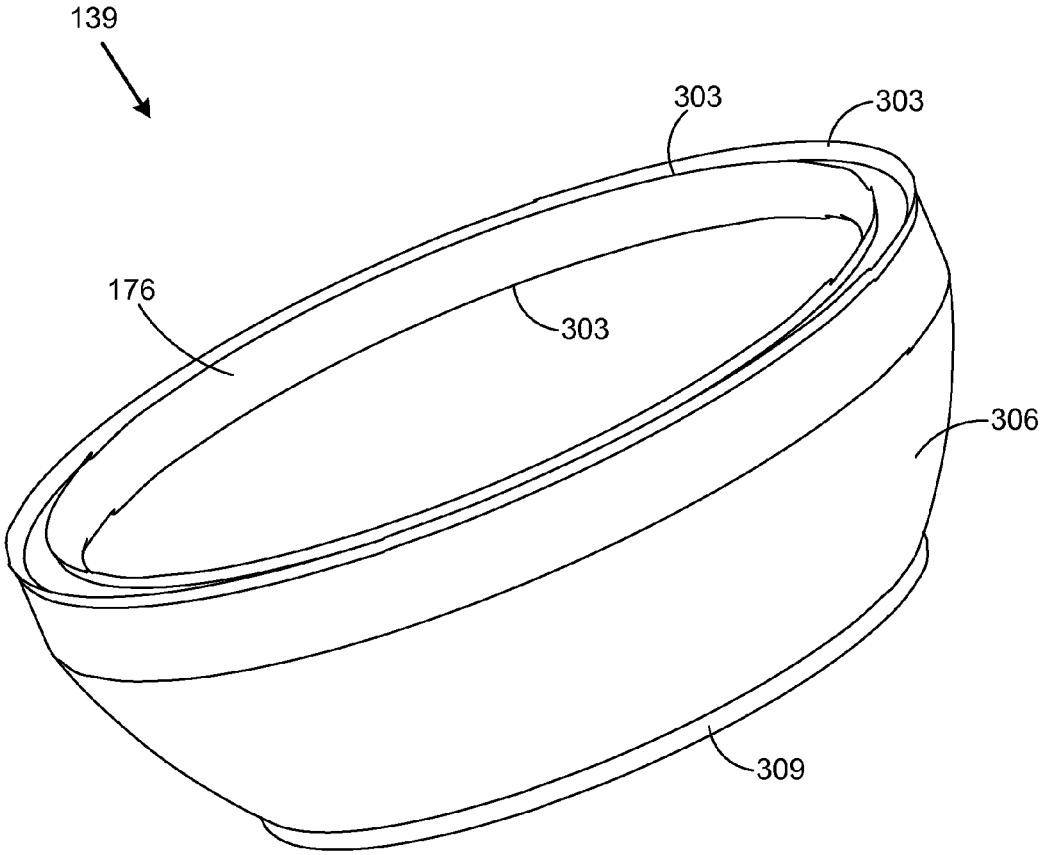

With reference next to FIGS. 6A and 6B, shown are views of a gasket 139 according to various embodiments. The gasket 139 includes annular sealing projections 303 that extend upward from the inward annular projection 176 of the gasket 139. In addition, an annular sealing projection 303 extends downward from the inward annular projection 176.

Figure 6C:
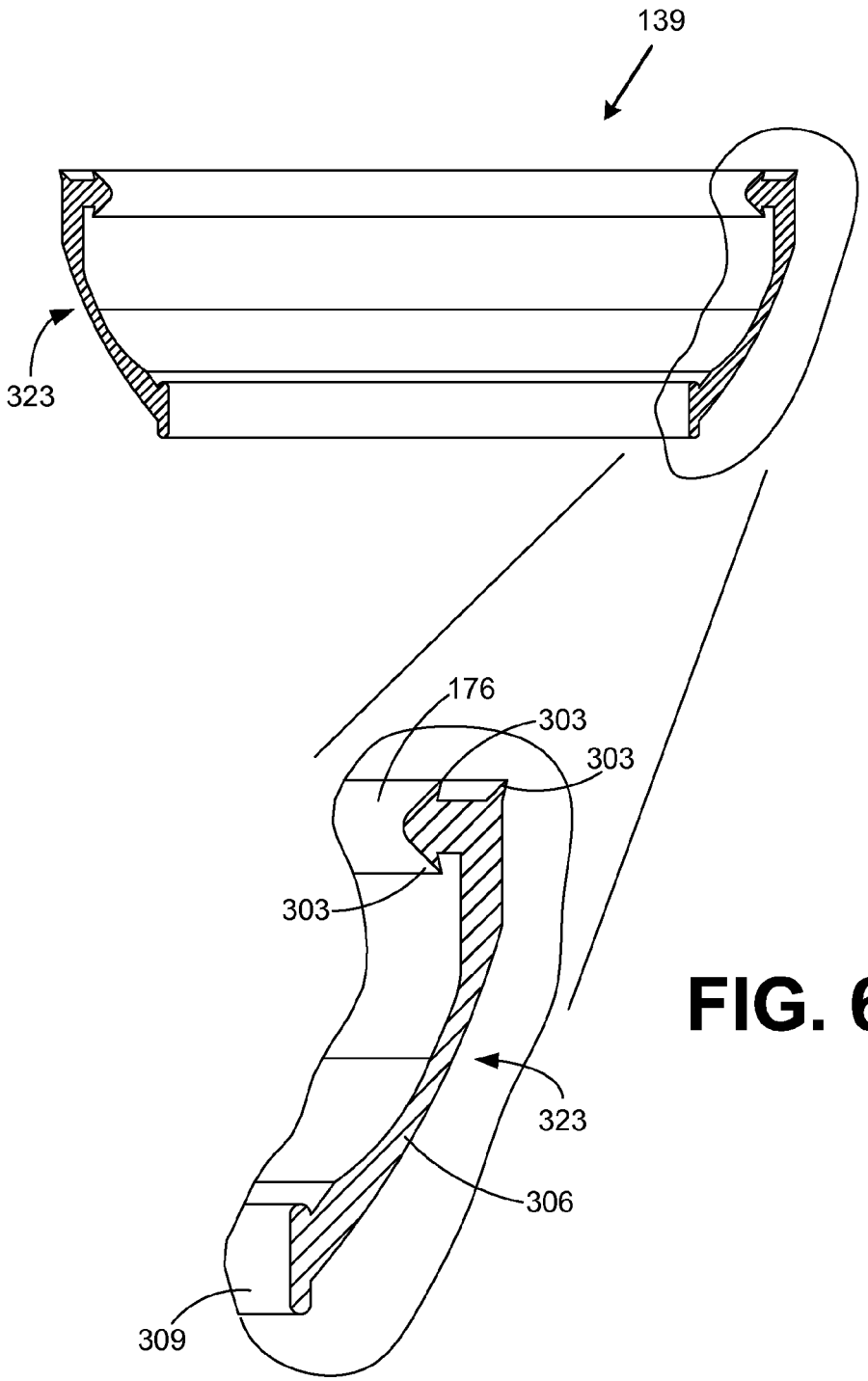

The gasket 139 is of a domed design allowing it to work on a multitude of different flush valves. The gasket 139 includes a side wall 306 that may provide a greater degree of compliance relative to the compliance of an annular support structure 309 at the bottom of the gasket 139 and relative to the inward annular projection 176. The annular support structure 309 is a pseudo I-beam or extension structure that may promote and/or maintain the integrity of the opening of the gasket 139 to allow water to move into the flush orifice 106/203 without restricting the flow of water exiting the tank during a flush. The sidewalls 306 of the gasket 139 include thinner portions that provide the greater degree of compliance so that the gasket 139 can conform with the orifices 106/203 to provide for an adequate seal. The annular sealing projections 303 provide for sealing against the sealing surfaces 256/259 (FIG. 5) of the annular recess 173 (FIG. 5). With reference to FIG. 6C, shown is a cutaway view of the gasket 139 that depicts the inward annular projection 176, the annular sealing projections 303, the sidewall 306, and the annular support structure 309. In the embodiment of FIG. 6C, the sidewall 306 includes a thinner portion 323 in the center portion of the sidewall 306 allowing this area to deform while maintaining the structural integrity of both the upper and lower portions of the domed gasket 139.

Figure 6D:
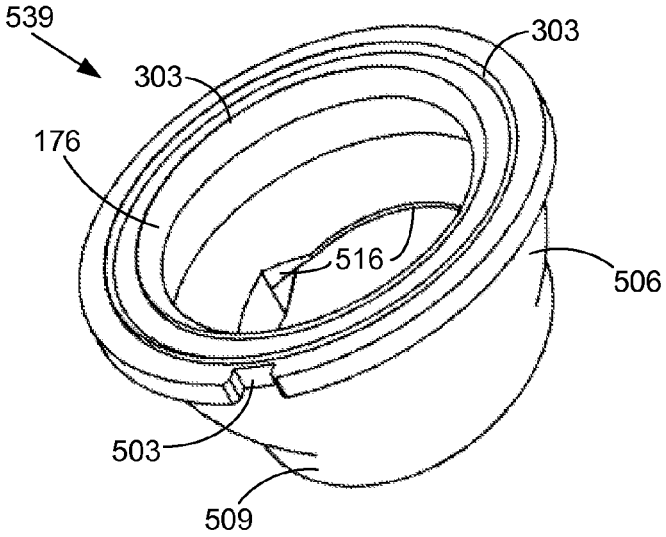
Figure 6E:
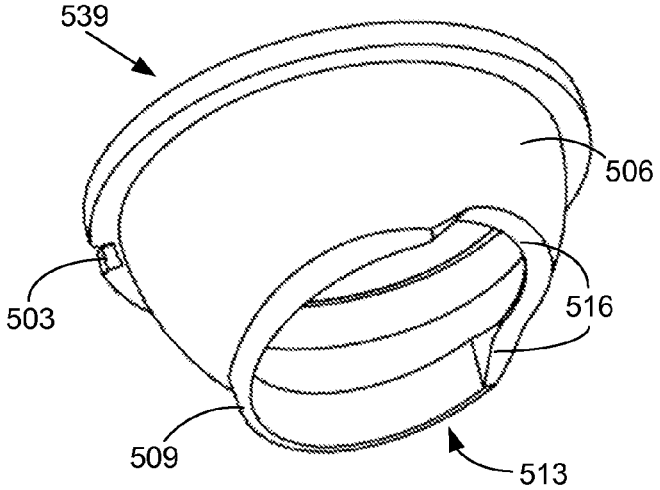
Figure 6F:
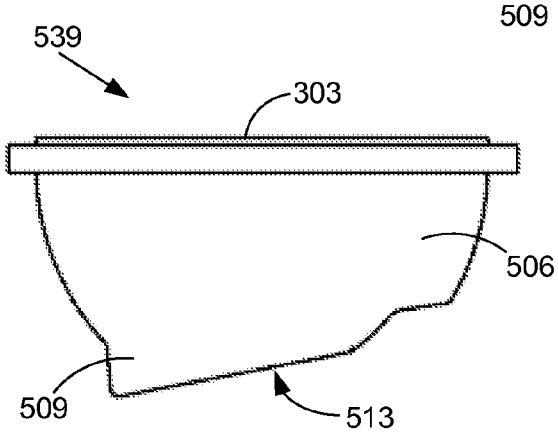

Referring now to FIGS. 6D-F, shown are views of another gasket 539 according to various embodiments. The gasket 539 includes annular sealing projections 303 that extend upward from the inward annular projection 176 of the gasket 539. In addition, an annular sealing projection 303 extends downward from the inward annular projection 176. The gasket 539 is attached to the bottom of the adapter 133 in such a manner that a seal is formed at the junction between the adapter 133 and the gasket 539. The gasket 539 includes an alignment notch 503 to assist in alignment of the gasket 539 on the adapter 133.

Figure 6G:
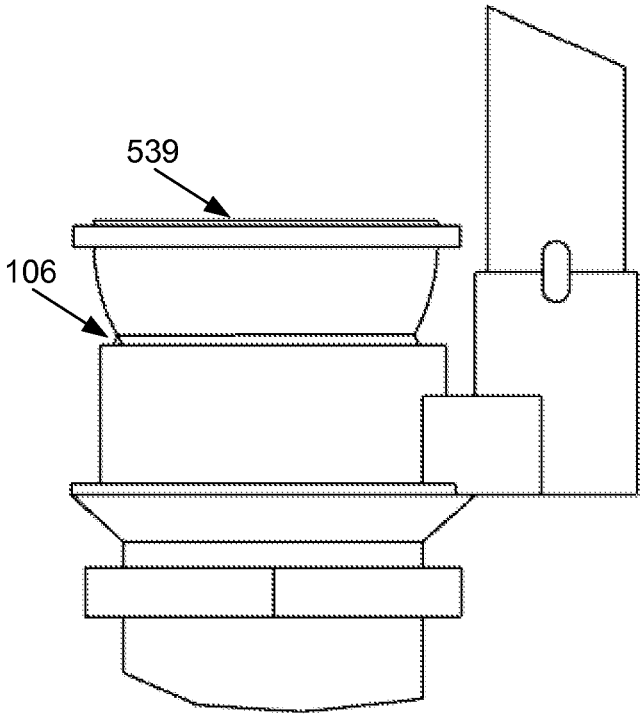
Figure 6H:
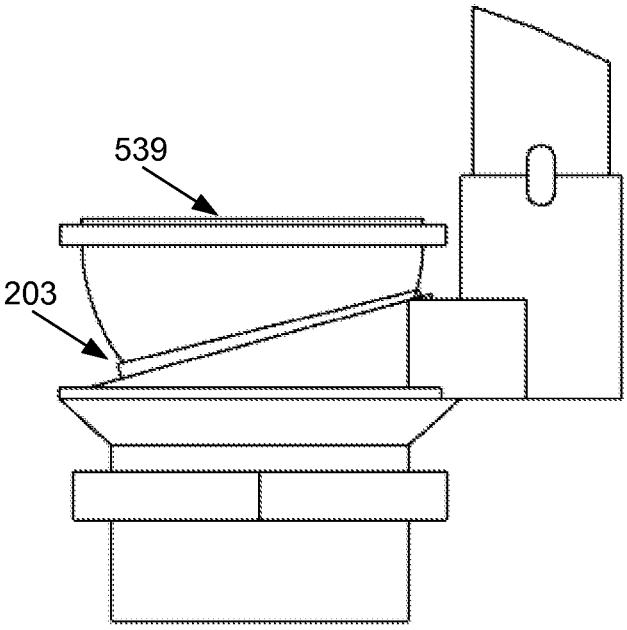

The gasket 539 is of a domed design allowing it to work on a multitude of different flush valves. The gasket 539 includes a side wall 506 that provides a greater degree of compliance relative to the compliance of an annular support structure 509 at the bottom of the gasket 539 and relative to the inward annular projection 176. The annular support structure 509 may include a pseudo I-beam or extension structure that promotes or maintains the integrity of the opening 513 of the gasket 539 to allow water to move into the flush orifice 106/203 without restricting the flow of water exiting the tank during a flush. In the embodiment of FIGS. 6D-F, the pseudo I-beam or extension structure 509 extends around a portion of the opening 513 of the gasket 539 to reduce restriction of the drain opening 123 (FIG. 2C) of the overflow tube 103. In addition, the opening 513 may be angled as illustrated in FIG. 6F to further reduce restriction of the drain opening 123, while aiding in the alignment and support of the gasket 539 in either a horizontal flush orifice 106 or an angled flush orifice 203 as depicted in FIGS. 6G-6H, respectively. The cut out area of extension 509 may have a thicker portion and blended radii to reinforce the opening of gasket 539.

Figure 6I:
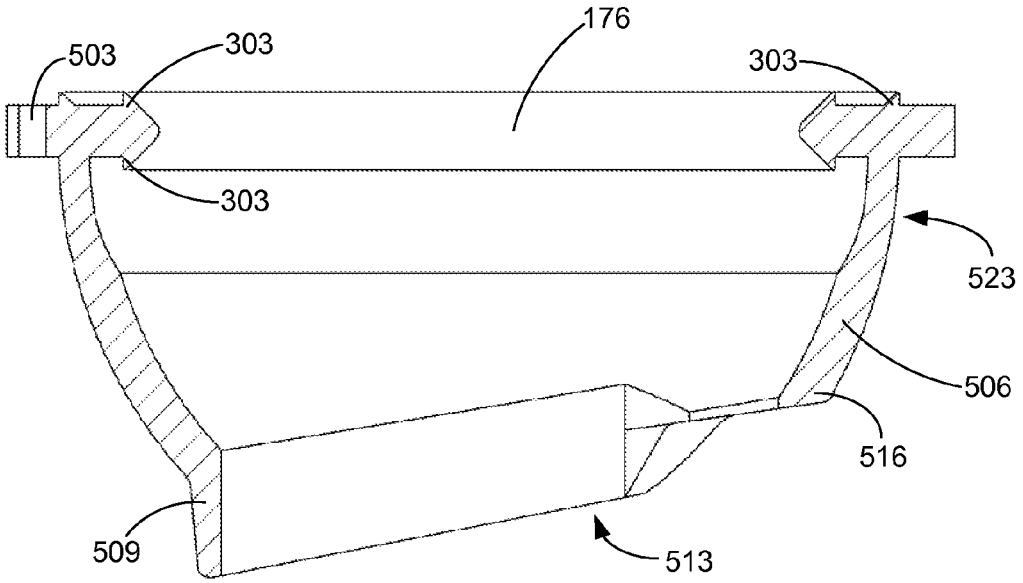
Figure 6J:
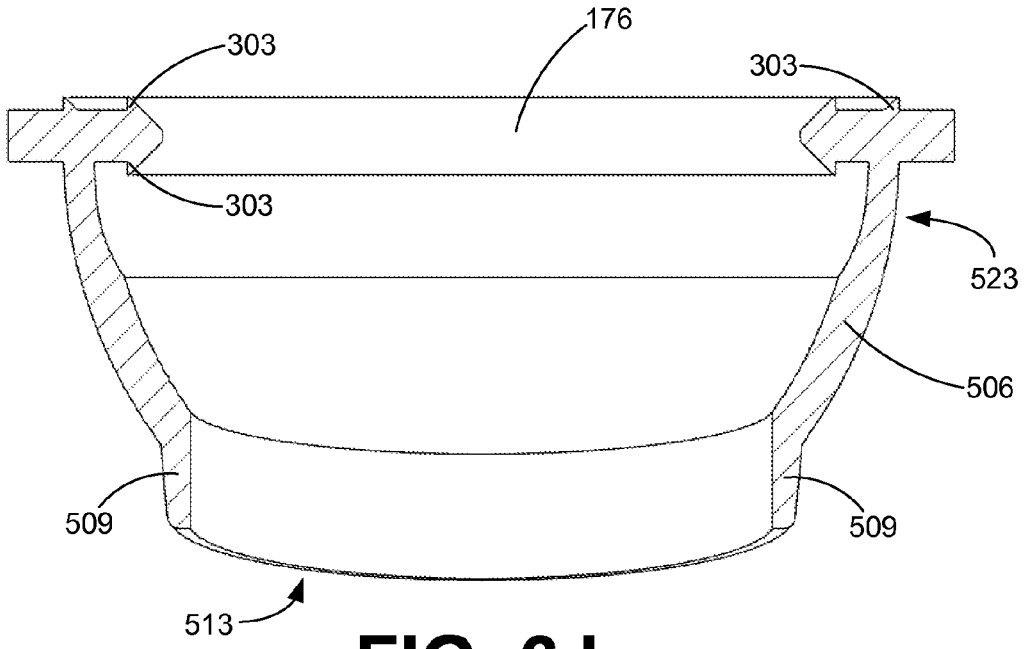

With reference to FIGS. 6I-J, shown are cutaway views of the gasket 639 that depict the inward annular projection 176, the annular sealing projections 303, the sidewall 306, and the annular support structure 609. FIG. 6I is a cutaway view passing through notch 603 and the center of the gasket 639. FIG. 6J is a cutaway view perpendicular to that of FIG. 6I. In addition to the pseudo I-beam or extension structure 509, the opening 513 may include a thicker portion 516 along the bottom of the side wall 506 that does not include the pseudo I-beam structure 509 to promote or maintain the integrity of the opening 513 when installed into the flush orifice 106/203. The sidewalls 506 of the gasket 539 may also include thinner portions that provide the greater degree of compliance so that the gasket 539 can conform with the orifices 106/203 to provide for an adequate seal. In the embodiment of FIGS. 6I-J, the sidewall 506 includes a thinner portion 523 in the upper portion of the sidewall 306.

Figure 7A:
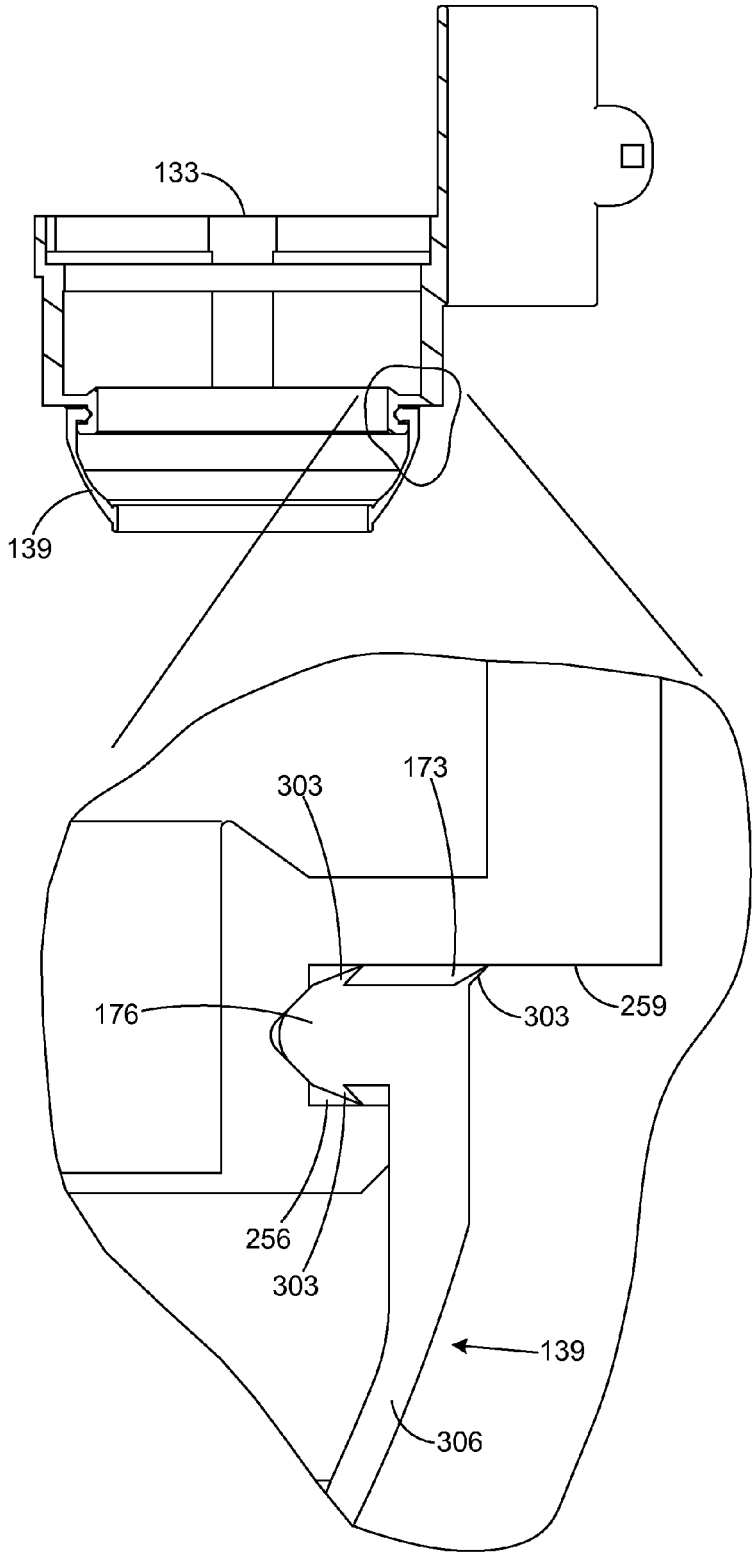
FIGS. 7A-B are drawings that illustrates a junction between a gasket of FIGS. 6A-J and the dual flush adapter of FIGS. 3A-C according to various embodiments.

Referring next to FIG. 7A, shown is a cutaway view of the adapter 133 with the gasket 139 attached thereto. In particular, shown is the inward annular projection 176 of the gasket 139 mated with the annular recess 173. To this end, a pointed end of the inward annular projection 176 fits into the pointed annular recess 253 and forms seals where the gasket 139 touches the annular recess 173. Also, the annular sealing projections 303 are compressed by the sealing surfaces 256 and 259 to further provide for a seal between the gasket 139 and the bottom of the adapter 133. Also, portions of the inward annular projection 176 may come into contact with various surfaces of the annular recess 173 to provide for further sealing.

Figure 7B:
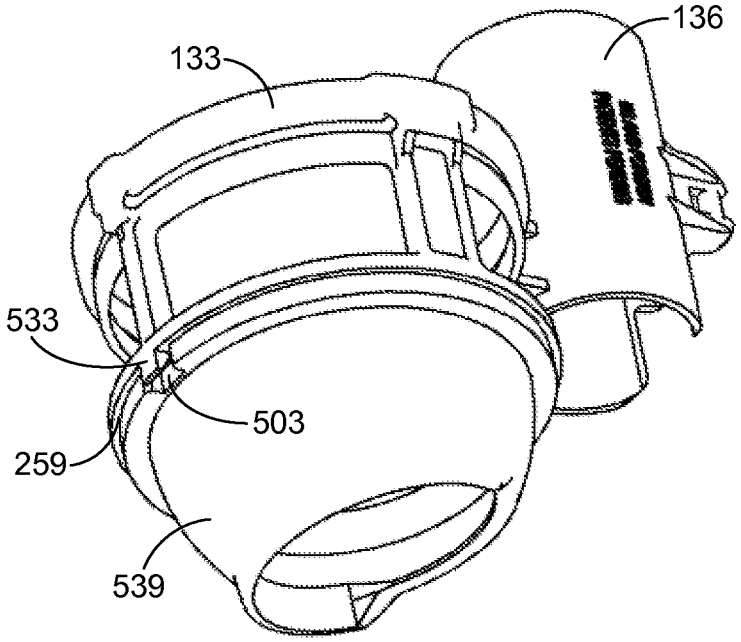

Gasket 539 may be similarly attached to the adapter 133 by mating inward annular projection 176 of the gasket 539 with the annular recess 173. In some embodiments, the adapter 133 includes an alignment tab 533 on sealing surface 259 as depicted in FIG. 7B. Alignment tab 533 engages alignment notch 503 to facilitate alignment of the gasket 539 on the adapter 133. When adapter 133 is secured to the overflow tube 103 as illustrated in FIGS. 2C and 4B, gasket 539 is aligned with the drain opening 123 (FIG. 2C) of the overflow tube 103 to avoid restriction or the drain opening 123.

Figure 8:
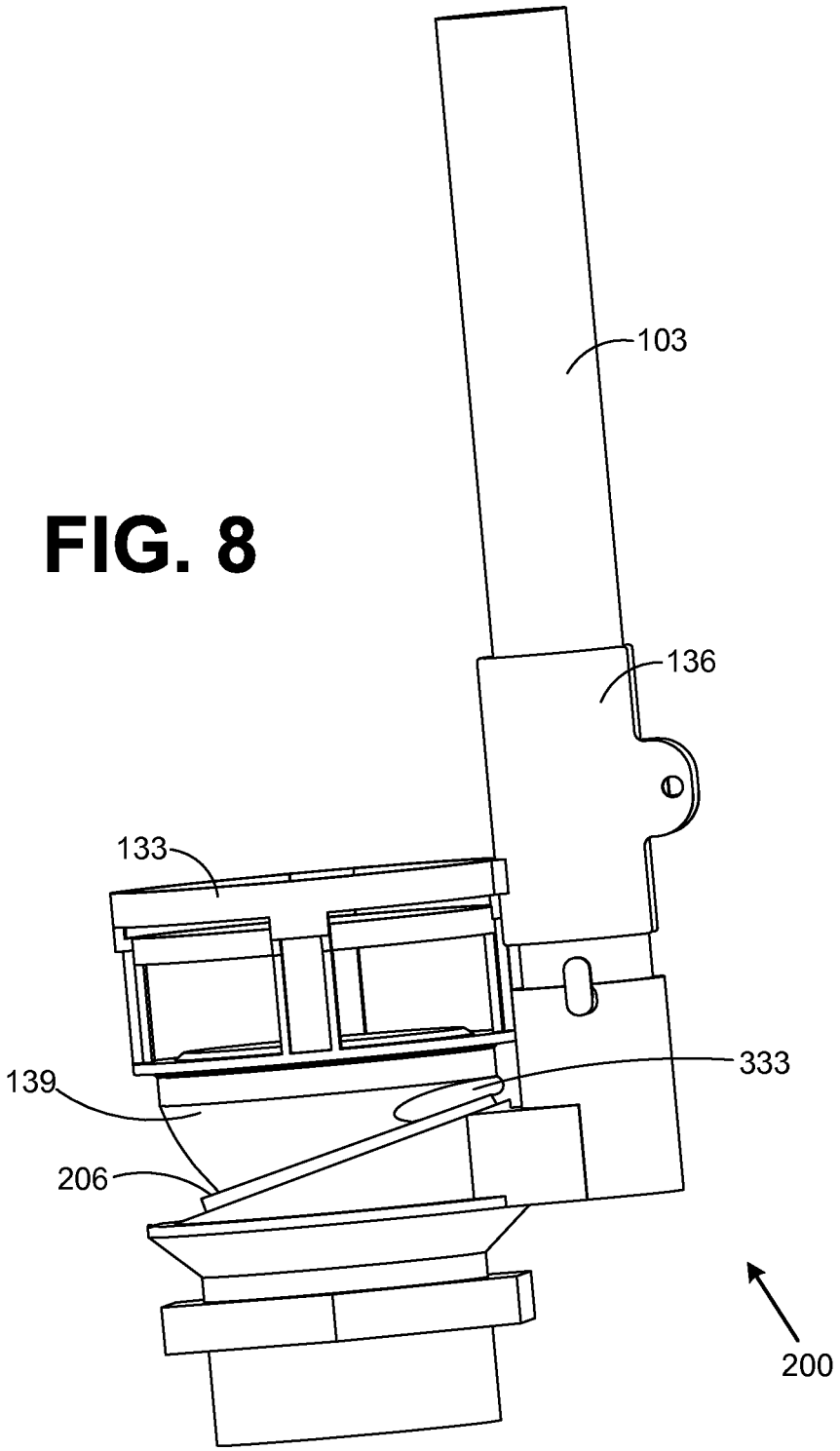
FIG. 8 is a drawing that provides a further view of the single flush toilet flush valve with a dual flush adapter of FIGS. 2A-C according to various embodiments.

With reference to FIG. 8, shown is another example of the flush valve 200 in which the gasket 139/539 is deformed due to compression down onto the flush orifice 206. To this extent, a deformity 333 may be created in a sidewall of the gasket 139/539 due to compression of the gasket 139/539 into the flush orifice 206 and due to the angled nature of the flush orifice 206. Due to the fact that the sidewall 306/506 is designed with a degree of compliance, the deformity 333 can occur while still allowing the gasket 139/539 to seal with the flush orifice 206. The gasket 139/539 may be deformed in a more uniform manner when mated with the flush orifice 106/203 (FIGS. 1A-D and 2A-C). Referring back to FIG. 7B, the alignment tab 533 may be located approximately opposite the clamp 136 to avoid interference with deformity 333 of the sidewall 306/506 when installed in the flush orifice 103/203.

Figure 9A:
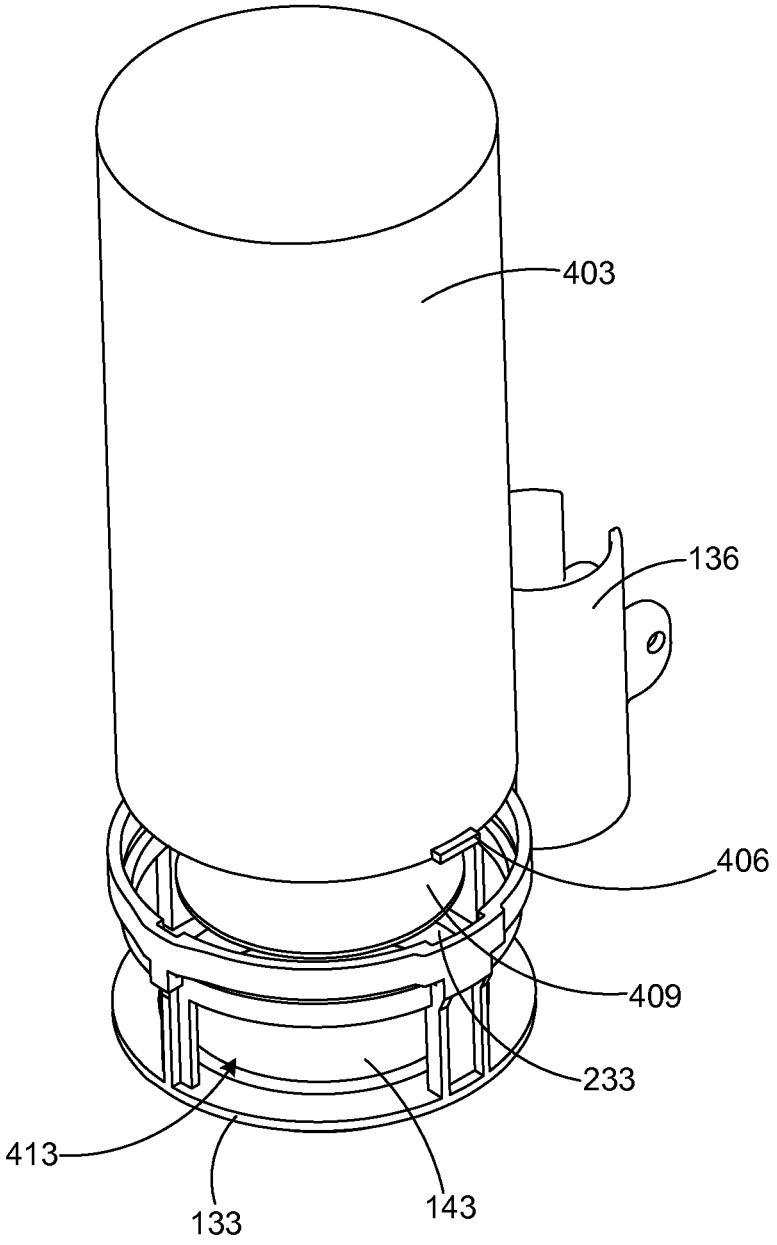
FIGS. 9A-B are drawings that illustrate the coupling of a dual flush canister to the dual flush adapter of FIGS. 3A-C according to various embodiments.
Figure 9B:
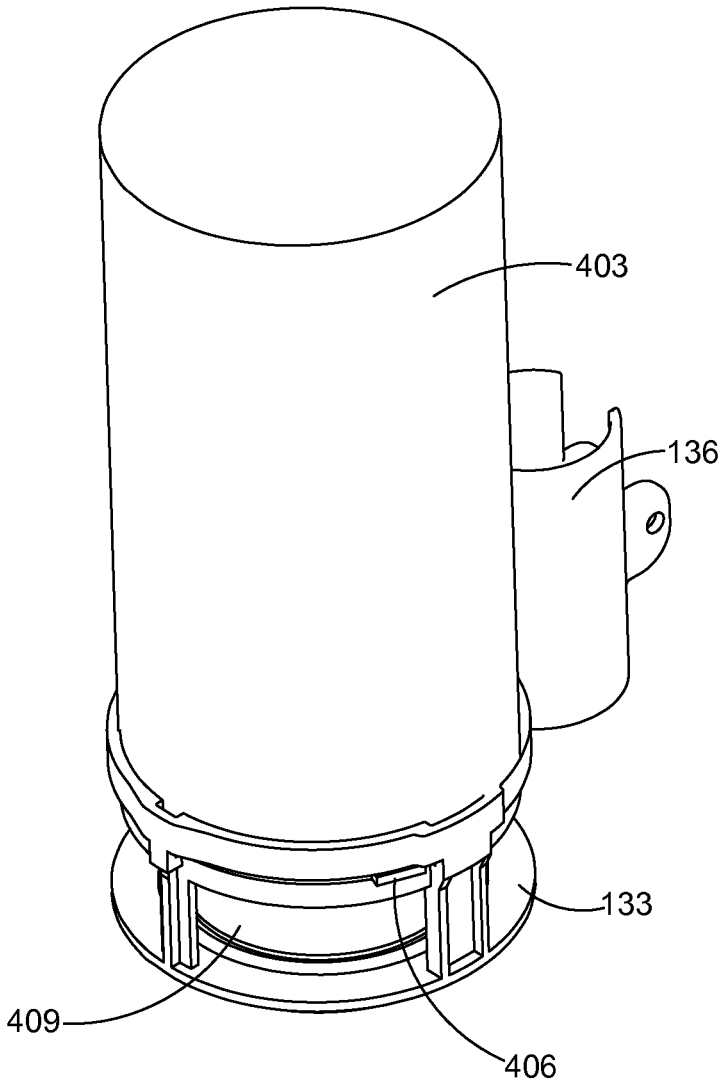

With reference to FIGS. 9A and 9B, shown is how the adapter 133 mates with a dual flush canister 403 according to various embodiments. The dual flush canister 403 includes mating ears 406 that slide into the grooves 233 and can be rotated within the annular groove 236 (FIG. 3A). Attached to the dual flush canister 403 is a sealing member 409 that closes the flush orifice 143 of the adapter 133 when the dual flush canister 403 is idle. The sides of the adapter 133 feature water flow openings 413 that allow water to enter into the adapter 133 and flow through the flush orifice 143 when a flush is implemented. A flush is implemented when the mechanisms in the dual flush canister 403 lift the sealing member 409 to allow water to flow into the flush orifice 143 of the adapter and through the flush valve to a toilet bowl. In an alternative embodiment, the adapter 133 may actually be an integrally molded portion of the dual flush canister 403. Furthermore, the dual flush canister may be similar to the dual flush canister manufactured by OEM toilet manufacturers and suppliers like CRN, LAB, VIB, R&T, WDI and Nison.

Figure 9C:
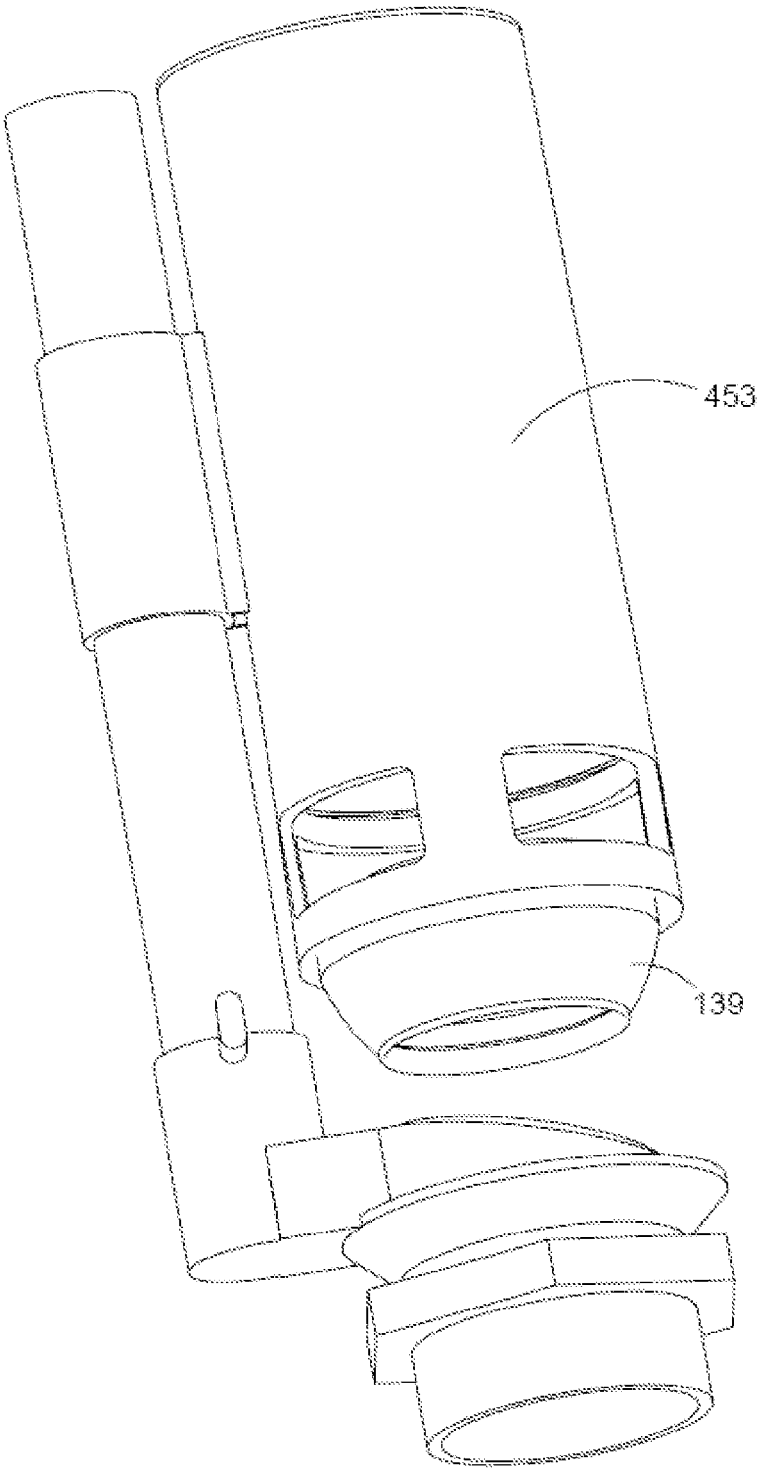
FIG. 9C is a drawing that illustrates a flush canister coupled to a flush valve according to various embodiments.
Figure 10C:
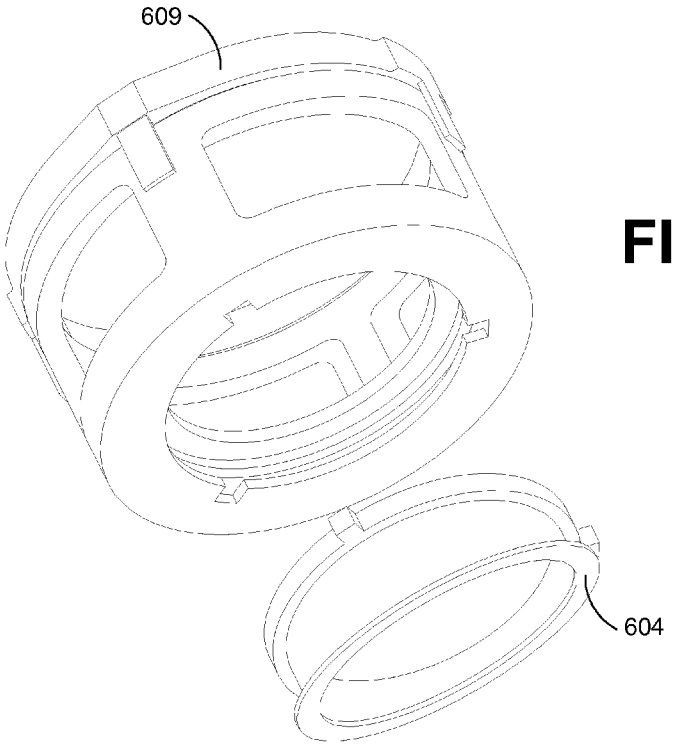
Figure 10D:
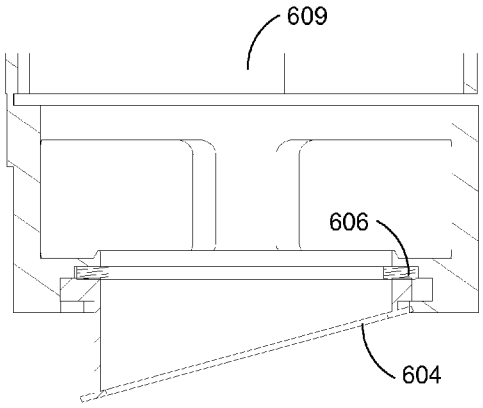
Figure 11A:
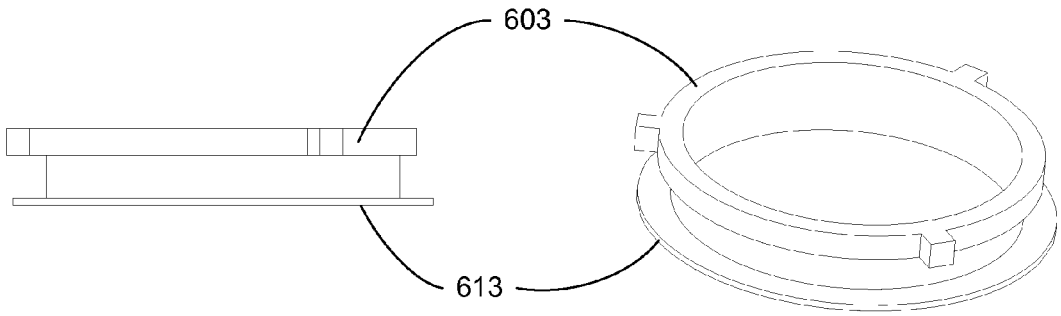
FIGS. 11A-B show adapter fittings of the flush adapters of FIGS. 10A-D according to various embodiments.
Figure 11B:
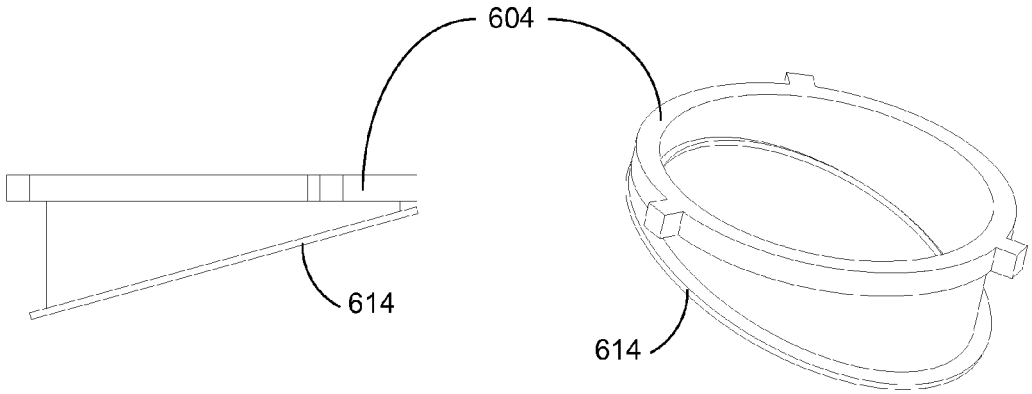

With reference to FIG. 9C, shown is a dual flush canister 453 in which the structure of the adapter 133 (FIGS. 3A-C) comprises an integrally molded portion of the dual flush canister 453. Also, the clamp 136 extends from one side of the dual flush canister 453 and is an integrally molded portion of the dual flush canister 453. The gasket 139 couples to the bottom of the dual flush canister 453. While the gasket 139 is shown attached to a dual flush canister 453, it is understood that it may be attached to other devices such as siphonic flush valves, electronically operated dual flush valves, or other flush mechanisms.

Referring next to FIGS. 10A-D, shown are various views of an adapter that comprises a basket structure 609 that is compatible with adapter fittings 603, 604. The adapter fitting 604 is configured to mate with an angled flush valve 200 and the adapter fitting 603 is configured to mate with a horizontal flush valve 100.

FIGS. Withdrawn views of the adapter fittings 603 and 604. The adapter fitting 603 includes a flange 613 and the adapter fitting 604 includes a flange 614. According to one embodiment, the flanges 613 and 614 facilitate coupling the adapter fittings 603 and 604 to respective flush orifices using appropriate bonding sealant. Such bonding sealants serve to seal the junction between the respective flange 613/614 and the respective flush orifice 106/203 and to bond the adapter fitting 603/604 to the flush orifice 106/203. Such bonding sealants may comprise, for example, epoxy, silicone, various adhesives, or other compounds. In other embodiments, the adapter fittings 603/604 may include rubber (e.g., silicone) or other sealing material along the mating surface of the flange 613/614 to provide sealing for mating with the flush orifice 106/203. Alternatively, the adapter fittings 603/604 may be rubber over-molded plastic or constructed of rubber (e.g., silicone) or other appropriate material, which may eliminate the need for gasket 606 to seal the junction with basket structure 609.

Figure 12:
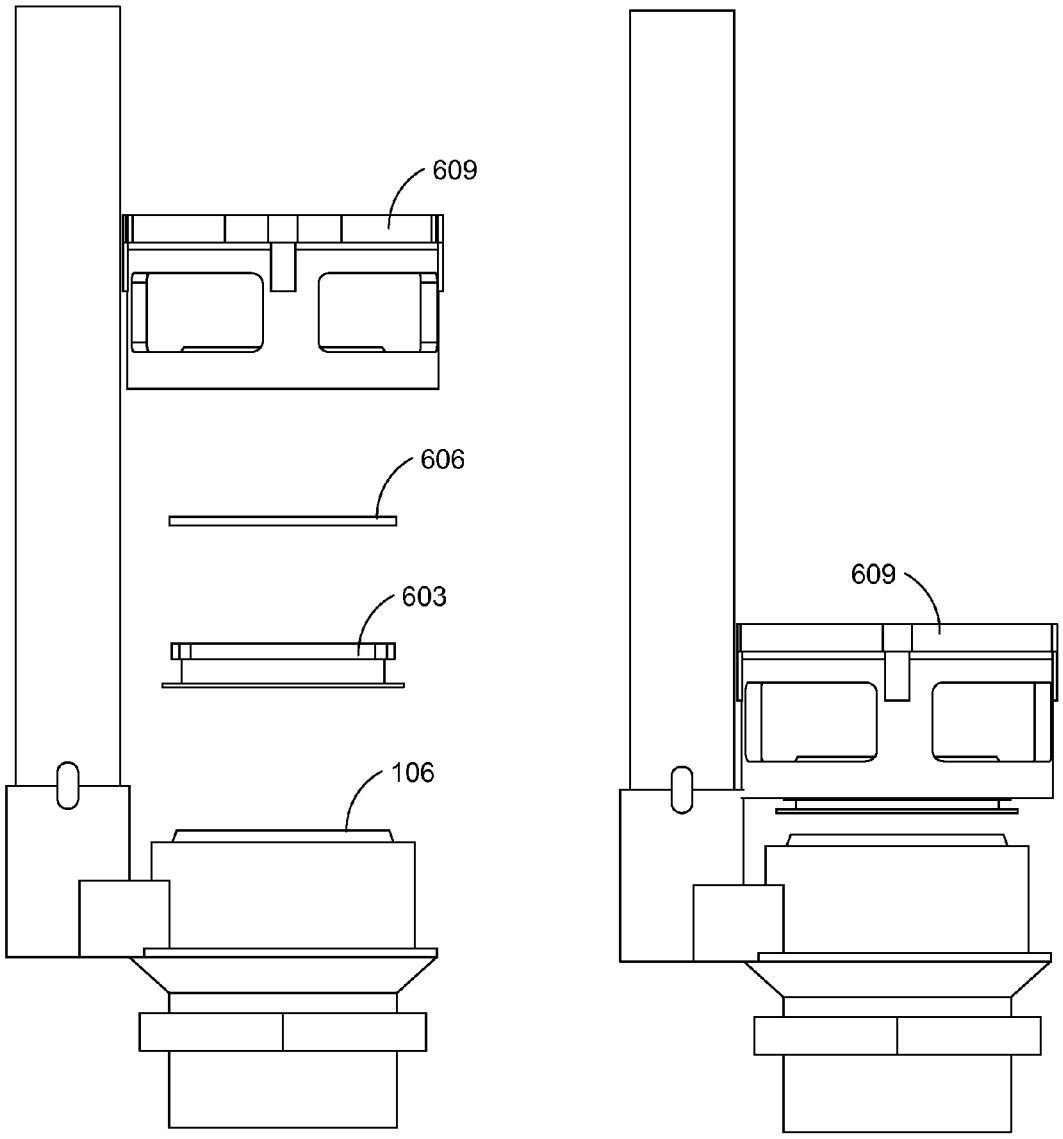
FIGS. 12 and 13 show the flush adapters of FIGS. 10A-D as they are assembled with flush valves according to various embodiments.
Figure 13:
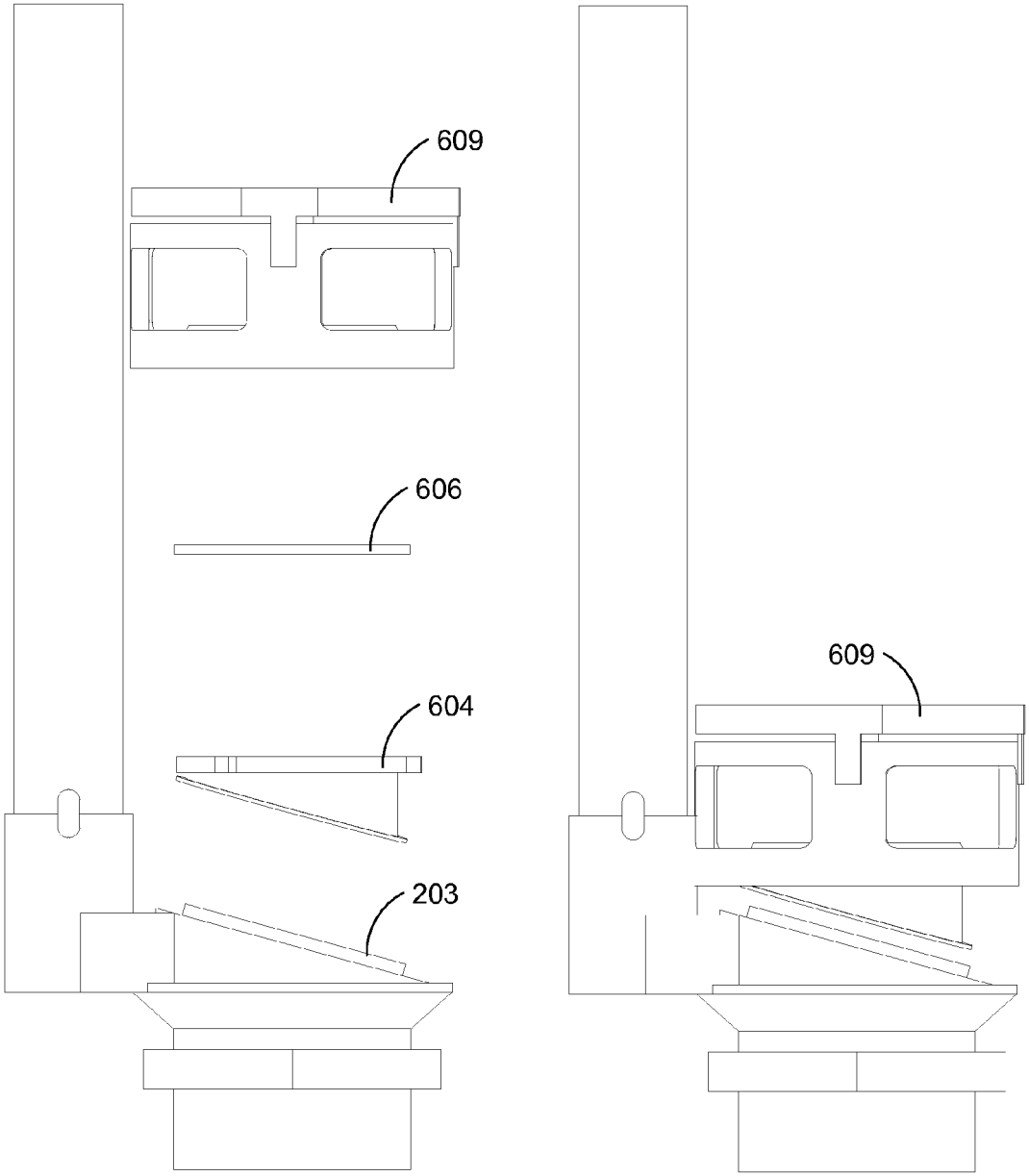

FIGS. 12 and 13 show the basket structure 609 and the respective adapter fittings 603/604 as they are assembled and attached to respective flush orifice 106/203. The flanges 613/614 are coupled to the respective flush orifices of the respective flush valves by a respective bonding sealant or sealing material as mentioned above.

Figure 14A:
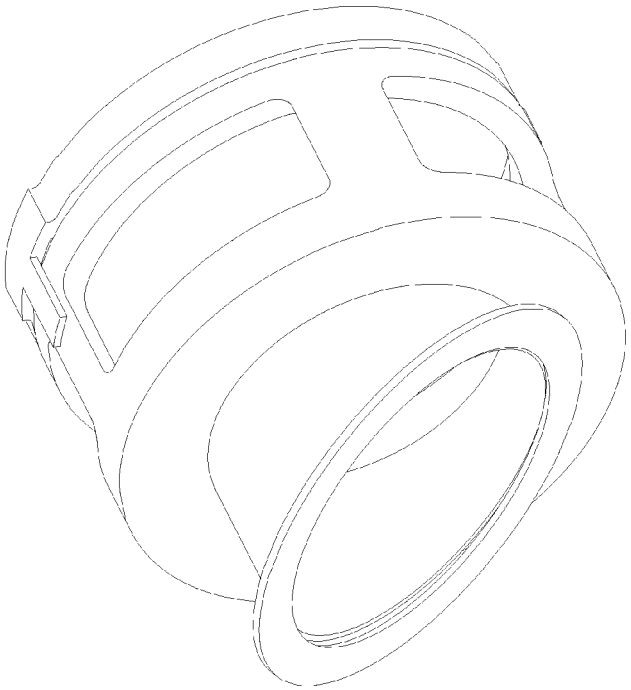
FIGS. 14A-B show various further flush adapters according to various embodiments.
Figure 14B:
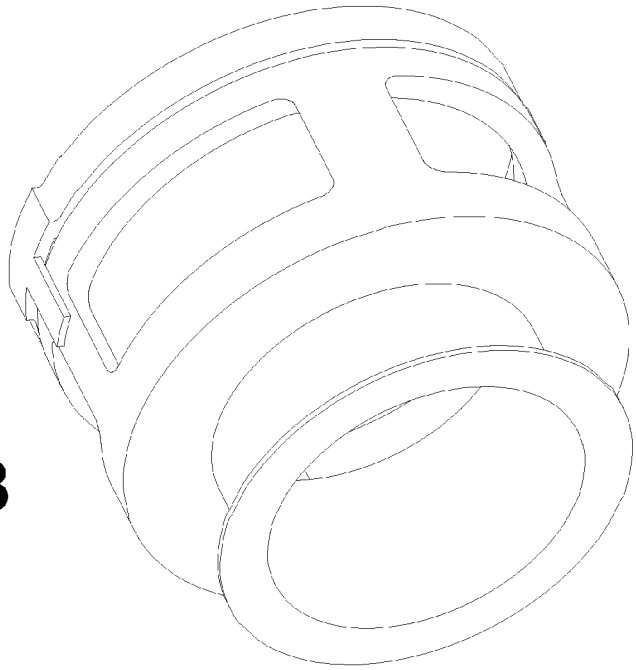

FIGS. 14A and 14B show structures in which the basket structure 609 and a respective adapter fitting 603/604 are integrally molded as a single piece. Such may be used in place of the separate components described above, thereby eliminating a seal between the respective adapter fitting 603/604 and the basket structure 609 as described above.

Figure 15:
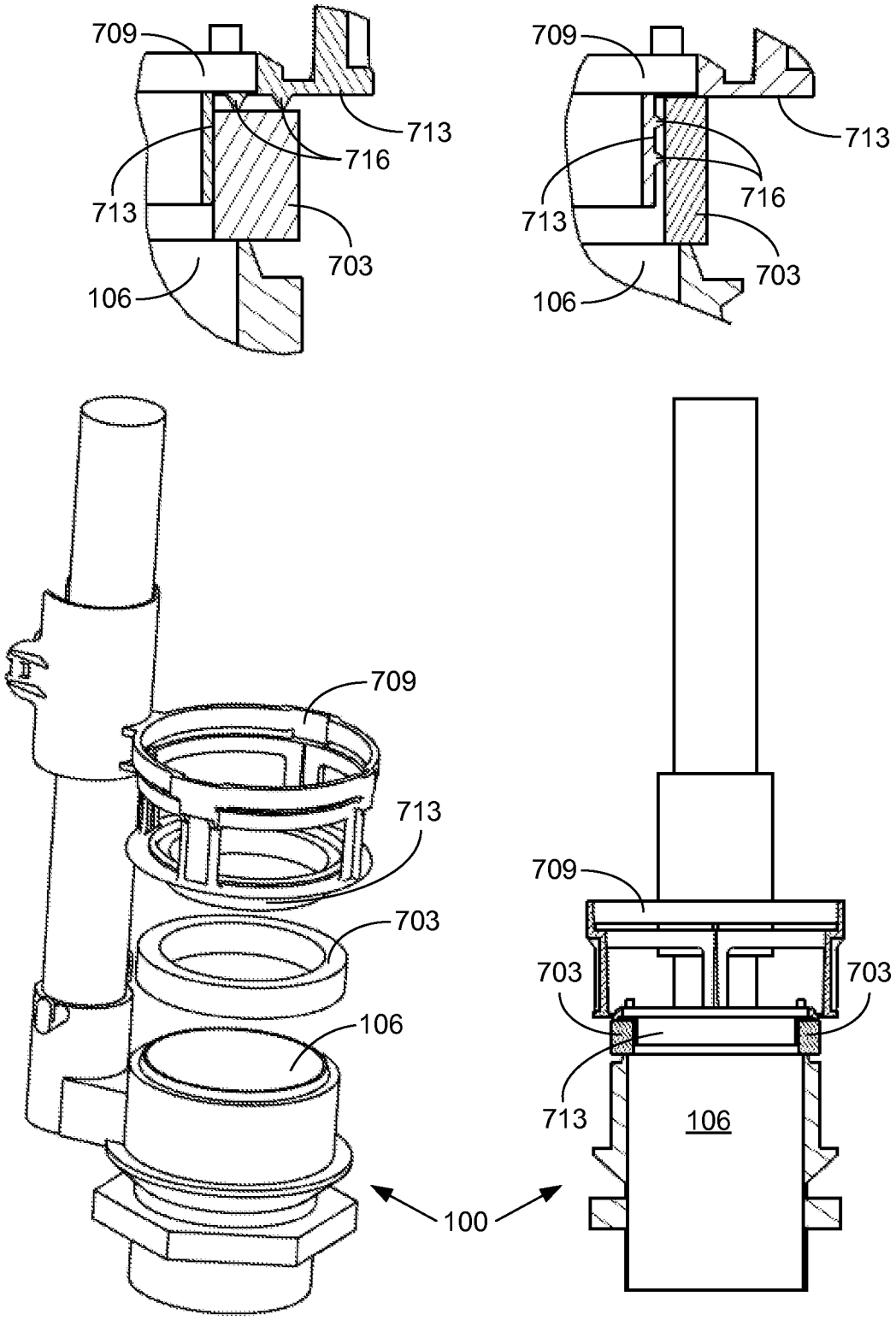
FIGS. 15-17 show views of adapters that include a basket structure with an adapter ring configured to mate with toilet flush valves of FIGS. 1A-D or FIGS. 2A-C according to various embodiments.
Figure 16:
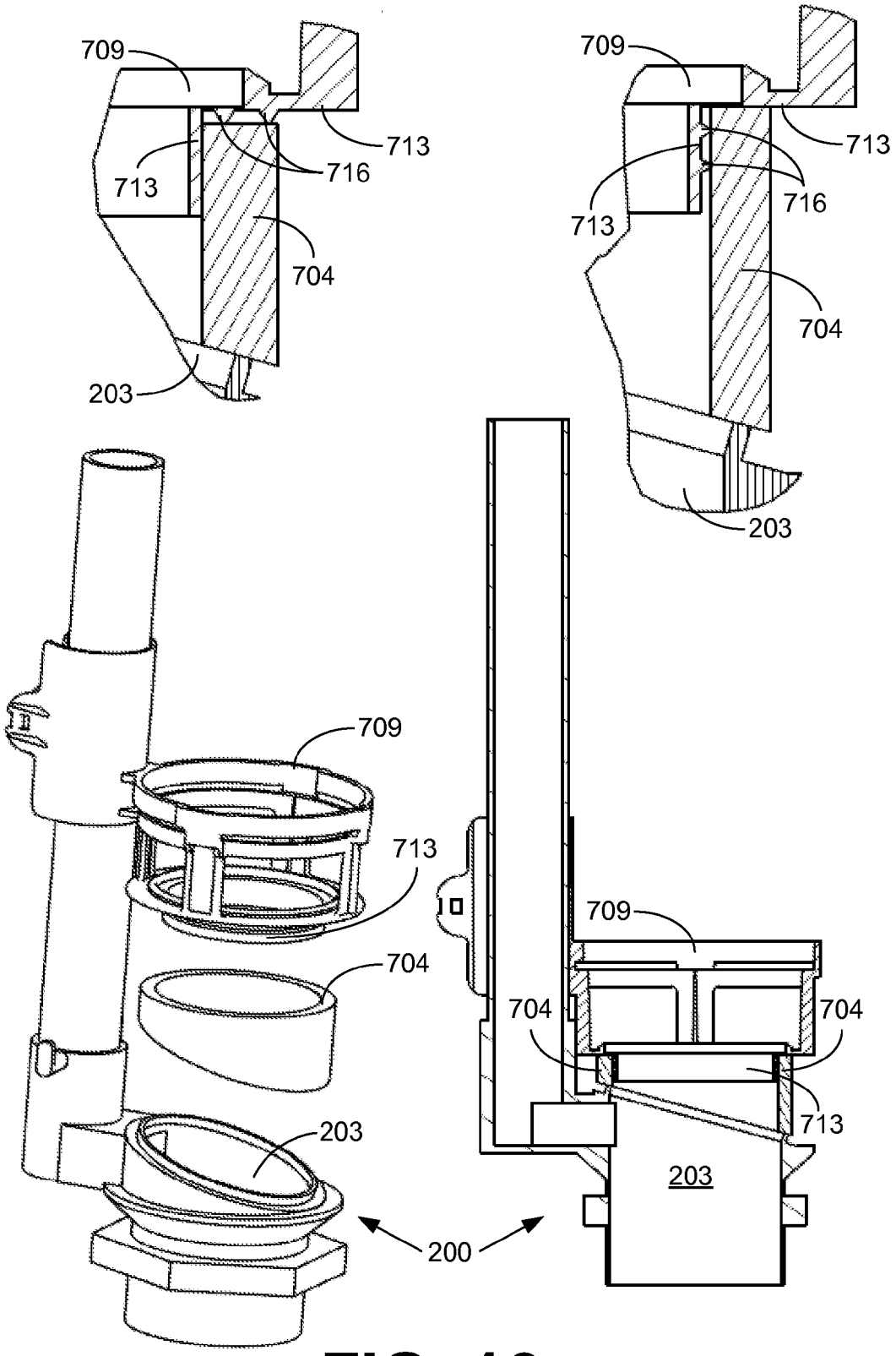
Figure 17:
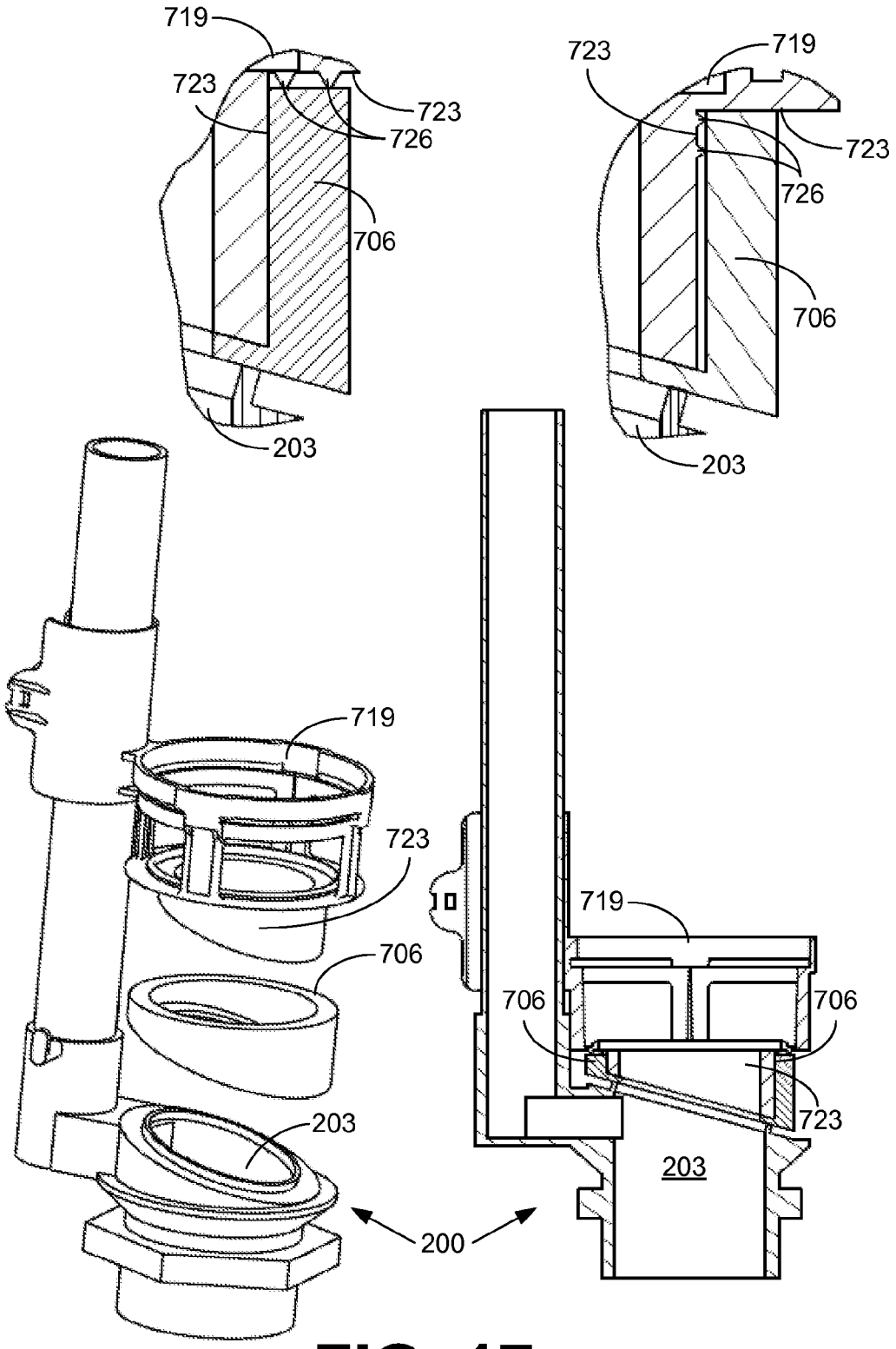

With reference to FIGS. 15-17, shown are views of other adapters that include a basket structure with an adapter ring configured to mate with a flush valve in accordance with various embodiments. In the embodiment of FIG. 15, the adapter comprises a basket structure 709 compatible with an adapter ring 703 that is configured to mate with a horizontal flush valve 100. Adapter ring 703 may be constructed of rubber (e.g., silicone) or other appropriate sealing material. In the embodiment of FIG. 15, the basket structure 709 includes a ring flange 713 that extends below the basket structure 709. The adapter ring 703 may be secured to the basket structure 709 through an interference fit with a vertical face of the ring flange 713. Sealing may be provided by annular sealing projections 716 that extend from either the horizontal and/or vertical face of the ring flange 713. Alternatively, adapter ring 703 may be sealed and/or secured to the ring flange 713 using bonding sealants such as, for example, epoxy, silicone, various adhesives, or other appropriate compounds. When aligned with the horizontal flush orifice 106, a downward force may assist the seal of the adapter ring 703 against the mating surface of the flush orifice 106.

In the embodiment of FIG. 16, the adapter comprises the basket structure 709 compatible with another adapter ring 704 that is configured to mate with an angled flush valve 200. Adapter ring 704 may be constructed of rubber (e.g., silicone) or other appropriate sealing material. The adapter ring 704 may be secured to the basket structure 709 through an interference fit with a vertical face of the ring flange 713. Sealing may be provided by annular sealing projections 716 that extend from either the horizontal and/or vertical face of the ring flange 713. Alternatively, adapter ring 704 may be sealed and/or secured to the ring flange 713 using bonding sealants such as, for example, epoxy, silicone, various adhesives, or other appropriate compounds. When aligned with the angled flush orifice 203, a downward force may assist the seal of the adapter ring 704 against the mating surface of the flush orifice 203.

In the embodiment of FIG. 17, the adapter comprises a basket structure 719 compatible with another adapter ring 706 that is configured to mate with an angled flush valve 200. Adapter ring 706 may be constructed of rubber (e.g., silicone) or other appropriate sealing material. In the embodiment of FIG. 17, the basket structure 719 includes an angled ring flange 723 that extends below the basket structure 719. The adapter ring 706 may be secured to the basket structure 719 through an interference fit with a vertical face of the angled ring flange 723. Sealing may be provided by annular sealing projections 726 that extend from either the horizontal and/or vertical face of the angled ring flange 723. Alternatively, adapter ring 706 may be sealed and/or secured to the angled ring flange 723 using bonding sealants such as, for example, epoxy, silicone, various adhesives, or other appropriate compounds. The adapter ring 706 configured to wrap around the bottom of the angled ring flange 723 to form a sealing lip. In this configuration, the angled ring flange 723 provides added rigidity to the adapter ring 706. When aligned with the angled flush orifice 203, a downward force seals the sealing lip of the adapter ring 706 against the mating surface of the flush orifice 203.

Figure 18:
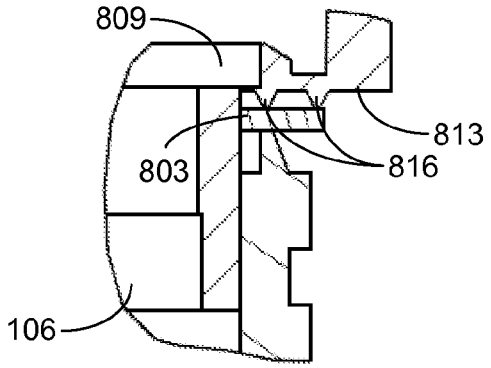
FIGS. 18-23 show views of adapters that include a basket structure configured to directly mate with toilet flush valves of FIGS. 1A-D or FIGS. 2A-C according to various embodiments.
Figure 18:
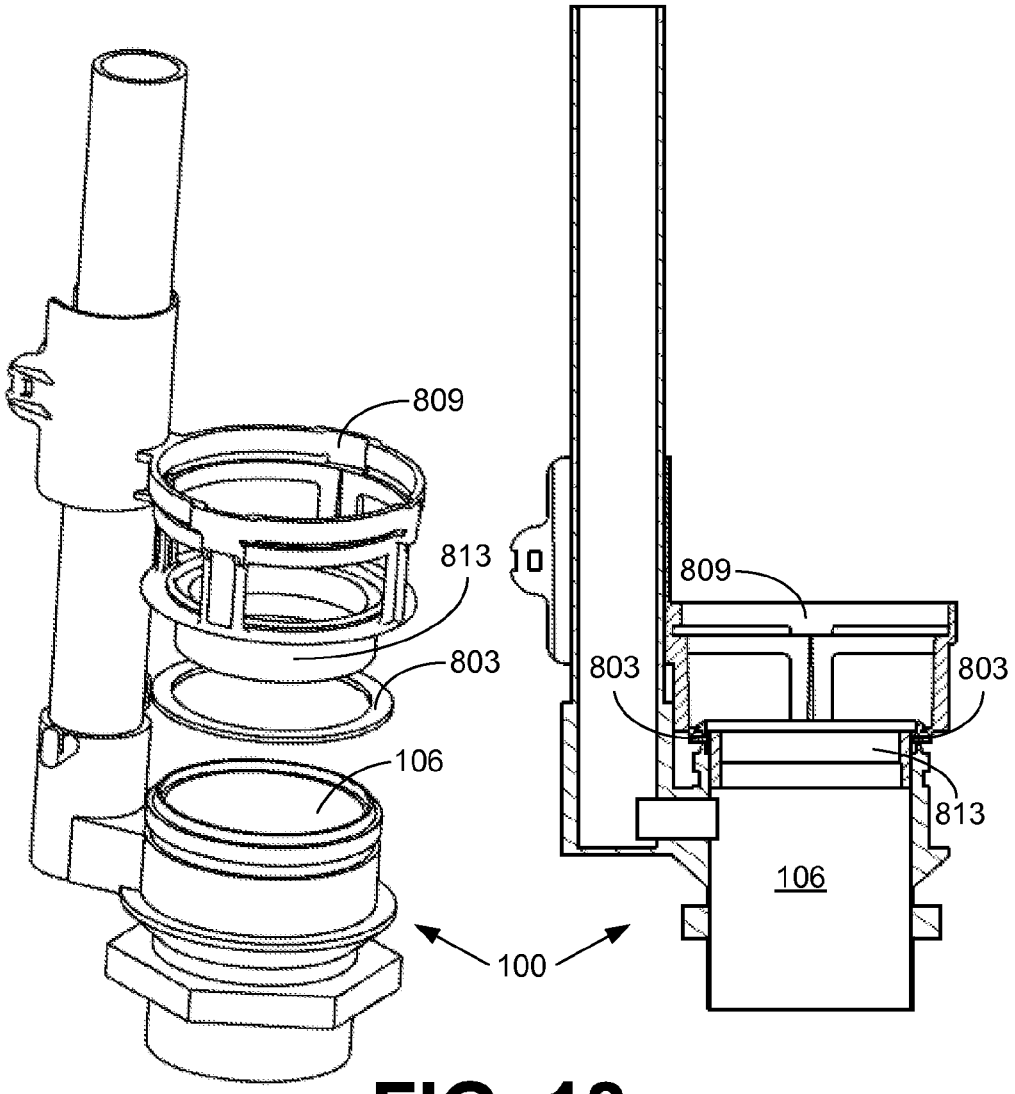

With reference to FIGS. 18-23, shown are views of other adapters that include a basket structure configured to mate directly with a horizontal flush valve 100 in accordance with various embodiments. In the embodiment of FIG. 18, the adapter comprises a basket structure 809 that is configured to mate directly with a horizontal flush valve 100. The basket structure 809 includes a mounting extension 813 that extends below the basket structure 809. The mounting extension 813 may configured to mate with the inside surface of the flush orifice 106 by an interference fit. Alternatively, the mounting extension 813 may be secured to the inside surface of the flush orifice 106 using bonding sealants such as, for example, epoxy, silicone, various adhesives, or other appropriate compounds.

A circular gasket 803 may be included to provide sealing between the basket structure 809 and the mating surface of the flush orifice 106. Sealing may be provided by annular sealing projections 816 that extend from the horizontal face of the mounting extension 813. When aligned with the horizontal flush orifice 106, a downward force seals the circular gasket 803 against the mating surface of the flush orifice 106.

Figure 19:
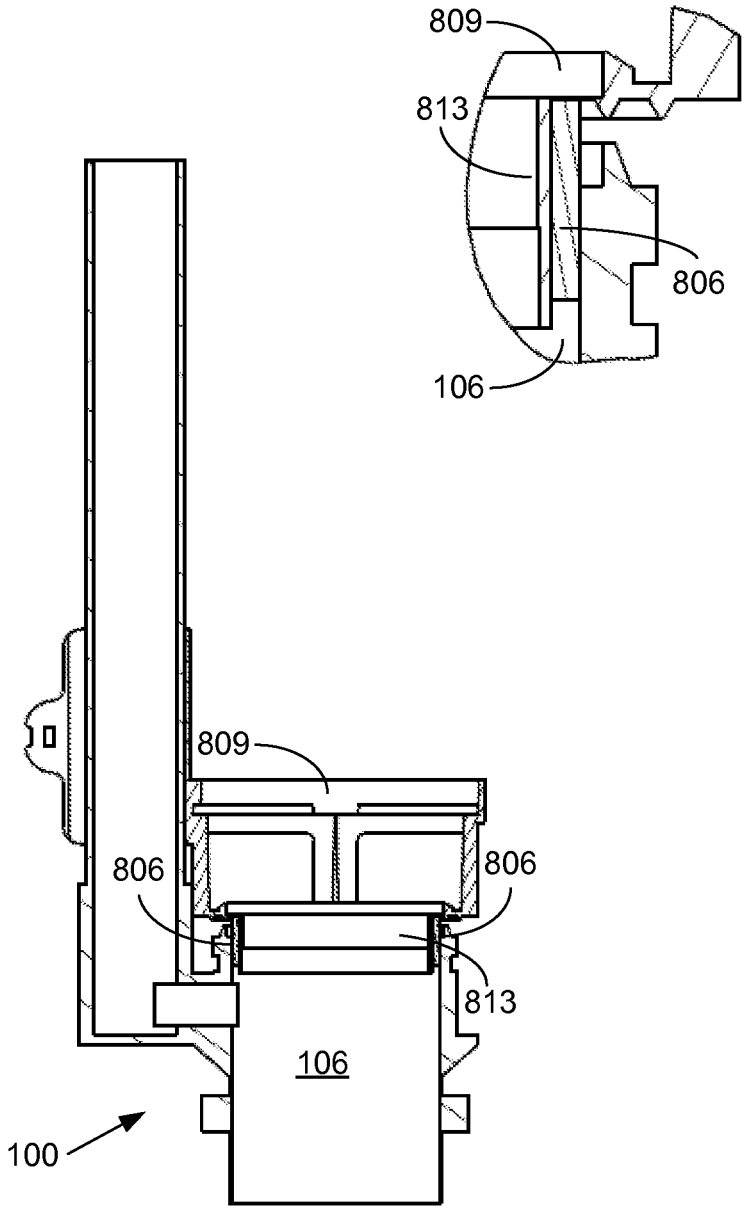

FIG. 19 illustrates an alternative embodiment of the adapter of FIG. 18. In the embodiment of FIG. 19, a gasket 806 is interposed between the mounting extension 813 and the inner surface of the flush orifice 106. Compression of the gasket 806 between the mounting extension 813 and inner surface of the flush orifice 106 provide sealing and secures the basket structure 809 in position within the flush orifice 106.

Figure 20:
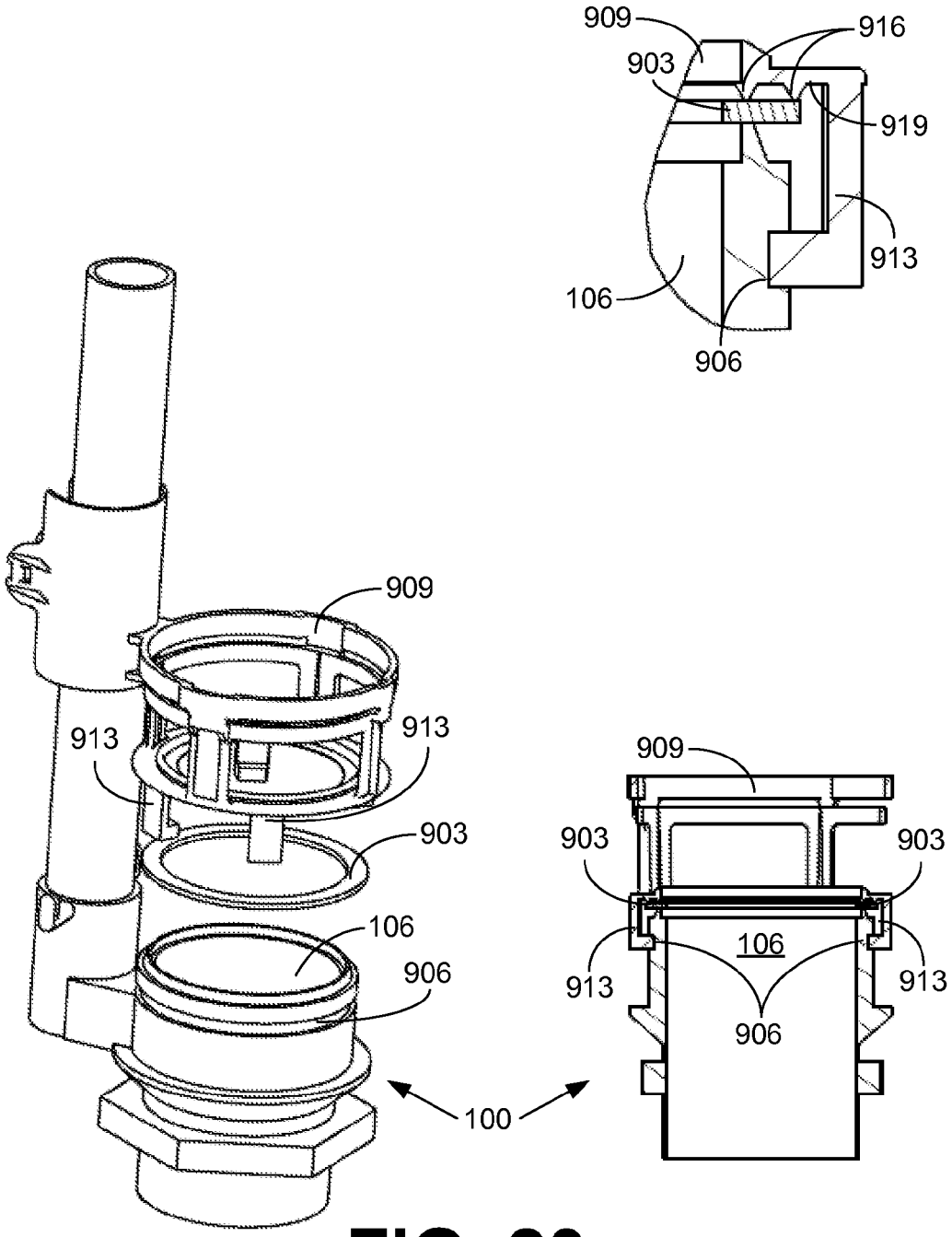

Referring now to FIG. 20, shown is another adapter that includes a basket structure 909 configured to mate directly with a horizontal flush valve 100 in accordance with various embodiments. In the embodiment of FIG. 20, the basket structure 909 includes one or more clamping arms 913 configured to mate directly with a channel 906 around the outer surface of the horizontal flush valve 100. The claming arms 913 are attached to the basket structure 909 at a proximal end and include a tab on a distal end. When mated to the flush valve 100, the tabs of the clamping arms 913 engage the channel 906 to secure the basket structure 909 in position.

A circular gasket 903 may be included to provide sealing between the basket structure 909 and the mating surface of the flush orifice 106. Sealing may be provided by annular sealing projections 916 that extend from a sealing face 919 of the basket structure 909. When aligned with the horizontal flush orifice 106, a downward force seals the circular gasket 903 against the mating surface of the flush orifice 106.

Figure 21:
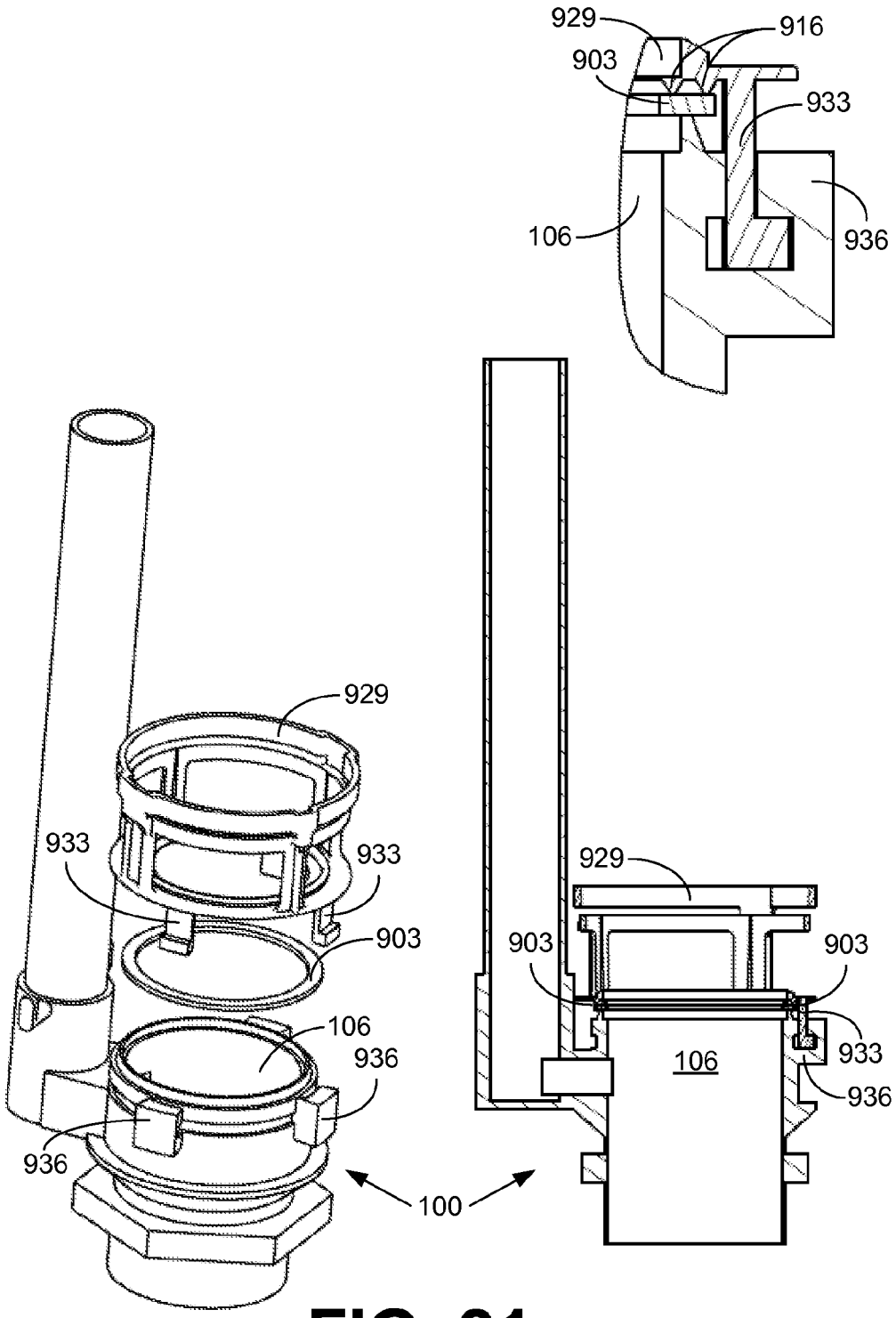

A variation of the embodiment of FIG. 20 is illustrated in FIG. 21. In the embodiment of FIG. 21, the basket structure 929 includes one or more clamping arms 933 configured to mate directly with a corresponding plurality of securing clips 936 distributed around the outer surface of the horizontal flush valve 100. The claming arms 933 are attached to the basket structure 929 at a proximal end and include a tab on a distal end. In the embodiment of FIG. 21, the tab extends away from the flush valve 100. In other embodiments, the tab may extend towards the flush valve 100 or may be an inverted-T shape with extensions in both directions. When mated to the flush valve 100, the tabs of the clamping arms 933 engage the corresponding securing clip 936 to secure the basket structure 909 in position. As in FIG. 20, a circular gasket 903 may be included to provide sealing between the basket structure 929 and the mating surface of the flush orifice 106.

Figure 22A:
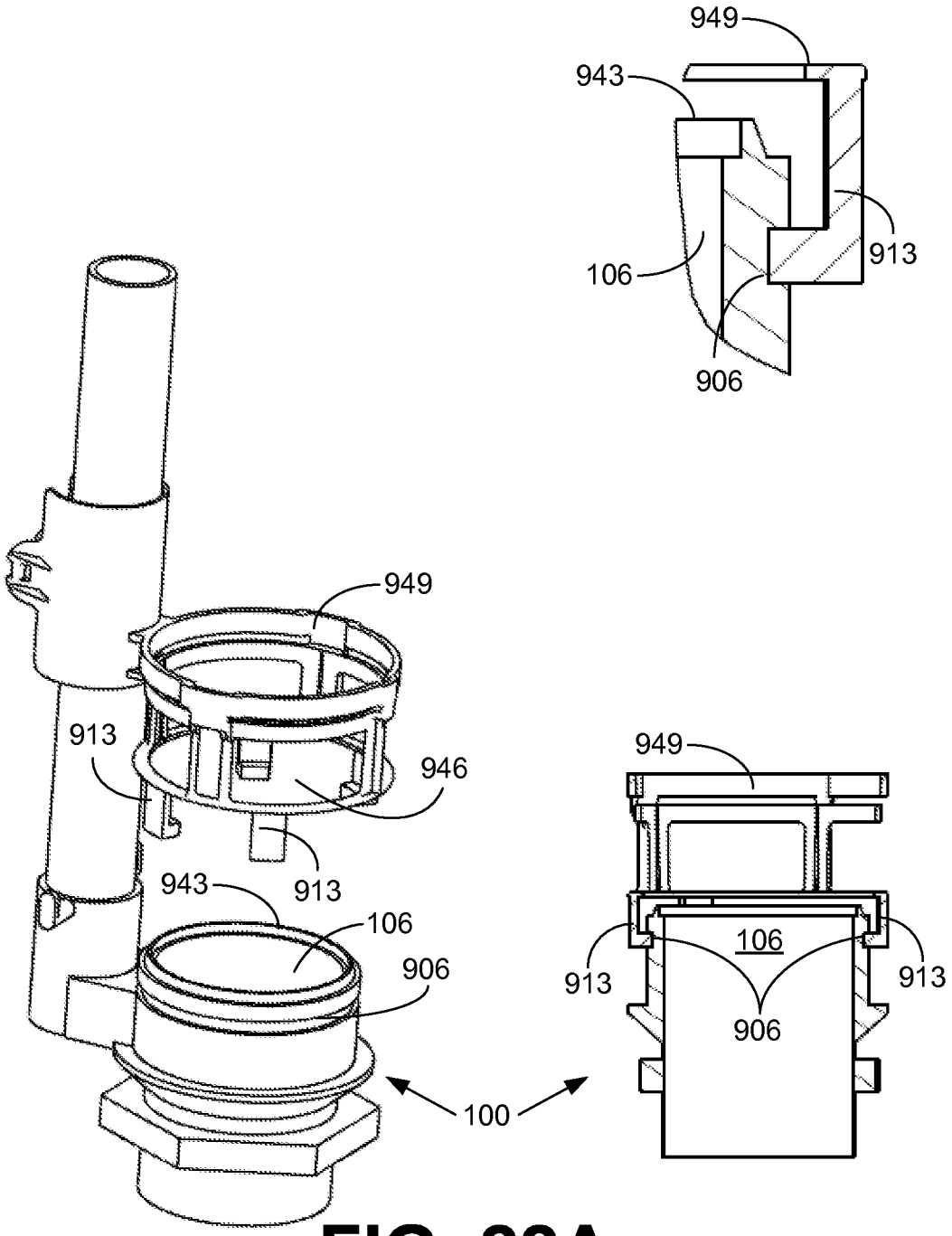

As discussed with respect to FIGS. 9A-B, the dual flush canister 403 includes a sealing member 409 that closes the flush orifice 143 of the adapter 133 when the dual flush canister 403 is idle. In some embodiments, the sealing member 409 may close directly onto the mating surface of the flush orifice 106. For example, FIG. 22A illustrates another variation of the embodiment of FIG. 20. In the embodiment of FIG. 22A, the basket structure 949 includes one or more clamping arms 913 configured to mate directly with a channel 906 around the outer surface of the horizontal flush valve 100. The claming arms 913 are attached to the basket structure 909 at a proximal end and include a tab on a distal end. When mated to the flush valve 100, the tabs of the clamping arms 913 engage the channel 906 to secure the basket structure 949 in position. In contrast to FIG. 20, a circular gasket 903 for sealing between the basket structure 949 and the mating surface of the flush orifice 106 is not included. The lower opening 946 of the basket structure 949 is enlarged to allow the sealing member 409 of the dual flush canister 403 to close directly onto the mating surface 943 of the flush orifice 106.

Figure 22B:
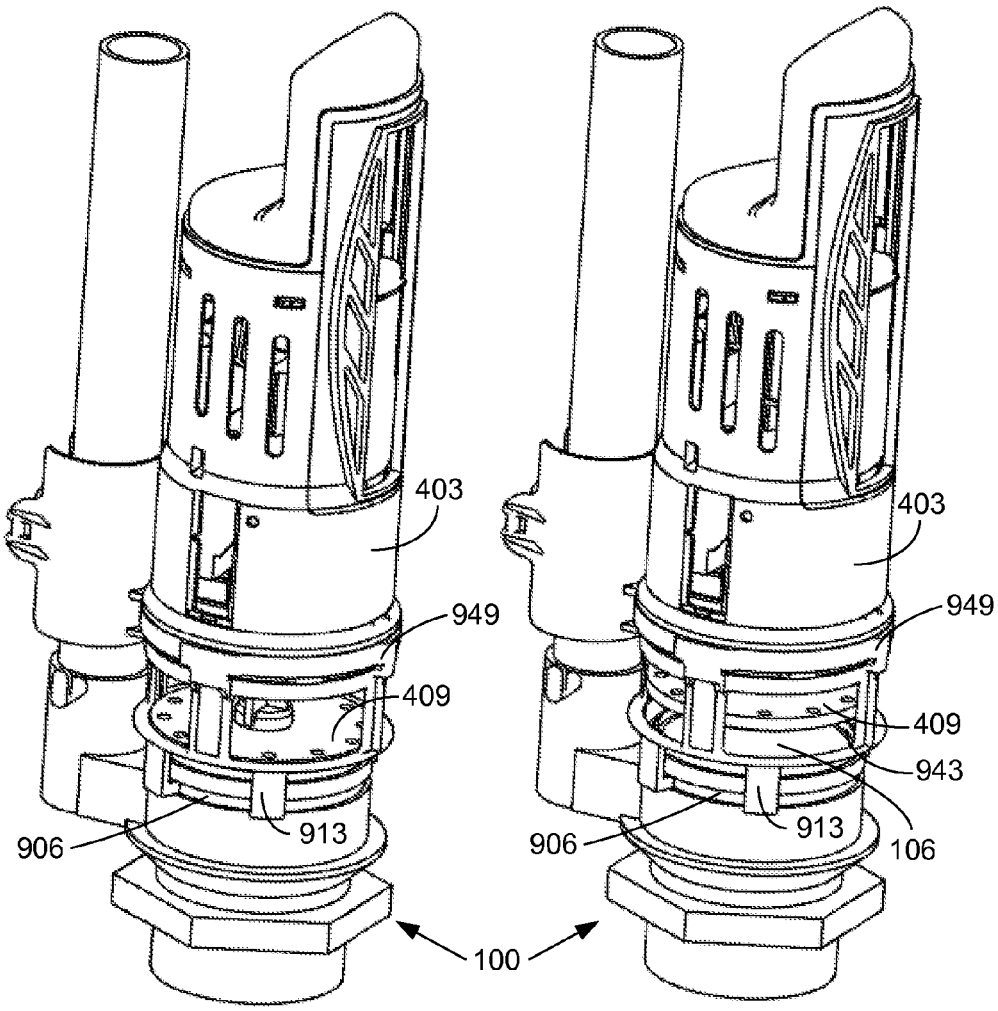
Figure 22B:
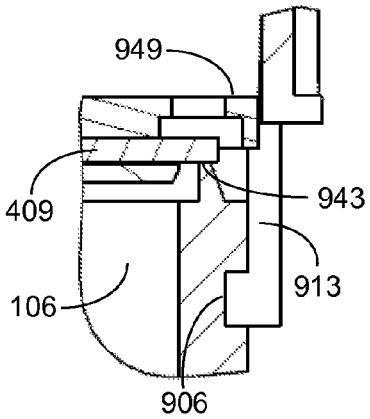

Referring now to FIG. 22B, shown is the coupling of a dual flush canister 403 to the adapter of FIG. 22A. When the dual flush canister 403 is idle, the sealing member 409 is extended downward to close directly on the mating surface 943 of the flush orifice 106. When the dual flush canister 403 is activated, the sealing member 409 is retracted upward to allow water to flow through the flush orifice 106.

Figure 23:
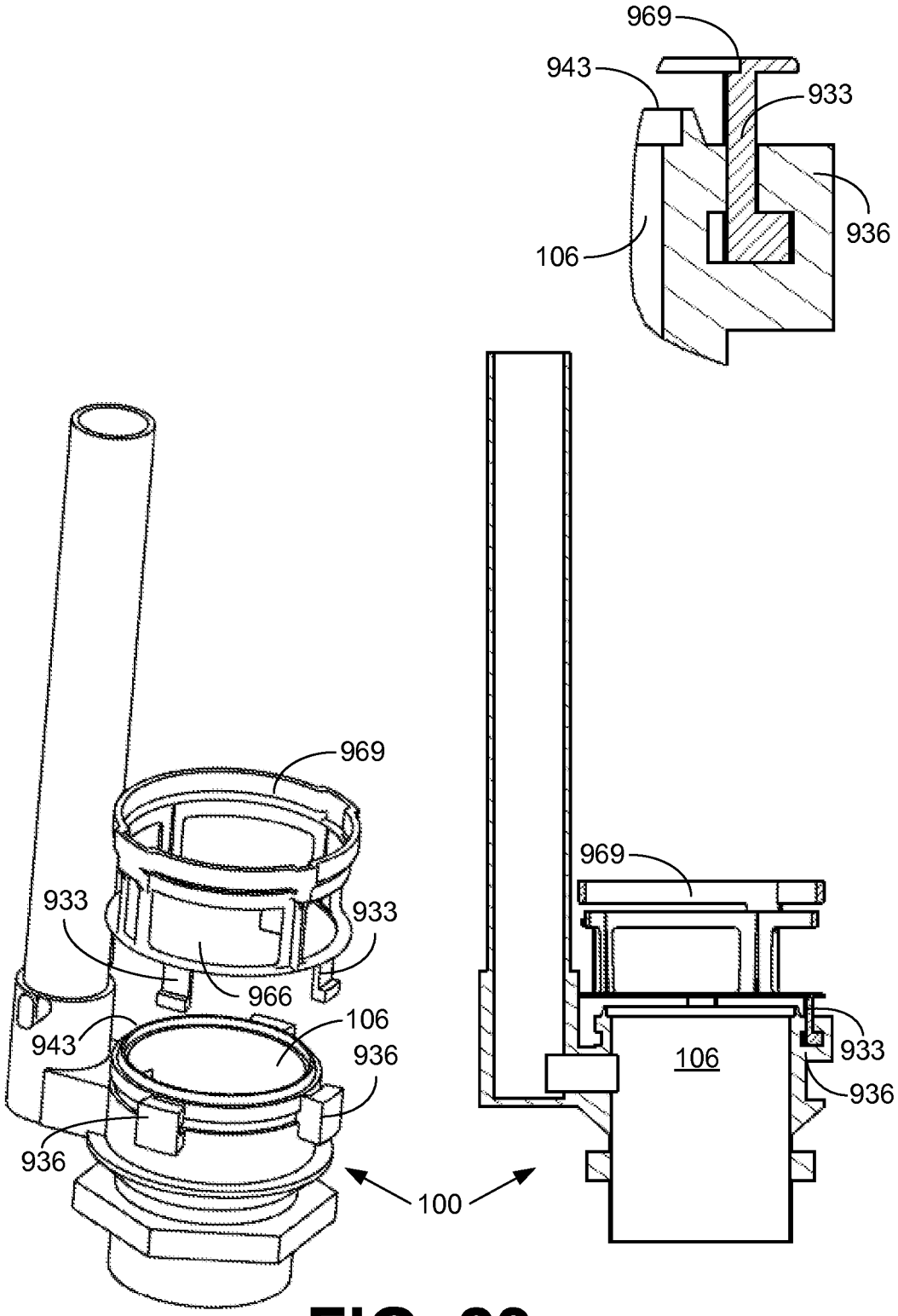

A variation of the embodiment of FIG. 22A is illustrated in FIG. 23. In the embodiment of FIG. 23, the basket structure 969 includes one or more clamping arms 933 configured to mate directly with a corresponding plurality of securing clips 936 distributed around the outer surface of the horizontal flush valve 100. When mated to the flush valve 100, the tabs of the clamping arms 933 engage the corresponding securing clip 936 to secure the basket structure 909 in position. As in FIG. 22A, sealing between the basket structure 949 and the mating surface of the flush orifice 106 is not included and lower opening 966 of the basket structure 969 is enlarged to allow the sealing member 409 of the dual flush canister 403 to close directly onto the mating surface 943 of the flush orifice 106. In a variation of the embodiment of FIG. 23, the design of the clamping arms 933 and the securing clips 936 may allow the basket structure 969 to become permanently affixed or molded to the dual flush canister 403. By configuring the flush valve 100 to accept the dual flush canister 403 while retaining the flapper ears (109 of FIG. 1A, 1123 of FIGS. 30, and 1156 of FIGS. 35 and 36), it allows the flush valve 100 to function as either a standard Douglas style flush valve with a flapper or as a dual flush valve.

While the exemplary embodiments of FIGS. 18-23 are depicted with a clamp for attachment to the overflow tube, the clamp may be eliminated in other embodiments.

Figure 24:
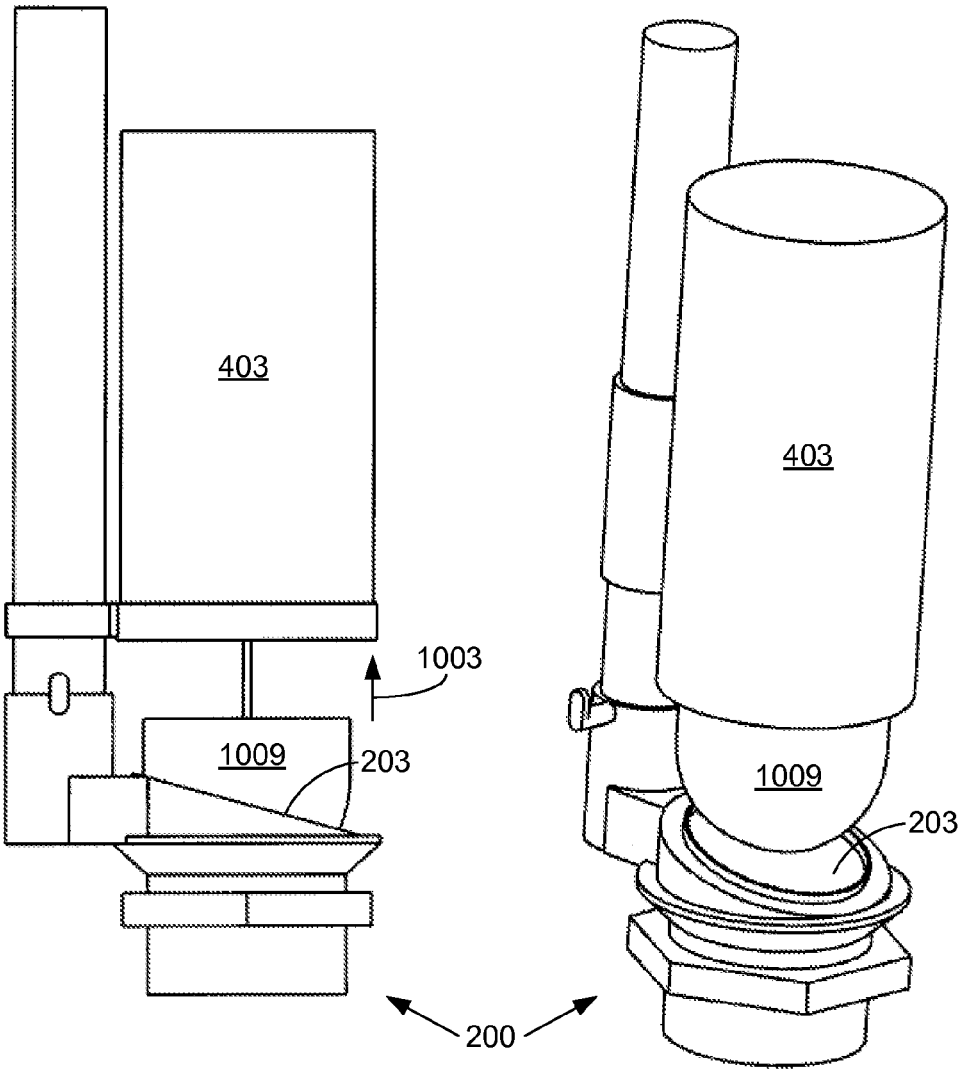

With reference to FIGS. 24-27, shown are exemplary embodiments of a flapper of the dual flush canister. In the embodiment of FIG. 24, the dual flush canister 403 utilizes a semi-spherical sealing ball-like flapper 1009 to seal the flush orifice 203 (or 106). When activated, the dual flush canister 403 retracts (arrow 1003) the semi-spherical sealing ball-like flapper 1009 to allow fluids to pass through the flush orifice 203. When operation is completed, the dual flush canister 403 returns to the idle position sealing the flush orifice 203. In some embodiments, the semi-spherical sealing ball-like flapper 1009 includes a wing 1013 as illustrated in FIG. 25. The wing 1013 extends the sealing surface to allow the semi-spherical sealing ball-like flapper 1009 to function on larger diameter horizontal flush valves 100 to aid in sealing of the flush orifice 106. Spacing of the dual flush canister 403 over the flush orifice 203 may be dictated by one or more spacer legs 1016 as depicted in FIG. 26.

Figure 27:
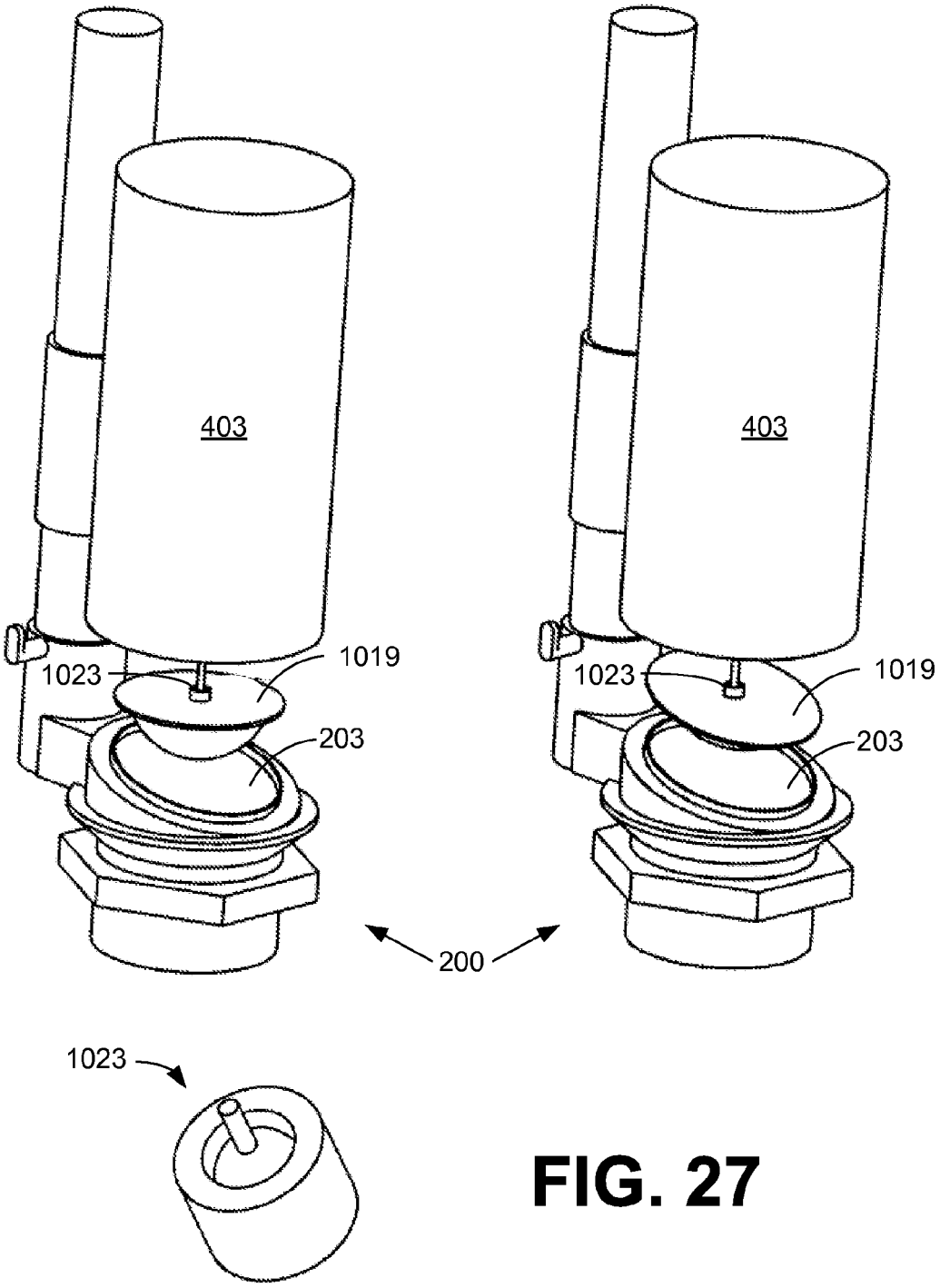

FIG. 27 depicts another exemplary semi-spherical disc-like flapper 1019 including a pivot joint 1023. The pivot joint 1023 may a ball joint arrangement. In one embodiment, the pivot joint 1023 may be locked into a specific orientation to facilitate alignment of the semi-spherical disc-like flapper 1019 with the mating surface of the flush orifice 203. In other embodiments, the pivot joint 1023 allows for movement of the semi-spherical disc-like flapper 1019 as it aligns with the flush orifice 203.

Figure 28:
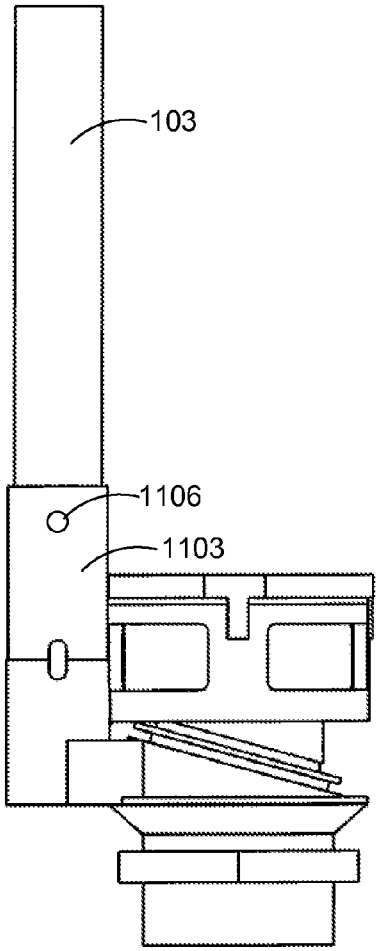
FIGS. 28-44 illustrate examples of securing a dual flush adapter to a toilet flush valve of FIGS. 1A-D or FIGS. 2A-C according to various embodiments.
Figure 29:
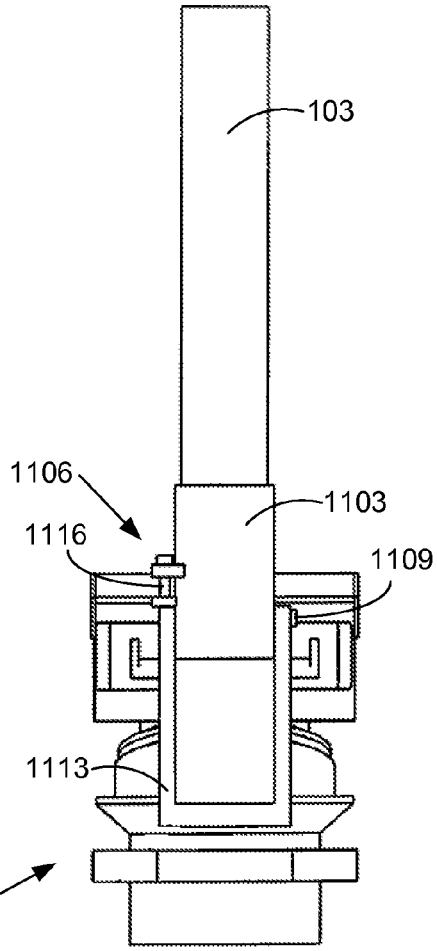
Figure 30:
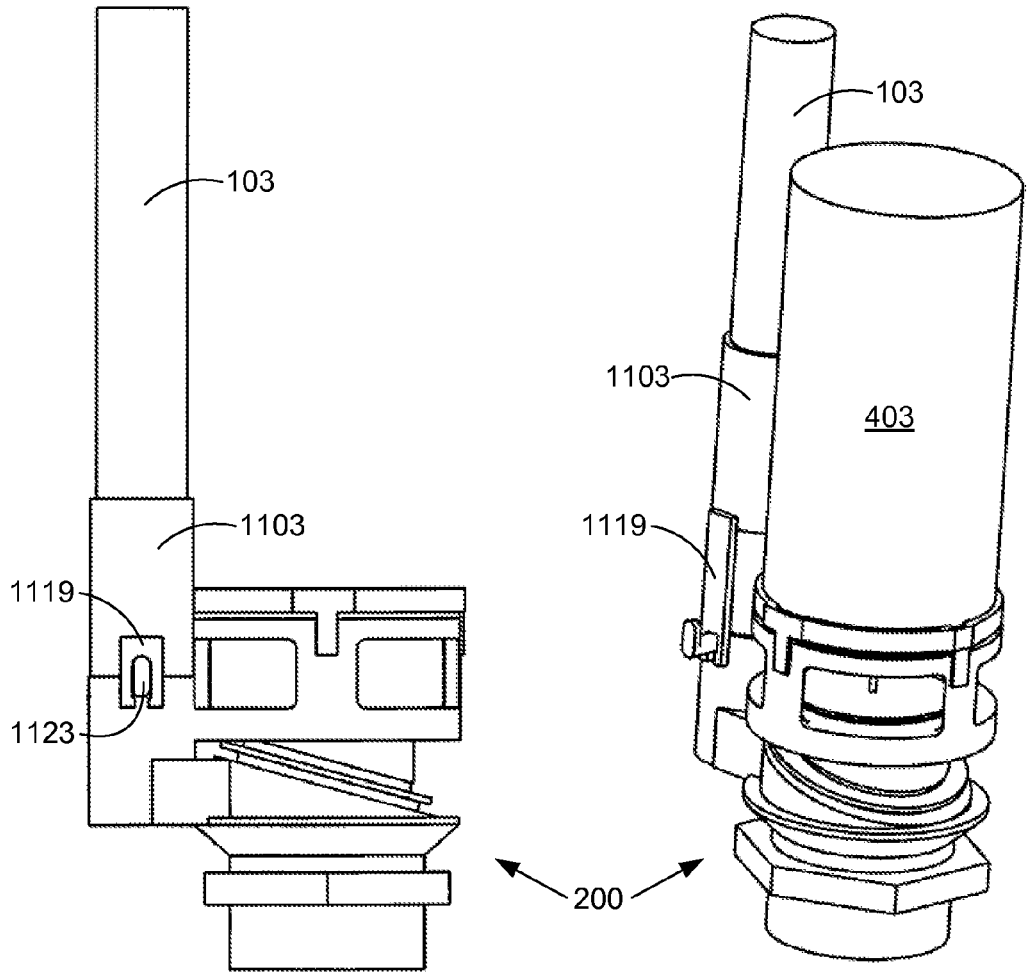

With reference to FIGS. 28-44, shown are embodiments for securing a dual flush adapter to a toilet flush valve. FIG. 28 illustrates an adapter including a sleeve 1103 that fits around the overflow tube 103. A set screw 1106 secures the sleeve, and thus the adapter to the toilet flush valve 200 (or 100). In the embodiment of FIG. 29, a clamp assembly 1106 attached to the sleeve 1103 wraps around the bottom of the overflow tube 103. A pivot point 1109 allows the clamp bar 1113 to be moved aside as the sleeve 1103 is positioned on the overflow tube 103. The clamp bar 1113 may then be positioned under the bottom of the overflow tube 103. Tightening a screw 1116 or other fastening device secures the clamp bar 1113, and thus the adapter, in position on the toilet flush valve 200 (or 100). FIG. 30 depicts an adapter including a sleeve 1103 with a clip 1119 that attaches to a tab or ear 1123 (see also 109 of FIG. 1A) that extends from the side of the overflow tube 103 of the Douglas style flush valve 200 (or 100) that traditionally attaches to a flapper. Alternatively, the sleeve 1103 may be attached to the dual flush canister 403 to secure the adapter in position on the toilet flush valve 200 (or 100) using a clip 1119.

Figure 31:
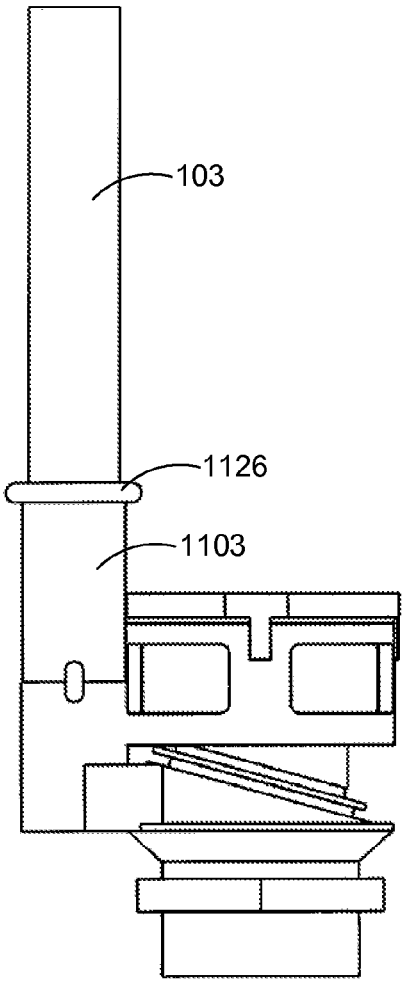
Figure 32:
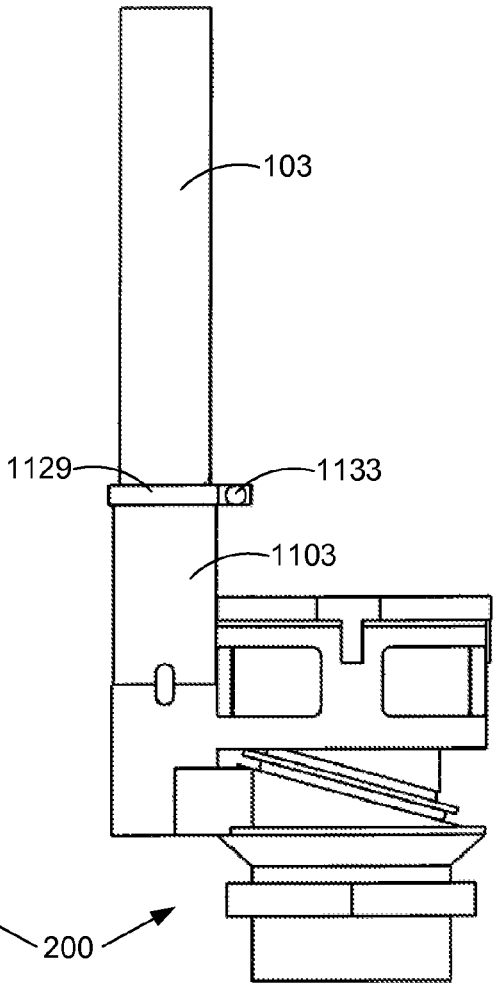

FIG. 31 illustrates an adapter secured by a compression ring 1126 that fits around the overflow tube 103. A friction fit secures the compression ring 1126 in position on the overflow tube 103. The compression ring 1126 may be manufactured from rubber or other elastic material. When placed appropriately on the overflow tube 103, the compression ring 1126 applies a downward force to the top of the sleeve 1103 and secures the adapter in position on the toilet flush valve 200 (or 100). In the embodiment of FIG. 32, a circular clamp 1129 is used to secure the adapter in position on the toilet flush valve 200 (or 100). A screw 1133 or other fastener is used to tighten the circular clamp 1129 in position on the overflow tube 103.

Figure 33:
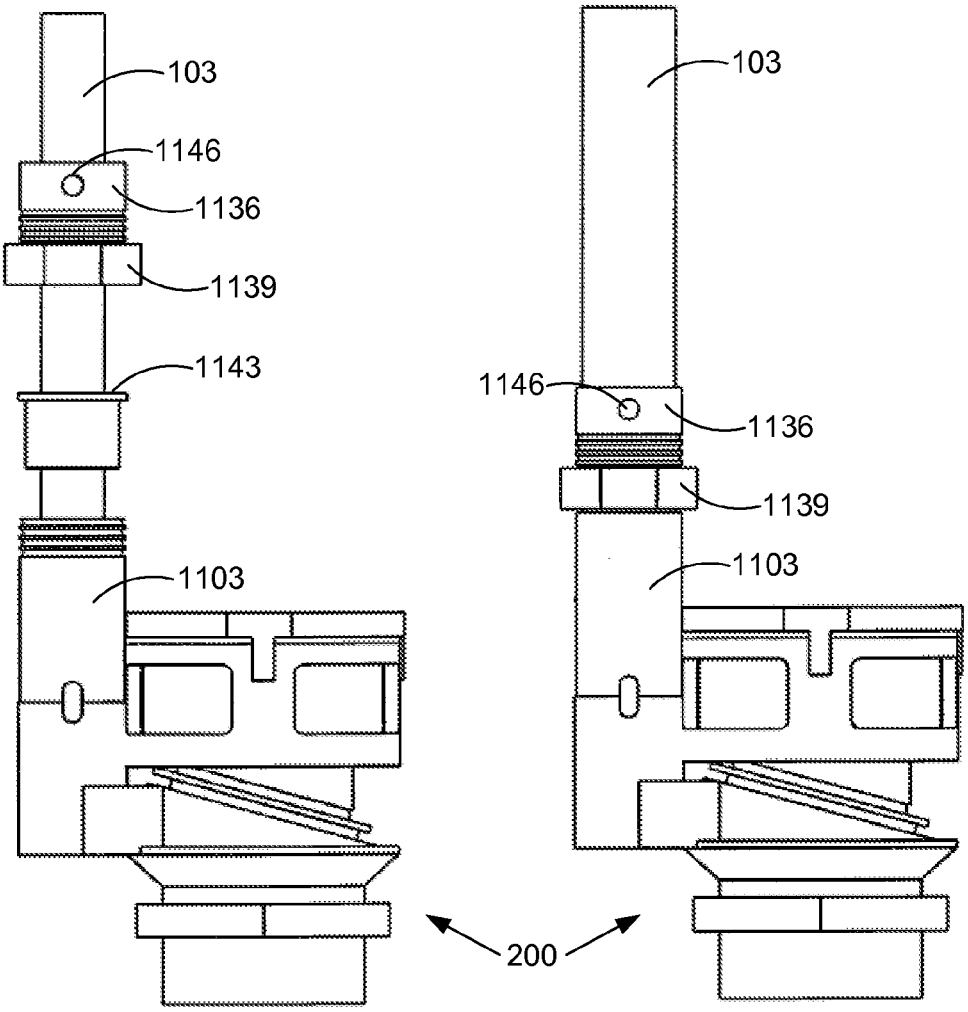
Figure 34:
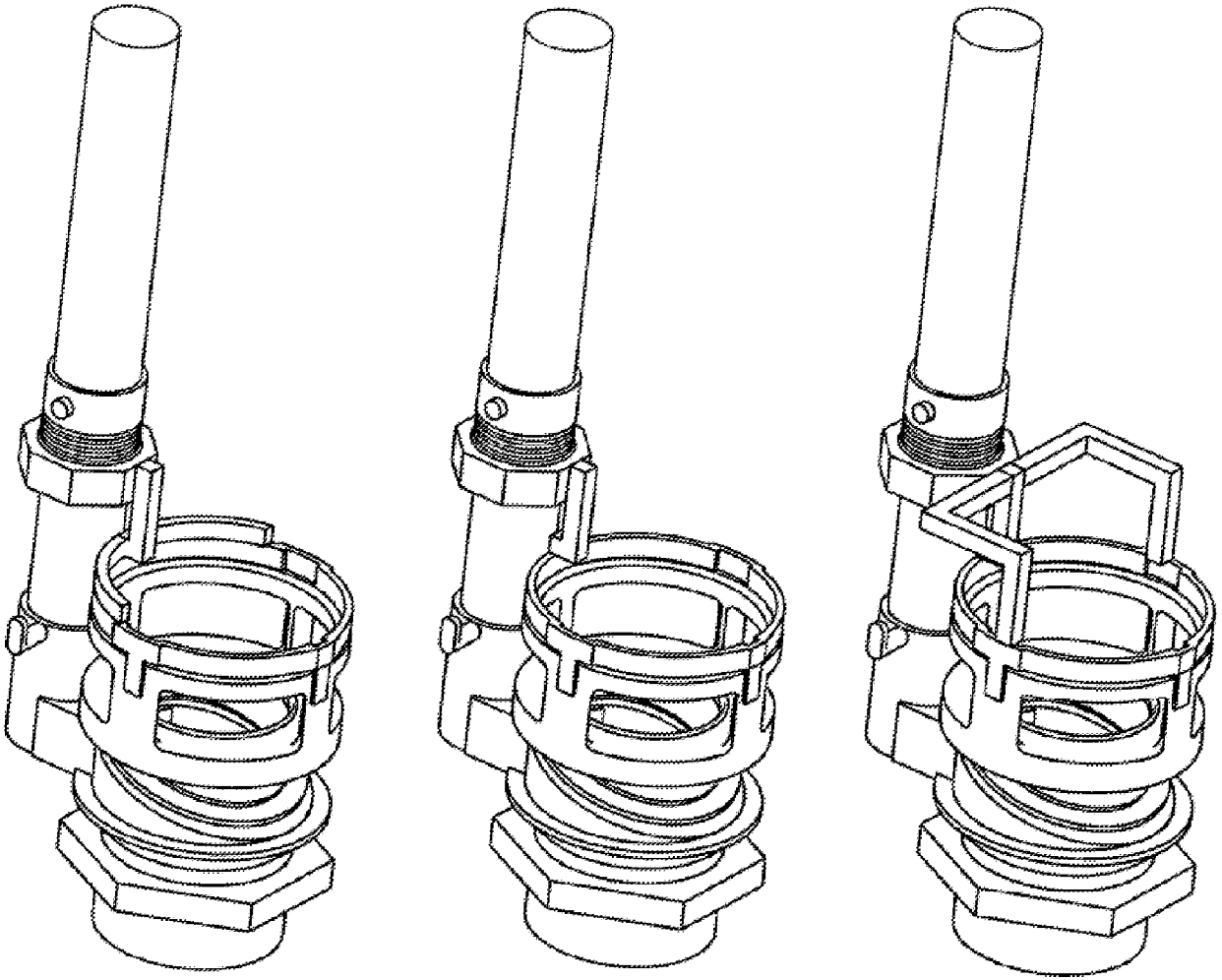

Referring now to FIG. 33, an adapter is secured in position by a threaded sleeve 1136 and nut 1139 combination. In some embodiments, a sleeve adapter 1143 may be nested between the overflow tube 103 and sleeve 1103 for proper alignment. The threaded sleeve 1136 and nut 1139 combination is positioned on the overflow tube 103 at the top of the sleeve 1103 and secured in position on the overflow tube by a set screw 1146, thereby securing the adapter in position on the toilet flush valve 200 (or 100). By adjusting the position of the nut 1139 on the threaded sleeve 1136, the downward force applied to the sleeve 1103 and adapter may be adjusted to apply a downward force for sealing. In some embodiments, the sleeve 1103 is threaded to engage with the nut 1139. In the embodiments of FIG. 34, the adapter is secured in position using other securing structures that directly interface with the basket structure. While the embodiments depicted in FIG. 34 engage the top of the basket structure, other embodiments may engage with other openings of the basket structure to secure the adapter in position on the toilet flush valve 200 (or 100).

Figure 35:
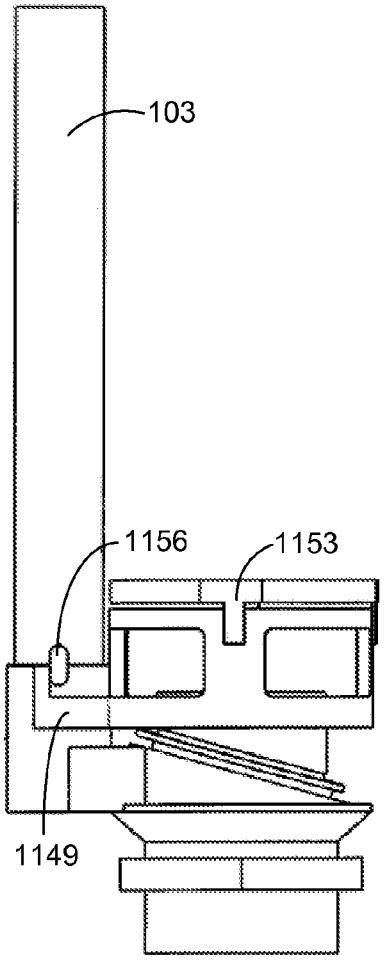
Figure 36:
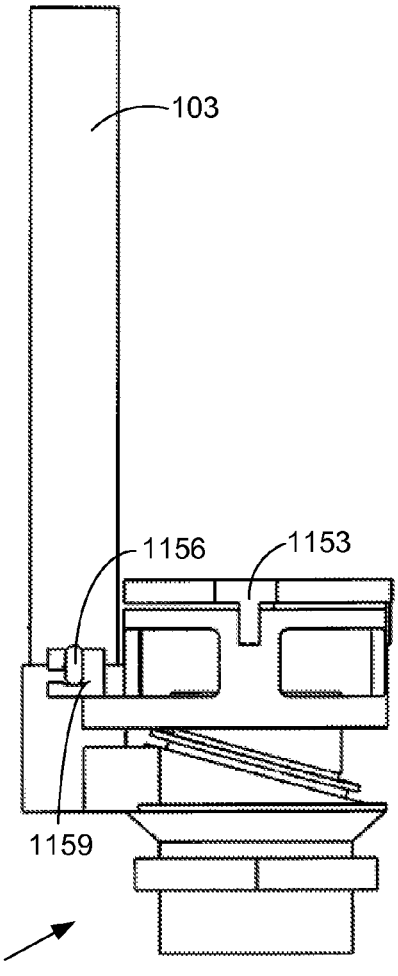
Figure 37:
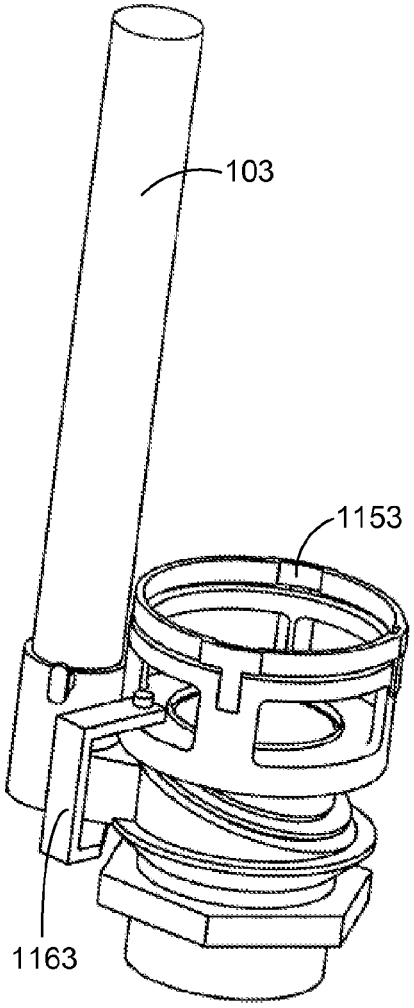
Figure 38:
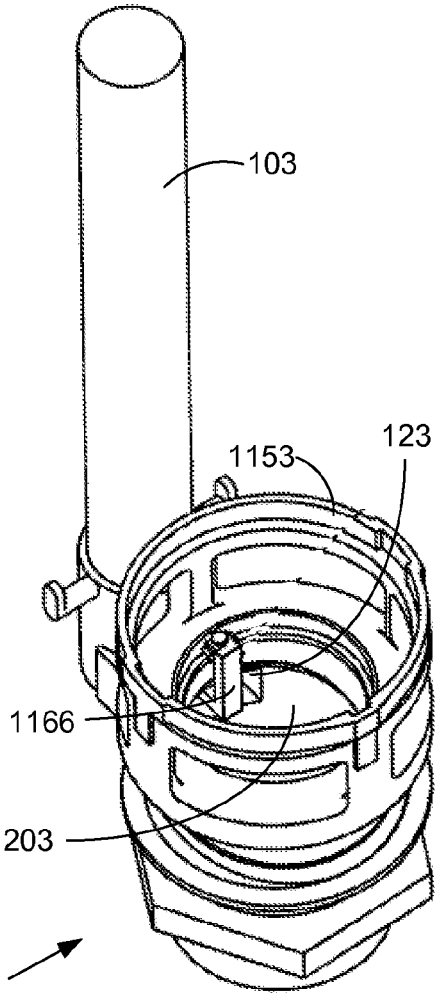

FIGS. 35-43 depict other embodiments of an adapter that is secured in position on the toilet flush valve through the basket structure of the adapter. In FIG. 35, arms 1149 extend from the basket structure 1153 and engage with traditional Douglas style flush valve 200 (or 100) flapper ears or tabs 1156 (see also 109 of FIG. 1A) that extend from the sides of the overflow tube 103 to secure the adapter in position. In FIG. 36, a clip 1159 extending from the basket structure 1153 attaches to a tab 1156 that extends from the side of the overflow tube 103. In the embodiment of FIG. 37, a c-clamp 1163 secures the adapter to the bottom of the overflow tube 103. The c-clamp 1163 may include threaded fasteners on one or both ends to adjust the clamping force applied. Alternatively, a c-clamp 1166 may secure the adapter to the drain opening 123 of the overflow tube 103 as depicted in FIG. 38. The c-clamp 1166 may be positioned inside the orifice 203 (or 106) and attached between the top of the drain opening 123 and an inner lip of the basket structure 1153.

Figure 39:
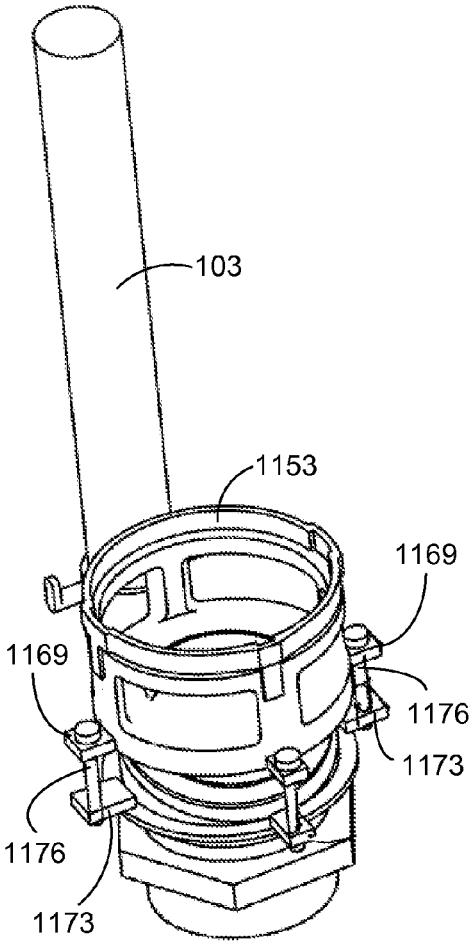

FIG. 39 illustrates an alternative embodiment for securing an adapter directly to the toilet flush valve. In the embodiment of FIG. 39, one or more ears 1169 are distributed around the basket structure 1153 of the adapter. One or more corresponding ears 1173 are distributed around the flush valve 200 (or 100). A bolt, screw, or other fastener 1176 extends between the corresponding ears 1169 and 1173 to secure the adapter to the flush valve. Compression of the fastener 1176 maintains position and sealing between the adapter and the flush valve. In some embodiments, the flush valve may be fabricated with ears 1173. In other embodiments, ears 1173 may be tabs that are positioned under a lip or flange of the flush valve and secured in position by compression of the fastener 1176.

Figure 40:
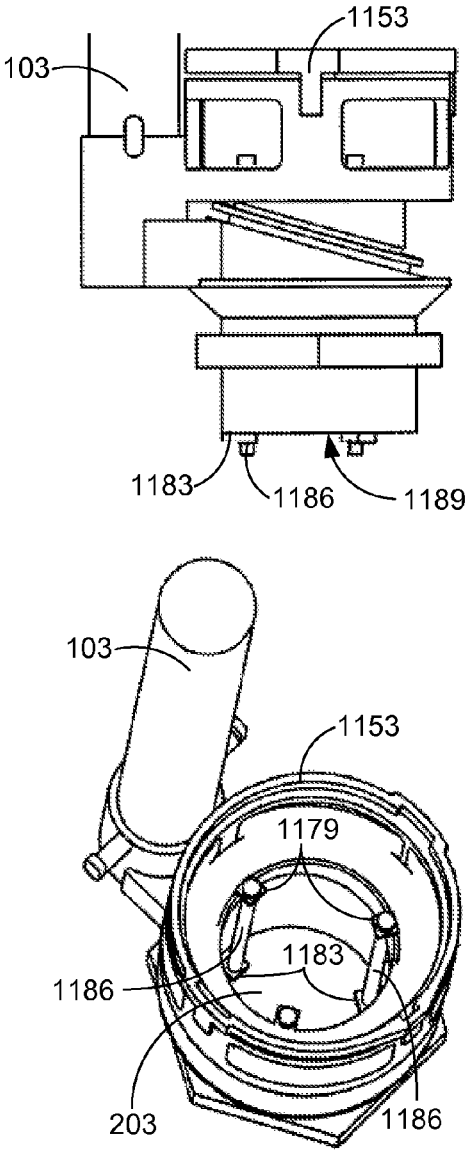

An adapter may also be secured to the toilet flush valve through the flush orifice. One or more ears 1179 may be distributed around the lower opening of the basket structure 1153 of the adapter. In the embodiment of FIG. 40, one or more corresponding ears 1183 are distributed around the inside of the lower opening 1189 of the flush valve 200 (or 100). A bolt, screw, or other fastener 1186 extends between the corresponding ears 1179 and 1183 to secure the adapter to the flush valve. Compression of the fastener 1186 maintains position and sealing between the adapter and the flush valve. In some embodiments, the flush valve may be fabricated with ears 1183 located around the inside of the lower opening 1189. Alternatively, the ears 1183 may be located around the inside of the orifice 203 (or 106). In other embodiments, ears 1183 may be tabs that are positioned under the lip of the lower opening 1189 of the flush valve and secured in position by compression of the fastener 1186.

Figure 41:
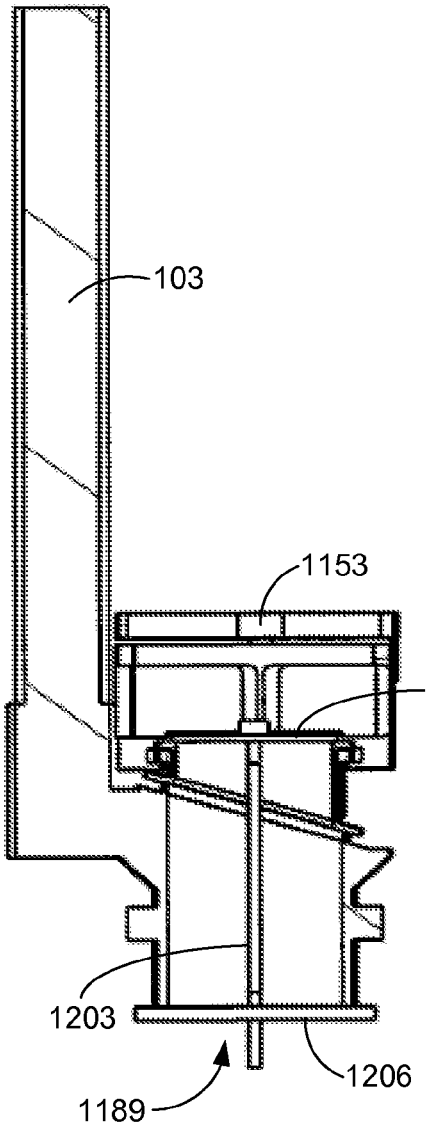
Figure 41:
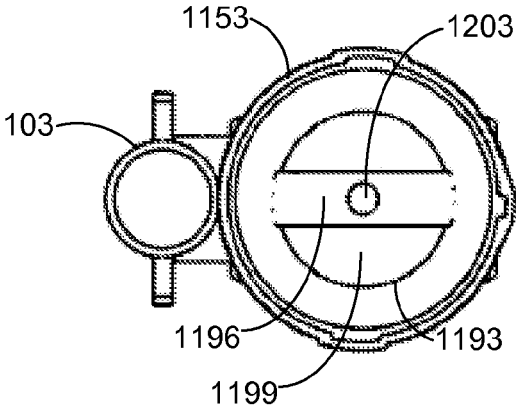
Figure 41:
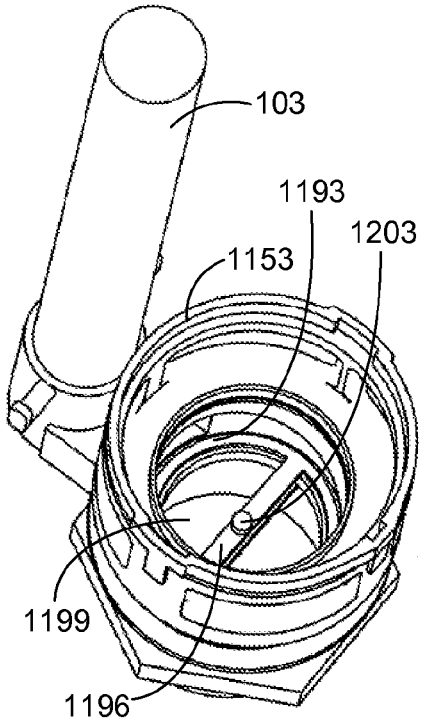

An adapter plate 1193 may also be used to secure an adapter to the toilet flush valve as illustrated in FIG. 41. The adapter plate 1193 includes a cross member 1196 to secure the adapter to the flush valve and one or more openings 1199 to allow for fluid to flow through the adapter plate 1193 and flush valve. In one embodiment, the adapter plate 1193 is part of the basket structure 1153. In other embodiments, the adapter plate 1193 is a separate plate that engages around the lower opening of the basket structure 1153. Alternatively, basket structure may include a mounting extension that extends below the basket structure into the flush valve orifice 106/203. The adapter plate 1193 may engage with or be a part of the lower portion of the mounting extension. The mounting extension may also include an opening that coincides with the drain opening 123 of the overflow tube 103.

A fastener 1203 such as, but not limited to, a bolt extends through the cross member 1196 to a lower fixing plate 1206. The lower fixing plate 1206 may be similar to the adapter plate 1193 including a cross member and one or more openings to allow for fluid to flow through the lower fixing plate 1206. The fastener may be secured by a nut or the lower fixing plate 1206 may include a threaded opening or other connection to receive the fastener as can be appreciated. Compression of the fastener 1203 secures the adapter to the flush valve. In one embodiment, the lower fixing plate 1206 is located under the lip of the lower opening 1189 of the flush valve. In other embodiments, the lower fixing plate 1206 may be positioned within the orifice 106/203 or under a lip or flange within the flush valve.

Figure 42:
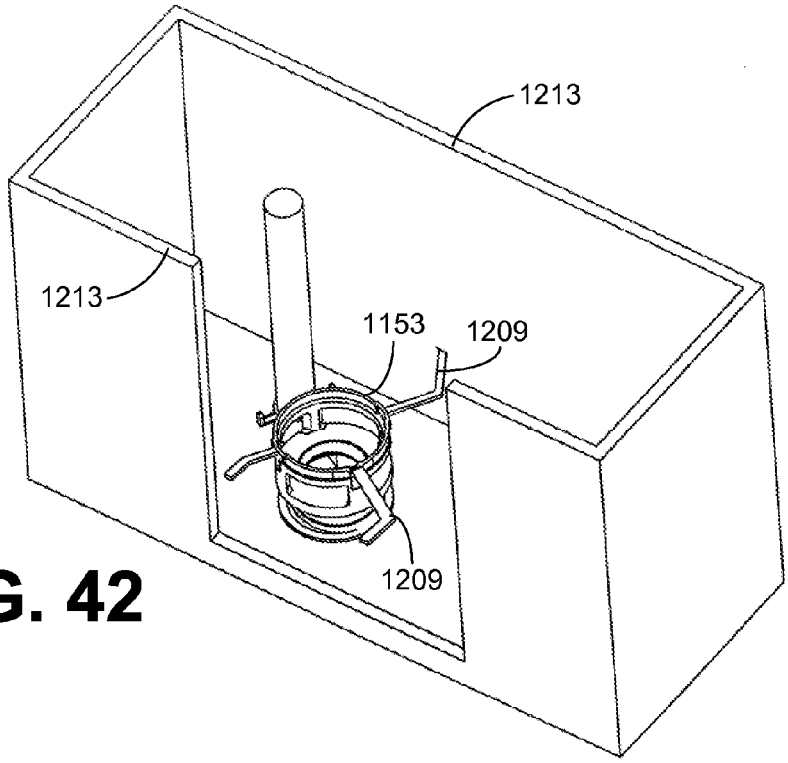
Figure 43:
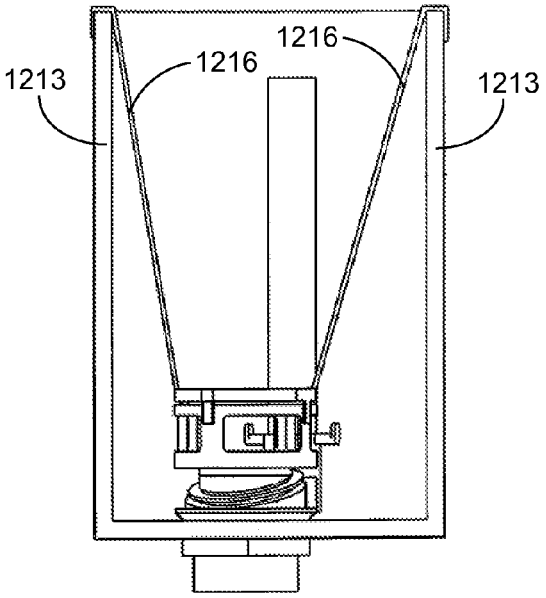

FIGS. 42-43 illustrate embodiments of an adapter that utilize the tank of the toilet to secure the adapter in position on a toilet flush valve. In the embodiment of FIG. 42, arms 1209 extending from the basket structure 1153 engage with the walls 1213 of the tank. An interference fit between the arms 1209 and tank walls 1213 secures the adapter in position. In FIG. 43, arms 1216 engaged with the top of the tank walls 1213 suspend the adapter in position on the toilet flush valve. A tank lid may apply a downward force through the arms 1216 to hold the adapter in position.

Figure 44:
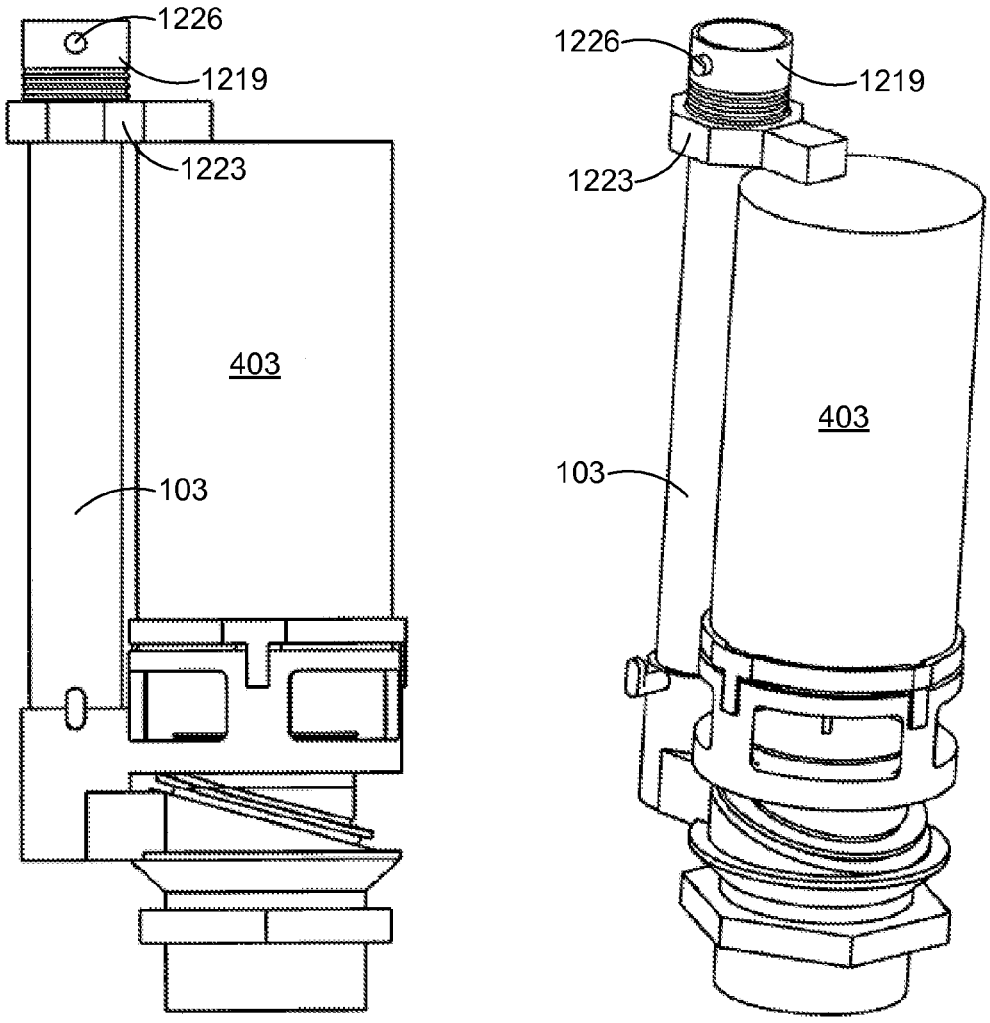

An adapter may also be secured in position on a toilet flush valve by applying a force to the top of the dual flush canister 403. For example, a weight may be position at the top of the dual flush canister 403 to secure and seal the adapter against the flush orifice. Alternatively, a threaded sleeve 1219 and nut 1223 combination as illustrated in FIG. 44 may be used to exert a downward force on the dual flush canister 403. The threaded sleeve 1219 and nut 1223 combination may be positioned at the top of the overflow tube 103 and secured in position on the overflow tube by a set screw 1226. The nut engages with the top of the dual flush canister 403, e.g., through an extension. By adjusting the position of the nut 1223 on the threaded sleeve 1219, the downward force applied to the dual flush canister 403, and thus the adapter, may be adjusted for sealing.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An adapter, comprising:

a flush opening configured to mate to a basket structure of a dual flush canister for a toilet, the dual flush canister being configured to provide both a short flush and a long flush of the toilet;

a flange configured to mate to a flush valve opening of a flush valve previously installed in the toilet, the flange being offset at an angle with respect to the flush opening;

a sealing material configured to provide a seal between the flange and the flush valve opening; and a mounting extension extending beyond the flange and configured to mate with an inside surface of the flush opening.

2. The adapter of claim 1, wherein the sealing material is further configured to be disposed against a mating surface of the flange.

3. The adapter of claim 1, wherein the sealing material is rubber.

4. An apparatus, comprising:

a basket structure having a first end and a second end, the first end being configured to couple to a dual flush canister for a toilet, the dual flush canister being configured to provide both a short flush and a long flush of the toilet;

a plurality of tabs extending inward toward a center axis of the basket structure, the plurality of tabs being configured to engage a lip of a flush opening of a flush valve previously installed in the toilet; and a plurality of support legs extending between the first end and the second end defining a plurality of passageways from an exterior of the basket structure to the flush opening.

5. The apparatus of claim 4, wherein the lip of the flush opening is defined by a channel around an outer surface of the flush opening.

6. The apparatus of claim 4, wherein the plurality of tabs secure the basket structure in position relative to the flush opening.

7. The apparatus of claim 4, wherein the first end is coupled to the dual flush canister via a plurality of mating ears fitting within an annular groove.

8. The apparatus of claim 7, wherein the plurality of mating ears slide within the annular groove.

9. The apparatus of claim 4, wherein the dual flush canister can be rotated with respect to the basket structure.

10. The apparatus of claim 4, wherein the plurality of tabs comprise tabs positioned around the flush opening to provide structural support.

11. The apparatus of claim 4, wherein the plurality of tabs comprise at least four tabs.

12. The apparatus of claim 4, wherein the plurality of support legs further comprise at least four support legs.

13. The apparatus of claim 4, wherein the plurality of tabs are positioned at the second end of the basket structure.

14. An apparatus, comprising:

a dual flush canister configured to provide both a short flush and a long flush of a toilet;

a basket structure having a first end and a second end, the first end being configured to couple to the dual flush canister;

a plurality of tabs extending inward toward a center axis of the basket structure, the plurality of tabs engaging a lip of an adapter flush opening of a flush valve adapter;

a plurality of support legs extending between the first end and the second end defining a plurality of passageways from an exterior of the basket structure to the adapter flush opening; and the flush valve adapter further comprising:

a flange configured to mate to a flush valve opening of a previously installed flush valve in the toilet, the flange being offset at an angle with respect to the adapter flush opening; and a sealing material forming a seal between the flange and the flush valve opening.

15. The apparatus of claim 14, wherein the sealing material is disposed against a mating surface of the flange.

16. The apparatus of claim 14, wherein the plurality of tabs secure the basket structure in position relative to the flush opening.

17. The apparatus of claim 14, wherein the first end is coupled to the dual flush canister via a plurality of mating ears fitting within an annular groove.

18. The apparatus of claim 17, wherein the plurality of mating ears slide within the annular groove.

19. The apparatus of claim 14, wherein the dual flush canister can be rotated with respect to the basket structure.

20. An apparatus, comprising:

a dual flush canister configured to provide both a short flush and a long flush of a toilet;

a basket structure having a first end and a second end, the first end being configured to couple to the dual flush canister;

a plurality of support legs extending between the first end and the second end defining a plurality of passageways from an exterior of the basket structure to a flush opening; and a circular support structure configured to align the dual flush canister with the flush opening, the circular support structure having an inner diameter greater than an outer diameter of a toilet overflow tube.

21. The apparatus of claim 20, wherein the circular support structure is mounted on the toilet overflow tube.

* * * * *